US005469128A

United States Patent [19]

Kawanishi et al.

[11] Patent Number: 5,469,128

[45] Date of Patent: Nov. 21, 1995

[54] CIRCUIT ELEMENTS FOR MICROWAVE AND MILLIMETER-WAVE BANDS AND METHOD OF PRODUCING SAME

[75] Inventors: Umeo Kawanishi; Nobuhisa Hirayama; Takeshi Hamabe, Yokohama; Toru Takagi, Yokosuka, all of Japan

[73] Assignees: Nissan Motor Co., Ltd., Yokohama; Nippon Valqua Industries, Ltd., Tokyo, both of Japan

[21] Appl. No.: 305,624

[22] Filed: Sep. 14, 1994

[30] Foreign Application Priority Data

Sep. 17, 1993 [JP] Japan ..... 5-254708
Sep. 17, 1993 [JP] Japan ..... 5-254712

[51] Int. Cl.[6] ..... H01P 1/26

[52] U.S. Cl. ..... 333/22 R; 264/1.7; 264/112; 343/910; 333/33; 333/81 B; 333/219.1; 333/258

[58] Field of Search ..... 333/101, 102, 333/22 R, 33, 34, 81 B, 239, 248, 258

[56] References Cited

U.S. PATENT DOCUMENTS 4,020,427 4/1977 Connerney et al. ..... 333/22 R
4,458,218 7/1984 Babbitt et al. ..... 333/248 X
4,463,330 7/1984 Yoneyama ..... 333/239

*Primary Examiner*—Paul Gensler
*Attorney, Agent, or Firm*—Lowe, Price, LeBlanc & Becker

[57] ABSTRACT

A circuit element for microwave and millimeter-wave bands and a method of producing the same. A dielectric line is made of a pure dielectric resin. A high-frequency wave absorbing member is made of a pure dielectric resin containing at least one of first, second and third powders dispersed therein. The first powder having a high specific inductive capacity, the second powder having a high magnetic permeability, and the third powder having a high specific resistance. A compression molding technique is used to fusion bond the high-frequency wave absorbing member to the dielectric line.

9 Claims, 37 Drawing Sheets

FIG.31
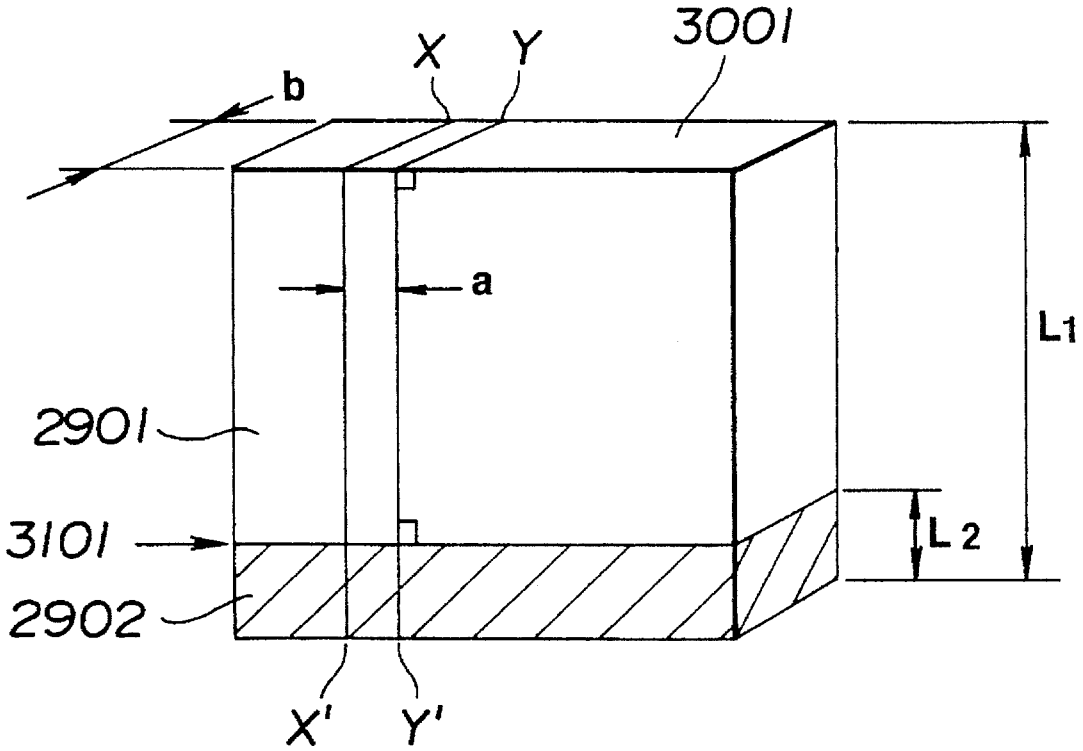
FIG.32A
FIG.32B
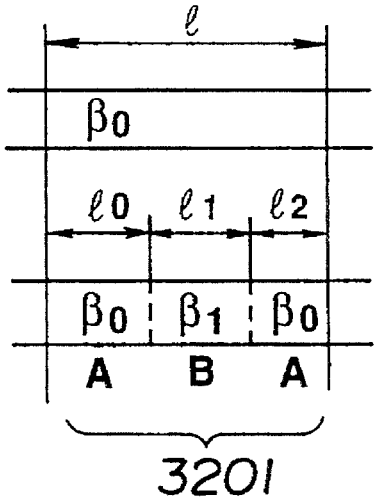

$\gamma_0=\alpha_0+j\beta_0$ $\gamma_2=\alpha_2+j\beta_2$ $\ell_1 \ell_2 << \lambda g$ $L \leq \frac{\lambda g}{4}$ $L \leq \frac{\lambda g}{4}$

CIRCUIT ELEMENTS FOR MICROWAVE AND MILLIMETER-WAVE BANDS AND METHOD OF PRODUCING SAME

BACKGROUND OF THE INVENTION

This invention relates to circuit elements such as resistive terminators, attenuators, matching lines, resonator elements, switching lines, electromagnetic lens and the like used for microwave and millimeter-wave bands and to a method of producing such circuit elements.

It is the conventional practice to produce such a circuit element by the use of an adhesive or double sided adhesive tape to joint various electric parts thereof. Since the electric circuit is for microwave and millimeter-wave bands and has a very small size, however, the conventional practice requires a troublesome assembling process and fails to improve the efficiency on a mass production basis. In addition, the jointed electric parts are subjected to separation and deviation at their junctions, causing changes in the electric characteristic of the circuit element. Furthermore, the adhesive is subject to chemical changes in contact with moisture. This causes changes in the electric characteristic of the circuit element with the lapse of time.

SUMMARY OF THE INVENTION

It is a main object of the invention to provide an improved circuit element for microwave and millimeter-wave bands which exhibits good electric characteristics unchanged over a very long period of time.

Another object of the invention is to provide an improved circuit element for microwave and millimeter-wave bands which can be produced economically on a mass production basis.

Another object of the invention is to provide an improved method which can produce circuit elements for microwave and millimeter-wave bands having stable electric characteristics.

Still another object of the invention is to provide an improved method which can produce circuit elements for microwave and millimeter-wave bands economically on a mass production basis.

There is provided, in accordance with the invention, a circuit element for microwave and millimeter-wave bands The circuit element comprises a dielectric line made of a pure dielectric resin, and a high-frequency wave absorbing member made of a pure dielectric resin containing at least one of first, second and third powders dispersed therein. The first powder has a high specific inductive capacity, the second powder has a high magnetic permeability, and the third powder has a high specific resistance. The high-frequency wave absorbing member is stuck as a unit to the dielectric line.

In another aspect of the invention, there is provided a method of producing a circuit element for microwave and millimeter-wave bands. The method comprises the steps of: compression molding a predetermined amount of a pure dielectric resin having a low specific inductive capacity under pressure to produce a first molded member; supplying a powder dispersed dielectric resin onto the first molded member, the powder dispersed dielectric resin including a pure dielectric resin containing a predetermined amount of at least one of first, second and third powders dispersed uniformly therein, the first powder having a high specific inductive capacity, the second powder having a high magnetic permeability, and the third powder having a high specific resistance; compression molding the supplied powder dispersed dielectric resin under pressure along with the first molded member to produce a second molded member stuck to the first molded member; and heating the first molded member fusion bonded to the second molded member.

In another aspect of the invention, there is provided a method of producing a circuit element for microwave and millimeter-wave bands. The method comprises the steps of: premolding a pure dielectric resin under pressure to produce a first premolded member; premolding a powder dispersed dielectric resin under pressure to produce a second premolded member, the powder dispersed dielectric resin including a pure dielectric resin containing a predetermined amount of at last one of first, second and third powders dispersed uniformly therein, the first powder having a high specific inductive capacity, the second powder having a high magnetic permeability, and the third powder having a high specific resistance; placing the second premolded member on the first premolded member; and compression heating the second premolded member along with the first premolded member to fusion bond the first and second premolded members.

In another aspect of the invention, there is provided a method of producing a circuit element for microwave and millimeter-wave bands. The method comprises the steps of: premolding a pure dielectric resin under pressure to produce first premolded members; premolding a powder dispersed dielectric resin under pressure to produce a second premolded member, the powder dispersed dielectric resin including a pure dielectric resin containing a predetermined amount of at least one of first, second and third powders dispersed uniformly therein, the first powder having a high specific inductive capacity, the second powder having a high magnetic permeability, and the third powder having a high specific resistance; placing the second premolded member between the first premolded members; and compression heating the second premolded member along with the first premolded members to fusion bond the first and second premolded members.

In another aspect of the invention, there is provided a method of producing a circuit element for microwave and millimeter-wave bands. The method comprises the steps of: premolding a pure dielectric resin under pressure to produce a first premolded member; premolding a powder dispersed dielectric resin under pressure to produce a second premolded member, the powder dispersed dielectric resin including a pure dielectric resin containing a predetermined amount of at least one of first, second and third powders dispersed uniformly therein, the first powder having a high specific inductive capacity, the second powder having a high magnetic permeability, and the third powder having a high specific resistance; placing the first and second premolded members into end surface contact with each other; and compression heating the second premolded member along with the first premolded member to fusion bond the first and second premolded members.

In another aspect of the invention, there is provided a method of producing a circuit element for microwave and millimeter-wave bands. The method comprises the steps of: premolding a pure dielectric resin under pressure to produce a first premolded member; sintering the first premolded member to produce a first sintered member; premolding a powder dispersed dielectric resin under pressure to produce a second premolded member, the powder dispersed dielectric resin including a pure dielectric resin containing a predetermined amount of at last one of first, second and third powders dispersed uniformly therein, the first powder having a high specific inductive capacity, the second powder having a high magnetic permeability, and the third powder having a high specific resistance; sintering the second premolded member to produce a second sintered member; placing the second sintered member on the first sintered member; and compression heating the second premolded member along with the first premolded member to fusion bond the first and second premolded members.

In another aspect of the invention, there is provided a method of producing a circuit element for microwave and millimeter-wave bands. The method comprises the steps of: premolding a pure dielectric resin under pressure to produce first premolded members; sintering the first premolded members to produce first sintered members; premolding a powder dispersed dielectric resin under pressure to produce a second premolded member, the powder dispersed dielectric resin including a pure dielectric resin containing a predetermined amount of at least one of first, second and third powders dispersed uniformly therein, the first powder having a high specific inductive capacity, the second powder having a high magnetic permeability, and the third powder having a high specific resistance; sintering the second premolded member to produce a second sintered member; placing the second sintered member between the first sintered members; and compression heating the second sintered member along with the first sintered members to fusion bond the first and second sintered members.

In another aspect of the invention, there is provided a method of producing a circuit element for microwave and millimeter-wave bands. The method comprises the steps of: premolding a pure dielectric resin under pressure to produce a first premolded member; sintering the first premolded member to produce a first sintered member; premolding a powder dispersed dielectric resin under pressure to produce a second premolded member, the powder dispersed dielectric resin including a pure dielectric resin containing a predetermined amount of at least one of first, second and third powders dispersed uniformly therein, the first powder having a high specific inductive capacity, the second powder having a high magnetic permeability, and the third powder having a high specific resistance; sintering the second premolded member to produce a second sintered member; placing the first and second sintered members into end surface contact with each other; and compression heating the second sintered member along with the first sintered member to fusion bond the first and second sintered members.

In another aspect of the invention, there is provided a circuit element for microwave and millimeter-wave bands. The circuit element comprises a dielectric line made of a pure dielectric resin, and a high-frequency wave absorbing member made of a pure dielectric resin containing a powder dispersed therein. The powder has a high specific resistance. The high-frequency wave absorbing member is fusion bonded at an inclined boundary to the dielectric line.

In another aspect of the invention, there is provided a circuit element for microwave and millimeter-wave bands. The circuit element comprises a dielectric line made of a pure dielectric resin, and a high-frequency wave absorbing member fusion bonded to the dielectric line. The high-frequency wave absorbing member is made of a pure dielectric resin containing a percentage of a powder dispersed therein. The powder has a high specific resistance. The powder percentage changes in a direction away from the dielectric line.

In another aspect of the invention, there is provided a method of producing a circuit element for microwave and millimeter-wave bands. The method comprises the steps of: compression molding a predetermined amount of a pure dielectric resin having a low specific inductive capacity under pressure to produce a first molded member; supplying a powder dispersed dielectric resin onto the first molded member, the powder dispersed dielectric resin including a pure dielectric resin containing predetermined percentages of powder dispersed therein, the powder having a high specific resistance; compression molding the supplied powder dispersed dielectric resin under pressure along with the first molded member to produce a second molded member fusion bonded to the first molded member; and heating the first and second molded members.

In another aspect of the invention, there is provided a method of producing a circuit element for microwave and millimeter-wave bands. The method comprises the steps of: compression molding a predetermined amount of a pure dielectric resin having a low specific inductive capacity under pressure to produce first molded members; supplying a powder dispersed dielectric resin between the first molded members, the powder dispersed dielectric resin including a pure dielectric resin containing predetermined percentages of a powder dispersed therein, the powder having a high specific resistance; compression molding the supplied powder dispersed dielectric resin under pressure along with the first molded members to produce a second molded member fusion bonded to the first molded members; and heating the first and second molded members.

In another aspect of the invention, there is provided a circuit element for microwave and millimeter-wave bands. The circuit element comprises a dielectric line made of a pure dielectric resin, and a high-frequency wave absorbing member made of a pure dielectric resin containing a powder dispersed therein. The powder has a high magnetic permeability. The high-frequency wave absorbing member is fusion bonded at an inclined boundary to the dielectric line.

In another aspect of the invention, there is provided a circuit element for microwave and millimeter-wave bands. The circuit element comprises a dielectric line made of a pure dielectric resin, and a high-frequency wave absorbing member fusion bonded to the dielectric line. The high-frequency wave absorbing member is made of a pure dielectric resin containing a percentage of a powder dispersed therein. The powder has a high magnetic permeability. The powder percentage changes in a direction away from the dielectric line.

In another aspect of the invention, there is provided a method of producing a circuit element for microwave and millimeter-wave bands. The method comprises the steps of: compression molding a predetermined amount of a pure dielectric resin having a low specific inductive capacity under pressure to produce a first molded member; supplying a powder dispersed dielectric resin onto the first molded member, the powder dispersed dielectric resin including a pure dielectric resin containing predetermined percentages of powder dispersed therein, the powder having a high magnetic permeability; compression molding the supplied powder dispersed dielectric resin under pressure along with the first molded member to produce a second molded member fusion bonded to the first molded member; and heating the first and second molded members.

In another aspect of the invention, there is provided a method of producing a circuit element for microwave and millimeter-wave bands. The method comprises the steps of: compression molding a predetermined amount of a pure dielectric resin having a low specific inductive capacity under pressure to produce first molded members; supplying a powder dispersed dielectric resin between the first molded members, the powder dispersed dielectric resin including a pure dielectric resin containing predetermined percentages of a powder dispersed therein, the powder having a high magnetic permeability; compression molding the supplied powder dispersed dielectric resin under pressure along with the first molded members to produce a second molded member fusion bonded to the first molded members; and heating the first and second molded members.

In another aspect of the invention, there is provided a circuit element for microwave and millimeter-wave bands. The circuit element comprises a dielectric line made of a pure dielectric resin, and a high-frequency wave absorbing member made of a pure dielectric resin containing a powder dispersed therein. The powder has a high specific inductive capacity. The high-frequency wave absorbing member is fusion bonded at an inclined boundary to the dielectric line.

In another aspect of the invention, there is provided a circuit element for microwave and millimeter-wave bands. The circuit element comprises a dielectric line made of a pure dielectric resin, and a high-frequency wave absorbing member fusion bonded to the dielectric line. The high-frequency wave absorbing member is made of a pure dielectric resin containing a percentage of a powder dispersed therein. The powder has a high specific inductive capacity. The powder percentage changes in a direction away from the dielectric line.

In another aspect of the invention, there is provided a dielectric resin electromagnetic lens comprising phase zones disposed circumfrentially in a concentric relationship with one another to form a lens member having a substantially uniform thickness in the direction of transmission of an electromagnetic wave. Each of the phase zones is specified for a phase determined by one of values into which original phases obtained from a Fresnel zone chart are rounded with respect to discontinuous finite values.

In another aspect of the invention, there is provided a method of producing a dielectric resin electromagnetic lens. The method comprises the steps of: preparing a center member made of fluorine resin; dispersing different percentages of a dielectric powder in fluorine resin to produce circumferential members having different specific inductive capacities; disposing the circumferential members in a concentric relationship with one another around the center member to produce a lens member; and sintering the lens member to fusion bonded the center and circumferential members to one another.

In another aspect of the invention, there is provided a method of producing a circuit element for microwave and millimeter-wave bands. The method comprises the steps of: compression molding a predetermined amount of a pure dielectric resin having a low specific inductive capacity under pressure to produce a first molded member; supplying a powder dispersed dielectric resin onto the first molded member, the powder dispersed dielectric resin including a pure dielectric resin containing predetermined percentages of powder dispersed therein, the powder having a high specific inductive capacity; compression molding the supplied powder dispersed dielectric resin under pressure along with the first molded member to produce a second molded member fusion bonded to the first molded member; and heating the first and second molded members.

In another aspect of the invention, there is provided a method of producing a circuit element for microwave and millimeter-wave bands. The method comprises the steps of: compression molding a predetermined amount of a pure dielectric resin having a low specific inductive capacity under pressure to produce first molded members; supplying a powder dispersed dielectric resin between the first molded members, the powder dispersed dielectric resin including a pure dielectric resin containing predetermined percentages of a powder dispersed therein, the powder having a high specific inductive capacity; compression molding the supplied powder dispersed dielectric resin under pressure along with the first molded members to produce a second molded member fusion bonded to the first molded members; and heating the first and second molded members.

In another aspect of the invention, there is provided a circuit element for microwave and millimeter-wave bands. The circuit element comprises a dielectric line made of a pure dielectric resin, and a high-frequency wave absorbing member made of a pure dielectric resin containing two of first, second and third powders dispersed therein. The first powder has a high specific inductive capacity, the second powder has a high magnetic permeability, the third powder has a high specific resistance. The high-frequency wave absorbing member is fusion bonded as a unit to the dielectric line.

In another aspect of the invention, there is provided a circuit element for microwave and millimeter-wave bands. The circuit element comprises a dielectric line made of a pure dielectric resin, and a high-frequency wave absorbing member made of a pure dielectric resin containing first, second and third powders dispersed therein. The first powder has a high specific inductive capacity, the second powder has a high magnetic permeability, and the third powder has a high specific resistance. The high-frequency wave absorbing member is fusion bonded as a unit to the dielectric line.

In another aspect of the invention, there is provided a method of producing a circuit element for microwave and millimeter-wave bands. The method comprises the steps of: compression molding a predetermined amount of a pure dielectric resin having a low specific inductive capacity under pressure to produce first molded members; supplying a powder dispersed dielectric resin between the first molded members, the powder dispersed dielectric resin including a pure dielectric resin containing a predetermined amount of two of first, second and third powders dispersed uniformly therein, the first powder having a high specific inductive capacity, the second powder having a high magnetic permeability, and the third powder having a high specific resistance; compression molding the supplied powder dispersed dielectric resin under pressure along with the first molded member to produce a second molded member fusion bonded to the first molded member; and heating the first molded member fusion bonded to the second molded member.

In another aspect of the invention, there is provided a method of producing a circuit element for microwave and millimeter-wave bands. The method comprises the steps of: compression molding a predetermined amount of a pure dielectric resin having a low specific inductive capacity under pressure to produce first molded members; supplying a powder dispersed dielectric resin between the first molded members, the powder dispersed dielectric resin including a pure dielectric resin containing a predetermined amount of first, second and third powders dispersed uniformly therein, the first powder having a high specific inductive capacity, the second powder having a high magnetic permeability, and the third powder having a high specific resistance; compression molding the supplied powder dispersed dielectric resin under pressure along with the first molded member to produce a second molded member fusion bonded to the first molded member; and heating the first molded member fusion bonded to the second molded member.

BRIEF DESCRIPTION OF THE DRAWINGS

The invention will be described in greater detail by reference to the following description taken in connection with the accompanying drawings, in which:

FIG. 31 is a perspective view used in explaining another method of producing the matching line of the invention;

FIGS. 32A and 32B are schematic diagrams used in explaining a phase adjusting circuit to which the matching line of the invention is applicable;

DETAILED DESCRIPTION OF THE INVENTION

Figure 1:
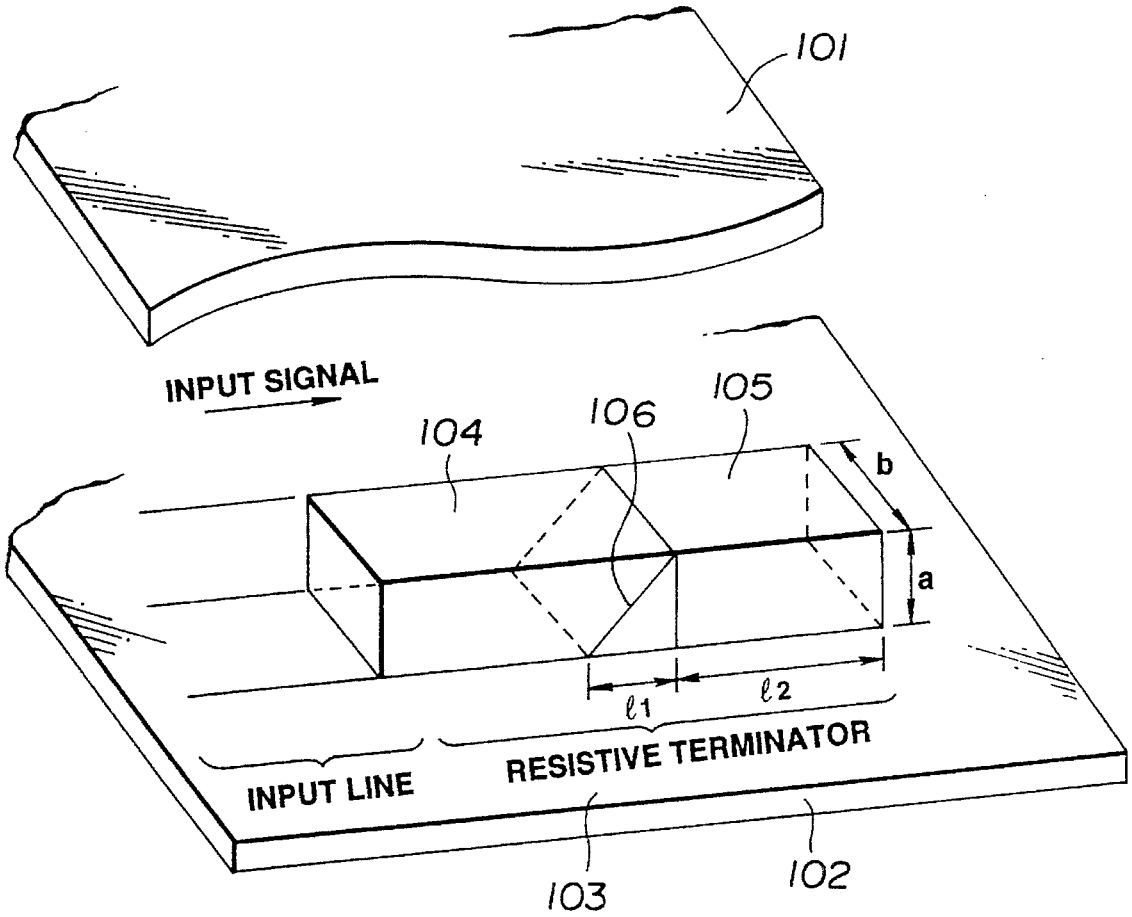
FIG. 1 is a fragmentary perspective view showing a resistive terminator for use in a non-radiative dielectric (NRD) wave guide of the invention.
Figure 2:
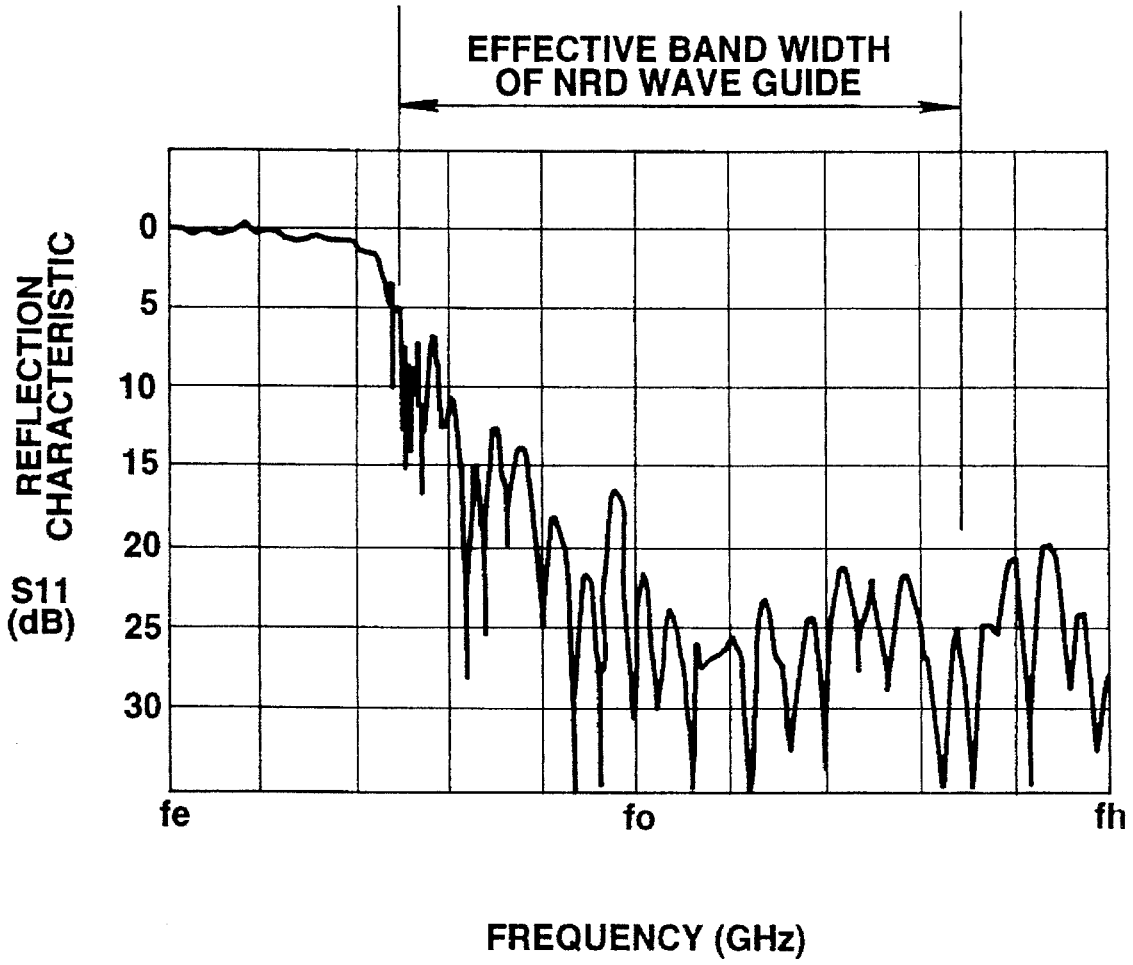
FIG. 2 is a graph used in explaining the reflection characteristic of the resistive terminator.

With reference to the drawings, wherein like numerals refer to like parts in the several views, and in particular to FIG. 1, there is shown a resistive terminator for use in a non-radiative dielectric (NRD) wave guide embodying the invention. The resistive terminator 103, which is disposed between upper and lower conductive plates 101 and 102, has a pure dielectric resin portion 104 provided on the input side thereof and a high-frequency electromagnetic wave absorber portion 105 provided on the output side thereof. The numeral 106 designates an inclined boundary surface at which the portions 104 and 105 are fusion bonded strongly with each other. The pure dielectric resin portion 104 is made of a pure dielectric resin such as pure fluorine resin or the like, and the high-frequency electromagnetic wave absorber portion 105 is made of a dielectric resin containing a predetermined weight or volume percentage of an electromagnetic wave absorbing powder or particle uniformly dispersed therein. The material of the electromagnetic wave absorbing powder or particle may be carbon, graphite, carbon fiber, ferrite or the like. For example, a high-frequency electromagnetic wave absorber portion 105 taken in the form of a fluorine resin containing about 3 to 15 percent by weight of carbon powder or particle uniformly dispersed therein will provide a good reflection characteristic to the resistive terminator 103, as shown in FIG. 2. The high-frequency electromagnetic wave absorber portion 105 has a predetermined height (a) between its upper and lower surfaces and a predetermined width (b). The upper surface has a length equal to a second length $l_2$ and the lower surface has a length equal to a first length $l_1$ plus the second length $l_2$. The boundary surface 106 is inclined at a predetermined angle θ in order to improve the reflection characteristic of the resistive terminator 103. The angle θ of inclination of the boundary surface 106 is determined by the first length $l_1$ since the height a of the resistive terminator 103 is fixed. This inclination is effective to relax the degree of reflection on the boundary surface 106 so as to provide a good characteristic over a wide frequency range. The rear resistive terminator portion of the length $\mathbf{l_2}$ absorbs and attenuates the electromagnetic wave power to a sufficient extent.

Figure 3:
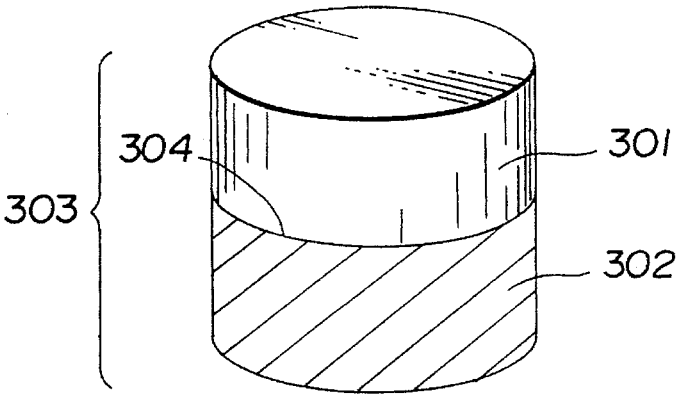
FIG. 3 is a perspective view showing a cylindrical resistive terminator ingot.
Figure 4:
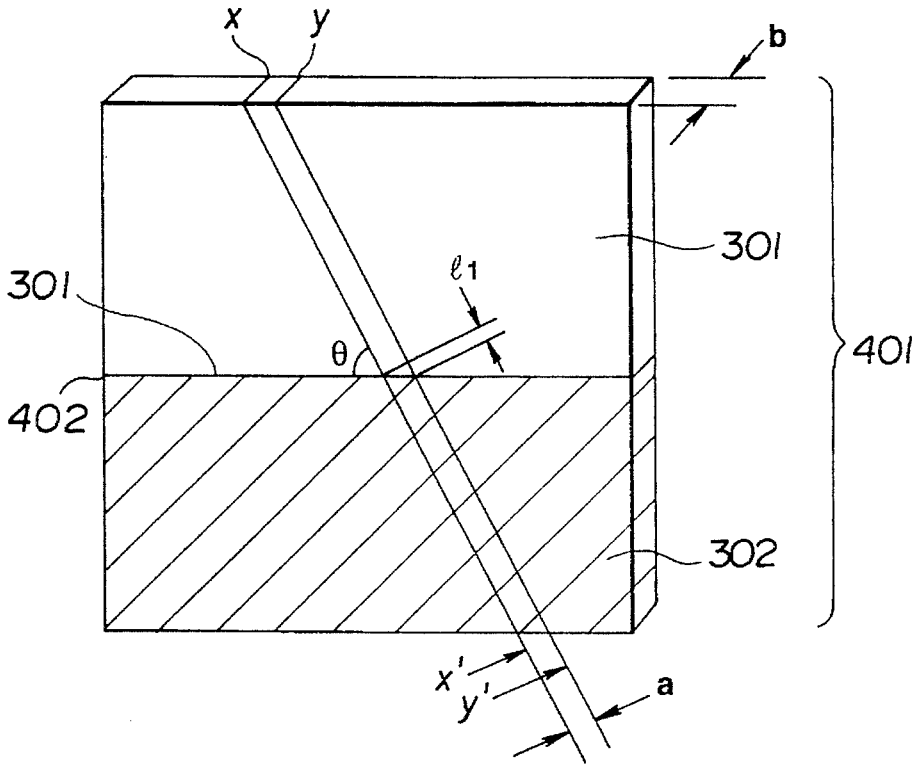
FIG. 4 is a perspective view showing a resistive terminator plate which is cut into a number of resistive terminators of the invention.

Description will be made to a method of production of the resistive terminator 103 of the invention. A predetermined amount of polytetrafluoroethylene (PTFE) resin, which has a low dielectric constant, is supplied into a bottomed cylindrical metal mold. A force piston is used to pressurize the supplied PTFE resin. The appropriate surface pressure applied to the supplied PTFE resin is greater than 0.5 $Kgf/cm^2$ and preferably 25 $Kgf/cm^2$. Upon completion of this pressurized premolding process, a predetermined amount of PTFE resin containing about 10 percent by weight of carbon powder (electromagnetic wave absorbing powder) uniformly dispersed therein is supplied onto the upper surface of the PTFE resin premolded in the metal mold. The force piston is used again to pressurize the supplied PTFE resin against the premolded PTFE resin to mold a resistive terminator block. This compression molding process is made under a molding pressure ranging from 50 $Kgf/cm^2$to 700 $Kgf/cm^2$and preferably 250 $Kgf/cm^2$. As shown in FIG. 3, the resistive terminator block 303 has a dielectric portion 301 molded on a high-frequency electromagnetic wave absorber portion 302. It was confirmed that the dielectric portion 301 was fusion bonded strongly at a smooth boundary surface 304 to the high-frequency electromagnetic wave absorber portion 302. The produced resistive terminator block 303 is take out of the cylindrical metal mold and, then, it is sintered for three hours at a temperature higher than the melting point (327° C.) of the PTFE resin. A preferable sintering temperature is 340° C. It was confirmed that the sintered resistive terminator block 303 had the dielectric portion 301 integrally fusion bonded at the boundary surface 304 to the high-frequency electromagnetic wave absorber portion 302. The resistive terminator block 303 may be produced by sintering the molded block in the cylindrical metal mold. Furthermore, the PTFE resin containing an electromagnetic wave absorbing powder dispersed uniformly therein may be premolded in another cylindrical metal mold before it is molded along with the PTFE resin premolded in the cylindrical metal mold. Upon completion of this compression molding process, the resistive terminator block 303 is cut into a number of resistive terminator plates 401, as shown in FIG. 4. A resistive terminator 103 is produced by obliquely cutting the resistive terminator plate 401 along lines x–x' and y–y' inclined at an angle θ with respect to the line 402 (corresponding to the boundary surface 304) at which the high-frequency electromagnetic wave absorber portion 302 is fusion bonded to the dielectric portion 301. It was confirmed that the pure dielectric resin portion was strongly fusion bonded to the electromagnetic wave absorber portion at the boundary surface.

Figure 5A:
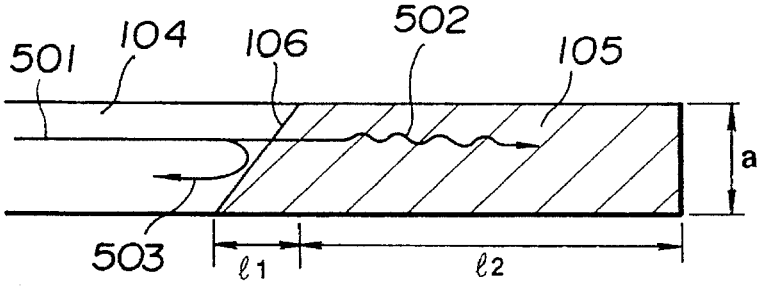
FIGS. 5A, 5B and 5C are schematic views used in explaining the different resistive terminator reflection characteristics.
Figure 5B:
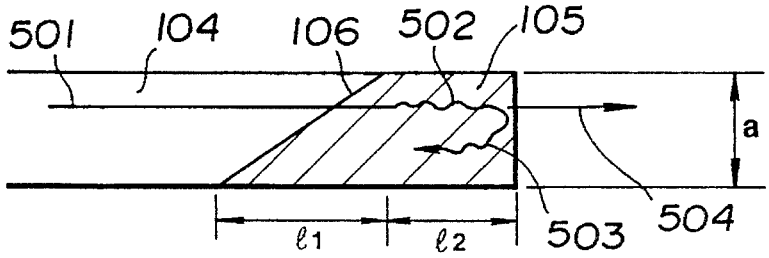
Figure 5C:
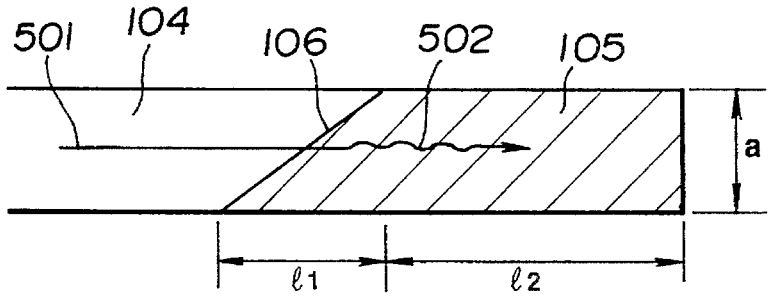

Description will be made to the parameters having an influence on the wide band non-reflection characteristic of the resistive terminator 103. These parameters include the density of the electromagnetic wave absorbing powder dispersed in the high-frequency electromagnetic wave absorber portion 105, the angle θ of inclination of the boundary surface 106 between the portions 104 and 105 of the resistive terminator 103 (that is, the length $l_1$), and the length $l_2$ of the lower surface of the electromagnetic wave absorber portion 105 of the resistive terminator 103. The angle θ of inclination of the boundary surface 106 between the portions 104 and 105 of the resistive terminator 103 should be set within an appropriate range. If the boundary surface 106 is inclined at an angle greater than this appropriate range, as shown in FIG. 5A, the signal 501 inputted into the resistive terminator 103 will partially reflects on the boundary surface 106, as indicated by the arrow 503 of FIG. 5A, and provide a poor wide band non-reflection characteristic to the resistive terminator 103. Furthermore, the length $l_2$ of the high-frequency electromagnetic wave absorber portion 105 should be set within an appropriate range. If the high-frequency electromagnetic wave absorber portion 105 has a length $l_2$ shorter than this appropriate range even though the boundary surface 106 is inclined at an appropriate angle, as shown in FIG. 5B, the inputted signal will be partially transmitted through the high-frequency electromagnetic wave absorber portion 105, as indicated by the arrow 504 of FIG. 5B, and provide a poor wide band non-reflection characteristic to the resistive terminator 103. If the resistive terminator 103 has a boundary surface 106 inclined at an appropriate angle θ and a high-frequency electromagnetic wave absorbing portion 105 of an appropriate length $l_2$, as shown in FIG. 5C, the inputted signal 501 will be transmitted into the high-frequency electromagnetic wave absorber portion 105 without partial reflection on the boundary surface 106, as indicated by the arrow 502 of FIG. 5C, and without partial transmission through the high-frequency electromagnetic wave absorber portion 105.

Figure 6A:
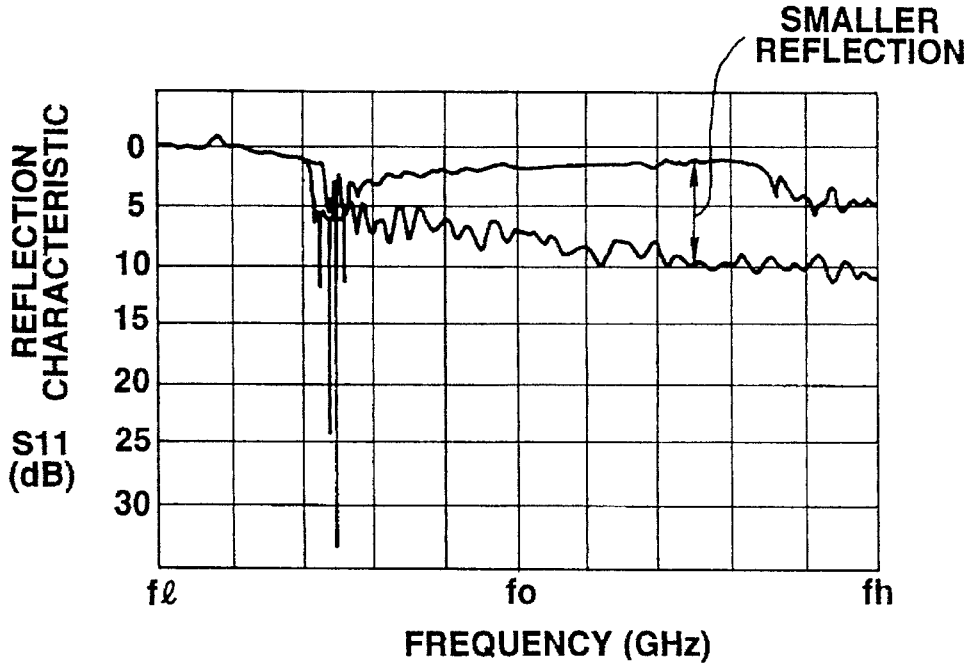
FIGS. 6A and 6B are graphs used in explaining the resistive terminator reflection characteristics with respect to frequency.
Figure 6B:
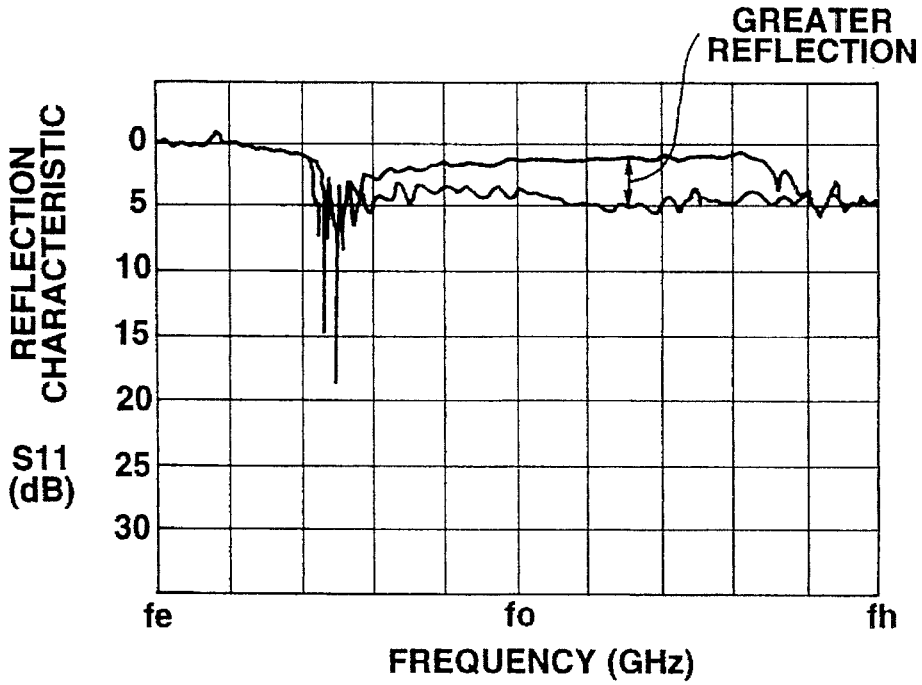

FIGS. 6A and 6B are graphs showing reflection characteristics obtained with two different percentages of electromagnetic wave absorbing powder dispersed in the high-frequency electromagnetic wave absorber portion 105. FIG. 6A relates to about 15 or less percent by weight of the electromagnetic wave absorbing powder dispersed in the high-frequency electromagnetic wave absorber portion 105, and FIG. 6B relates to about 20 or more percent by weight of the electromagnetic wave absorbing powder dispersed in the high-frequency electromagnetic wave absorber portion 105. In this case, the boundary surface 106 is positioned at an angle normal to the direction of transmission of the signal inputted into the resistive terminator 103 to provide the greatest tendency for reflection of the inputted signal on the boundary surface 106. As can be seen from a comparison between FIGS. 6A and 6B, the most preferable result can be obtained when the percent by weight of the electromagnetic wave absorbing powder dispersed in the high-frequency electromagnetic wave absorber portion 105 is about 15 or less.

Figure 7:
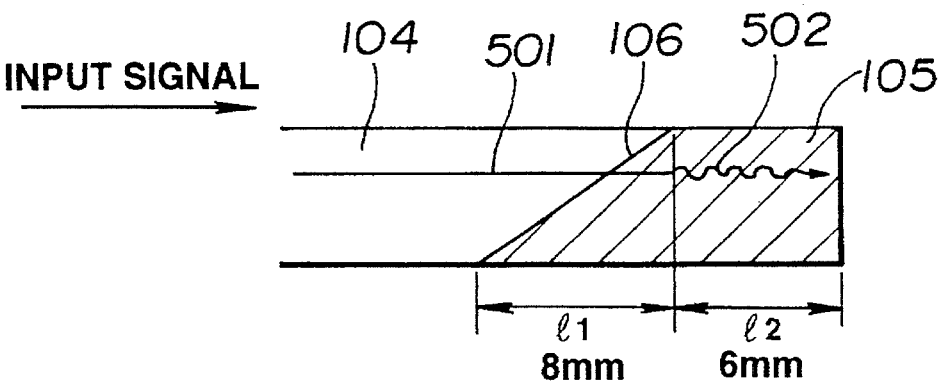
FIG. 7 is a schematic view used in explaining a preferable structure of the resistive terminator of the invention.

When the first length $l_1$ is about 8 mm, the second length $l_2$ is about 6 mm and the weight percentage is less than about 10, as shown in FIG. 7, the resistive terminator 103 provides a reflection characteristic as shown in FIG. 2. A preferable value of the first length $l_1$ is dependent on the frequency of the electromagnetic wave to be inputted into the resistive terminator 103. A preferable value of the second length $l_2$ is dependent on the percentage of the electromagnetic wave absorbing powder dispersed in the high-frequency electromagnetic wave absorber portion 105. Assuming now that the fluorine resin made high-frequency electromagnetic wave absorber portion 105 contains carbon, graphite, carbon fiber, or ferrite powder, the preferable value of the percent by weight of the electromagnetic wave absorbing powder dispersed in the high-frequency electromagnetic wave absorber portion 105 is from about 1% to about 15%, the preferable value of the first length $l_1$ is from about 5 mm to about 20 mm for signals having a frequency 40 GHz or higher, and the preferable value of the second length $l_2$ is from about 0 mm to about 20 mm.

Figure 8:
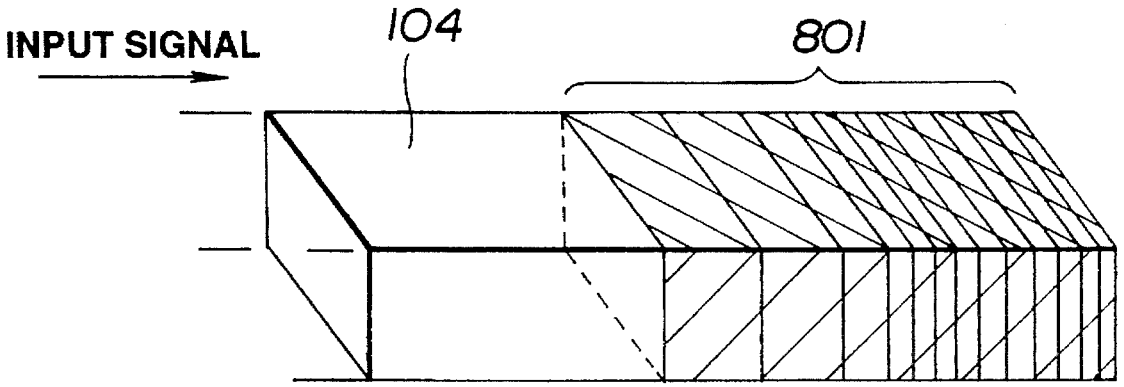
FIG. 8 is a perspective view showing a modified form of the resistive terminator of the invention.

Referring to FIG. 8, there is shown a modified form of the resistive terminator of the invention. In this modification, a high-frequency electromagnetic wave absorber portion 801 contacts with the dielectric resin portion 104 at a boundary surface substantially normal to the direction of transmission of the signal (electromagnetic wave) inputted into the resistive terminator. The high-frequency electromagnetic wave absorber portion 801 has a series connection of high-frequency electromagnetic wave absorber blocks each made of fluorine resin containing an electromagnetic wave absorbing powder, such as carbon, graphite, carbon fiber, ferrite or the like, uniformly dispersed therein to absorb the electromagnetic wave so as to provide a good non-reflection characteristic to the resistive terminator. The percentage by weight or volume of the electromagnetic wave absorbing powder dispersed in the high-frequency electromagnetic wave absorber blocks increases as going in the direction of transmission of the input signal. The high-frequency electromagnetic wave absorber portion 801 is molded as a unit in such a manner as described above.

Figure 9A:
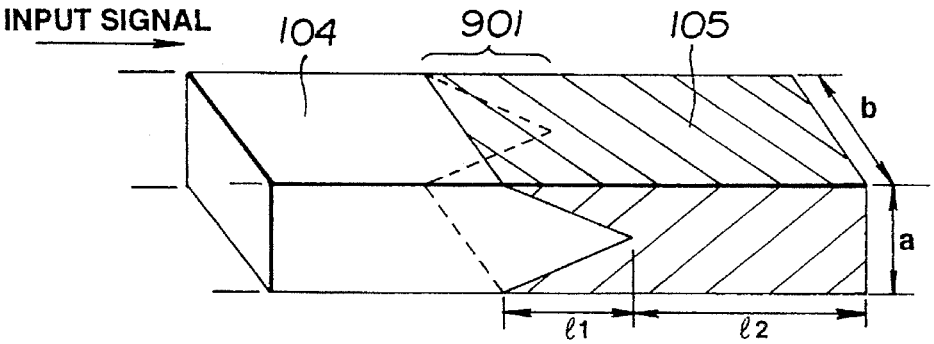
FIG. 9A is a perspective view showing another modified form of the resistive terminator of the invention.

Referring to FIG. 9A, there is shown another modified form of the resistive terminator of the invention. In this modification, the boundary surface 901 at which the high-frequency electromagnetic wave absorber portion 105 is fusion bonded to the dielectric resin portion 104 is inwardly tapered in a wedge form toward the output side of the resistive terminator. The dielectric resin portion 104 is made of fluorine resin, and the high-frequency electromagnetic wave absorber portion 105 is made of fluorine resin containing an electromagnetic wave absorbing powder, such as carbon, graphite, carbon fiber, ferrite or the like, uniformly dispersed therein. This modification is effective to improve the non-reflection characteristic of the resistive terminator. The portions 104 and 105 of the resistive terminator are molded as a unit in such a manner as described above.

Figure 9B:
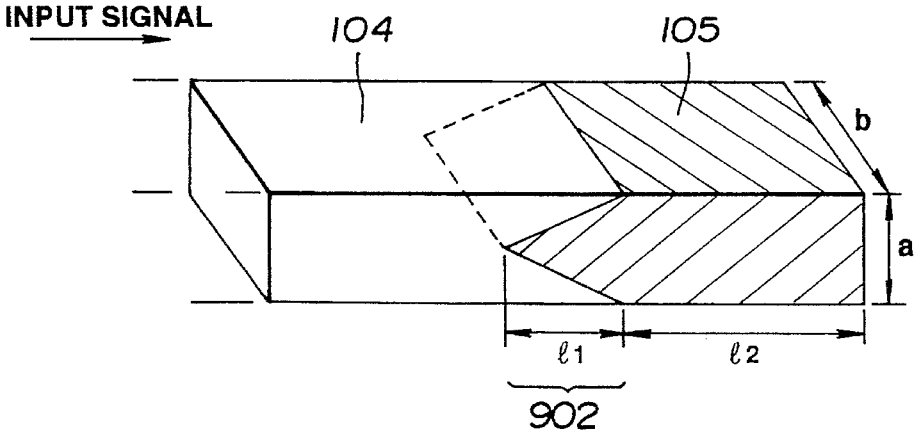
FIG. 9B is a perspective view showing another modified form of the resistive terminator of the invention.

Referring to FIG. 9B, there is shown still another modified form of the resistive terminator of the invention. In this modification, the boundary surface 902 at which the high-frequency electromagnetic wave absorber portion 105 is fusion bonded to the dielectric resin portion 104 is outwardly tapered in a wedge form toward the input side of the resistive terminator. The dielectric resin portion 104 is made of fluorine resin, and the high-frequency electromagnetic wave absorber portion 105 is made of fluorine resin containing an electromagnetic wave absorbing powder, such as carbon, graphite, carbon fiber, ferrite or the like, uniformly dispersed therein. This modification is effective to improve the non-reflection characteristic of the resistive terminator. The portions 104 and 105 of the resistive terminator are molded as a unit in such a manner as described above.

Figure 10:
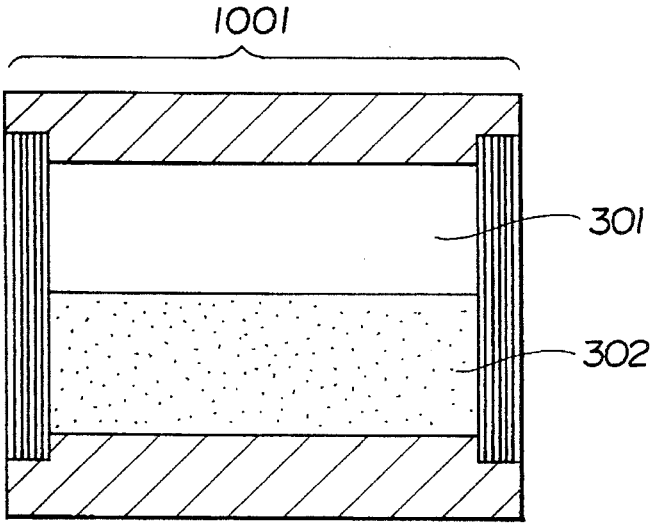
FIG. 10 is a sectional view used in explaining another method of producing the resistive terminator of the invention.

Referring to FIG. 10, description will be made to another method of producing the resistive terminator of the invention. The pure dielectric resin portion 301 molded in the form of a sintered PTFE resin block and the high-frequency electromagnetic wave absorber portion 302 molded in the form of a sintered PTFE resin containing 10 percent by weight of carbon powder uniformly dispersed therein are produced separately. The pure dielectric resin portion 301 and the high-frequency electromagnetic wave absorber portion 302 are placed in a metal mold 1001 and sintered at a temperature higher than the melting point of the PTFE resin under pressure to produce a resistive terminator ingot. The resistive terminator ingot is cut into a number of resistive terminator 103 in such a manner as described in connection with FIGS. 3 and 4.

Figure 11:
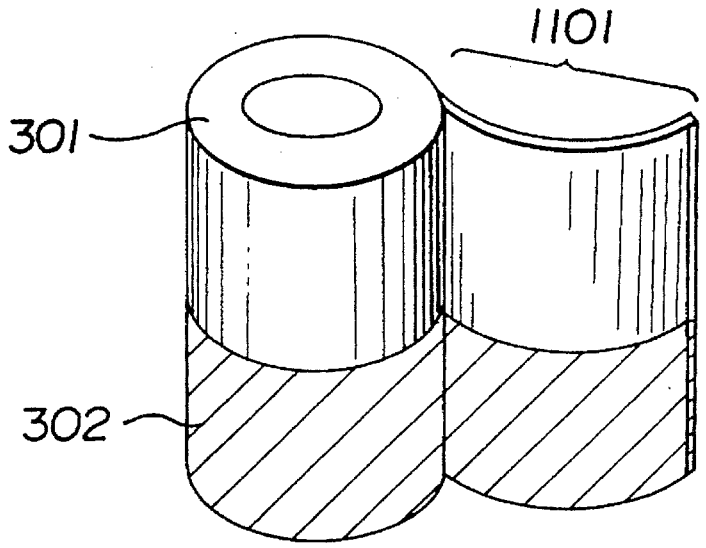
FIG. 11 is a perspective view used in explaining another method of producing the resistive terminator of the invention.

Referring to FIG. 11, description will be made to another method of producing the resistive terminator of the invention. A resistive terminator sheet 1101 is formed by cutting a cylindrical resistive terminator ingot having dielectric and wave-absorber portions 301 and 302 fusion bonded as a unit. The resistive terminator sheet 1101 is cut obliquely to form a number of resistive terminators 103 in such a manner as described in connection with FIG. 4.

Figure 12:
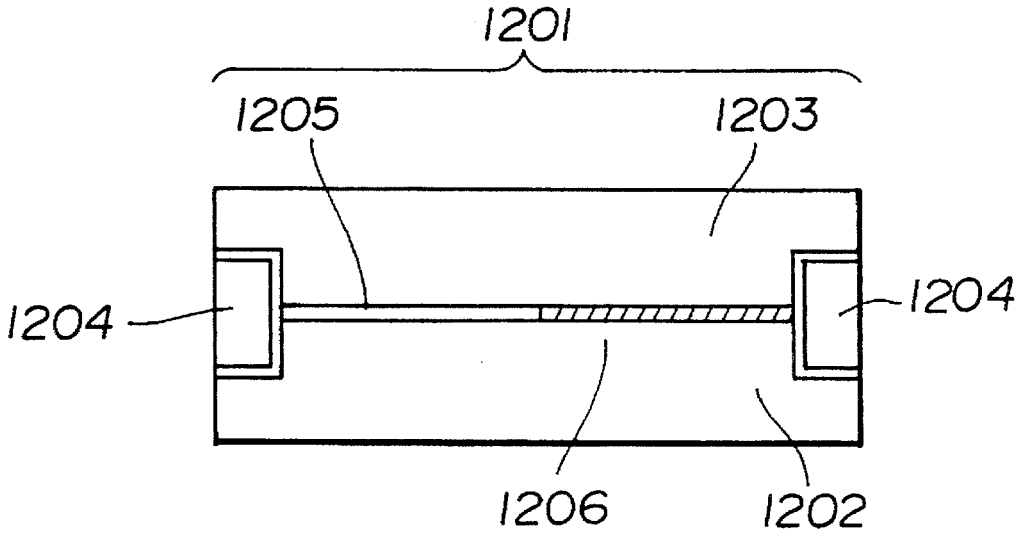
FIG. 12 is a sectional view used in explaining another method of producing the resistive terminator of the invention.

Referring to FIG. 12, description will be made to another method of producing the resistive terminator of the invention. A pure dielectric portion 1205 molded in the form of a sintered PTFE resin sheet and a high-frequency electromagnetic wave absorber portion 1206 molded in the form of a sintered PTFE resin sheet containing 10 percent by weight of carbon powder uniformly dispersed therein are produced separately. The pure dielectric resin portion 1205 and the electromagnetic wave absorber portion 1206 are placed in a metal mold 1201 with their one ends held in surface contact with each other and they are sintered at a temperature higher than the melting point of the PTFE resin under pressure to produce a resistive terminator sheet. The resistive terminator sheet is cut into a number of resistive terminator 103 in such a manner as described in connection with FIG. 4.

Figure 13:
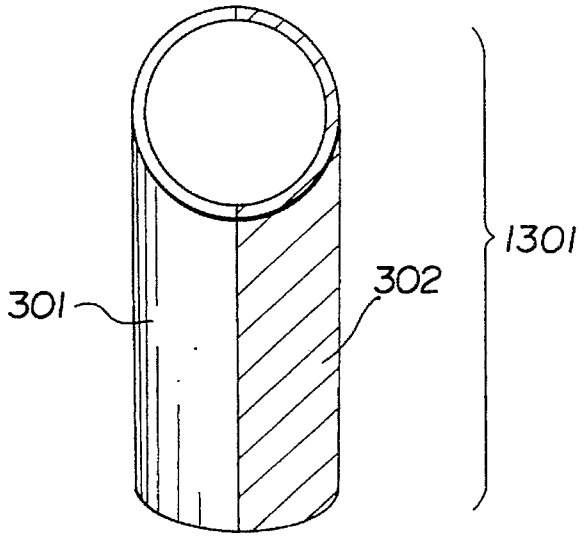
FIG. 13 is a perspective view used in explaining another method of producing the resistive terminator of the invention.

Referring to FIG. 13, description will be made to still another method of producing the resistive terminator of the invention. A paste extrusion method is utilized to form a tubular resistive terminator 1301 having a pure dielectric resin portion 301 having a semi-circular cross section and a high-frequency electromagnetic wave absorber portion 302 having a semi-circular cross section. The high-frequency electromagnetic wave absorber portion 302 contains about 10 percent by weight of carbon powder uniformly dispersed therein. The dielectric and wave absorber portions 301 and 302 are fusion bonded strongly to each other. The tubular resistive terminator 1301 is modified in a flat sheet form and the resistive terminator sheet is cut into a number of resistive terminator 103 in such a manner as described in connection with FIG. 4.

According to the resistive terminator producing method of the invention, the electric parts of the resistive terminator are securedly fusion bonded with one another without the use of adhesive. Thus, the resistive terminator of the invention is free from the disadvantages attendant on the conventional resistive terminators used for microwave and millimeter-wave bands.

Figure 14:
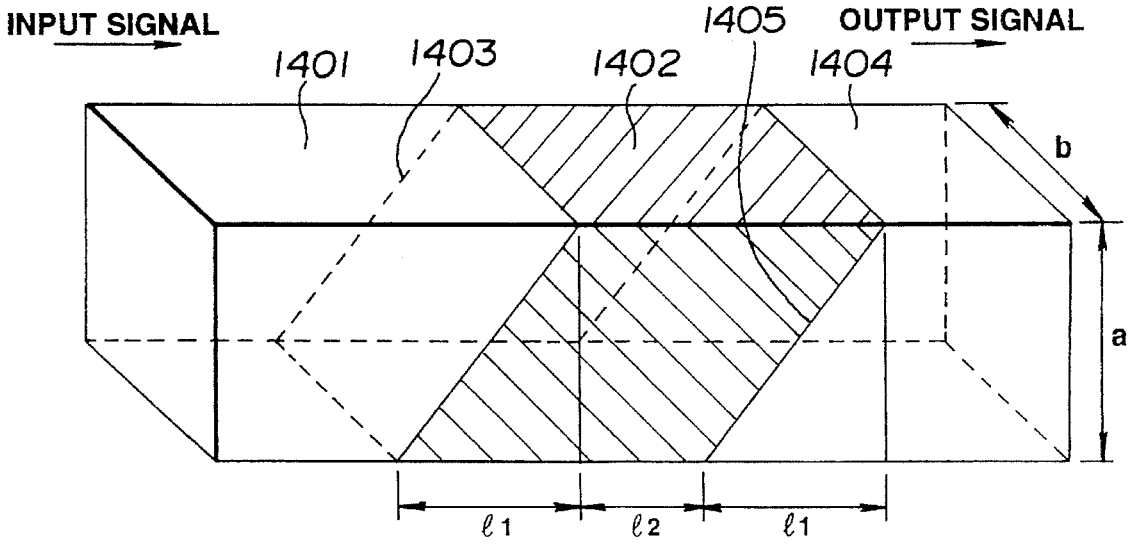
FIG. 14 is a perspective view showing an attenuator made in accordance with the invention.

Referring to FIG. 14, there is shown an attenuator for use in an NRD guide embodying the invention. The attenuator has a pure dielectric resin portion 1401 provided on the input side thereof, a pure dielectric resin portion 1404 provided on the output side thereof, and an electromagnetic wave attenuating portion 1402 disposed between the dielectric resin portions 1401 and 1404. The numeral 1403 designates an inclined boundary surface at which the electromagnetic wave attenuating portion 1402 is fusion bonded to the dielectric resin portion 1401, and the numeral 1405 designates an inclined boundary surface at which the electromagnetic wave attenuating portion 1402 is fusion bonded to the dielectric resin portion 1404. The pure dielectric resin portions 1401 and 1404 are made of a pure dielectric resin having a superior high-frequency characteristic, and the electromagnetic wave attenuating portion 1402 is made of a pure dielectric resin containing a predetermined weight or volume percentage of an electromagnetic wave absorbing powder or particle uniformly dispersed therein. The material of the electromagnetic wave absorbing powder may be carbon, graphite, carbon fiber, ferrite or the like. The electromagnetic wave absorber portion 1402 has a predetermined height (a) and a predetermined width (b). The boundary surfaces 1403 and 1405 are inclined at a predetermined angle determined by the height (a) and a first length $l_1$. The inclined boundary surfaces 1403 and 1405 are effective to improve the non-reflection characteristic.

Figure 15:
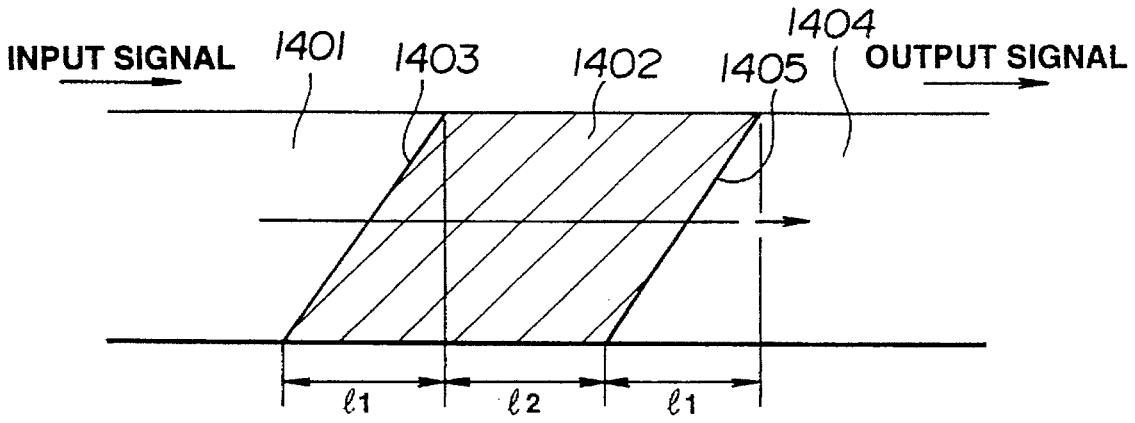
FIG. 15 is a schematic view used in explaining the operation of the attenuator of the invention.
Figure 16:
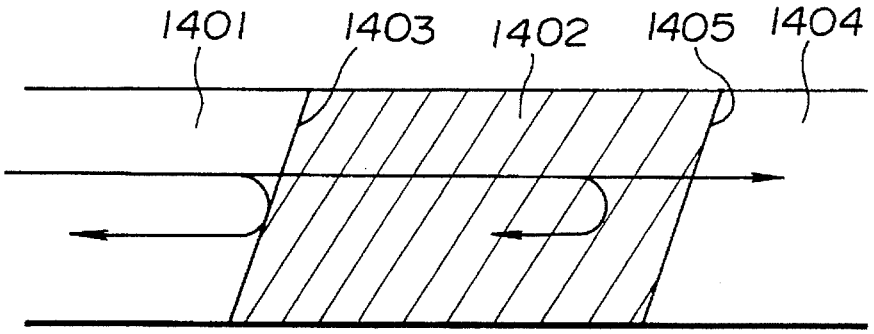
FIG. 16 is a schematic view used in explaining the operation of the attenuator of the invention.

The signal (electromagnetic wave) inputted into the dielectric resin portion 1401 is transmitted through the electromagnetic wave attenuating portion 1402 into the dielectric resin portion 1404, as shown in FIG. 15. The length $l_1$, that is, the angle of inclination of the boundary surfaces 1403 and 1405 should be set within an appropriate range. If the length $l_1$ is less than the appropriate range, the inputted signal will be reflected partially on the inclined boundary surface 1403 and partially on the inclined boundary surface 1405, as shown in FIG. 16, resulting in a degraded non-reflection characteristic. Furthermore, the percentage by weight or volume of the electromagnetic wave absorbing powder dispersed in the electromagnetic wave attenuating portion 1402 should be set within an appropriate range. If the percentage is greater than the appropriate range, the inputted signal will be reflected on the inclined boundary surface 1403, as shown in FIG. 5. Assuming now that the length $l_1$ is fixed, the length $l_2$ is directly proportional to the degree (for example, 5 dB, 10 dB, 15 dB) to which the electromagnetic wave is to be attenuated.

Figure 17:
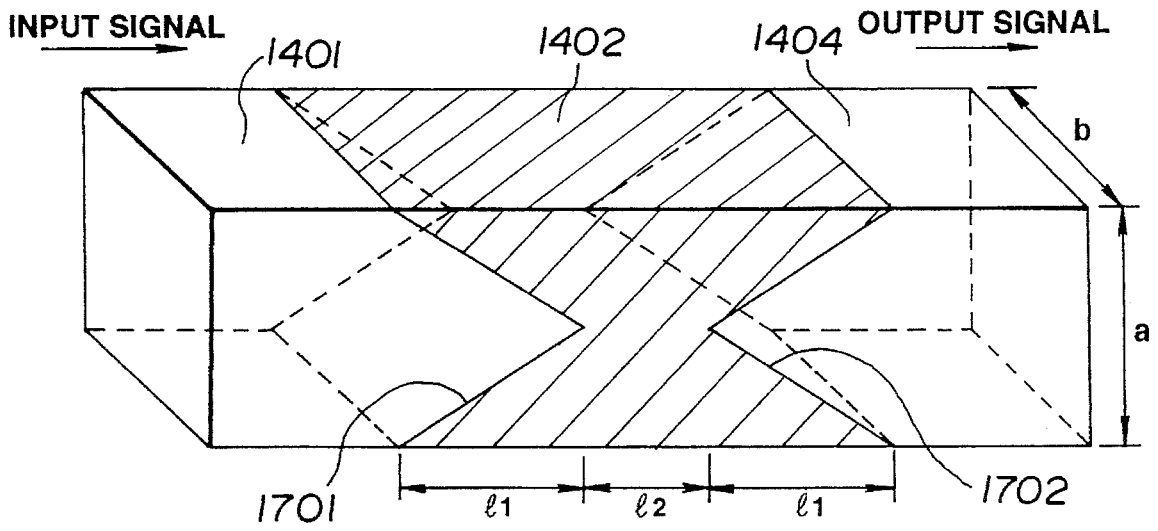
FIG. 17 is a perspective view showing another modified form of the attenuator of the invention.

Referring to FIG. 17, there is shown a modified form of the attenuator of the invention. In this modification, the boundary surface 1701 at which the electromagnetic wave absorber portion 1402 is fusion bonded to the dielectric resin portion 1401 is inwardly tapered in a wedge form toward the output side of the attenuator, and the boundary surface 1702 at which the electromagnetic wave absorber portion 1402 is fusion bonded to the dielectric resin portion 1404 is inwardly tapered in a wedge form toward the input side of the attenuator. The dielectric resin portions 1401 and 1404 are made of fluorine resin, and the electromagnetic wave absorber portion 1402 is made of fluorine resin containing an electromagnetic wave absorbing powder, such as carbon, graphite, carbon fiber, ferrite or the like, uniformly dispersed therein.

Figure 18:
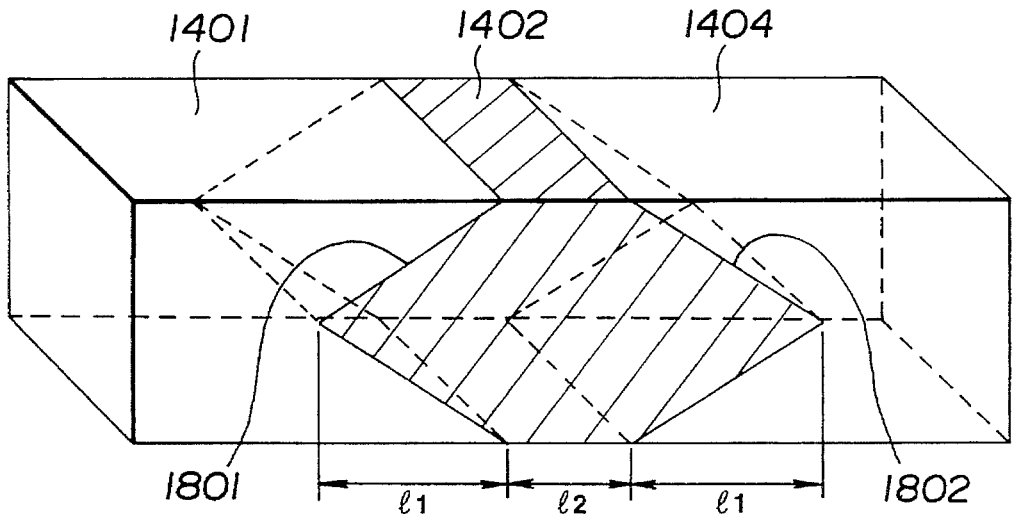
FIG. 18 is a perspective view showing another modified form of the attenuator of the invention.

Referring to FIG. 18, there is shown another modified form of the attenuator of the invention. In this modification, the boundary surface 1801 at which the electromagnetic wave absorber portion 1402 is fusion bonded to the dielectric resin portion 1401 is outwardly tapered in a wedge form toward the input side of the attenuator, the boundary surface 1802 at which the electromagnetic wave absorber portion 1402 is fusion bonded to the dielectric resin portion 1404 is outwardly tapered in a wedge form toward the output side of the attenuator.

Figure 19:
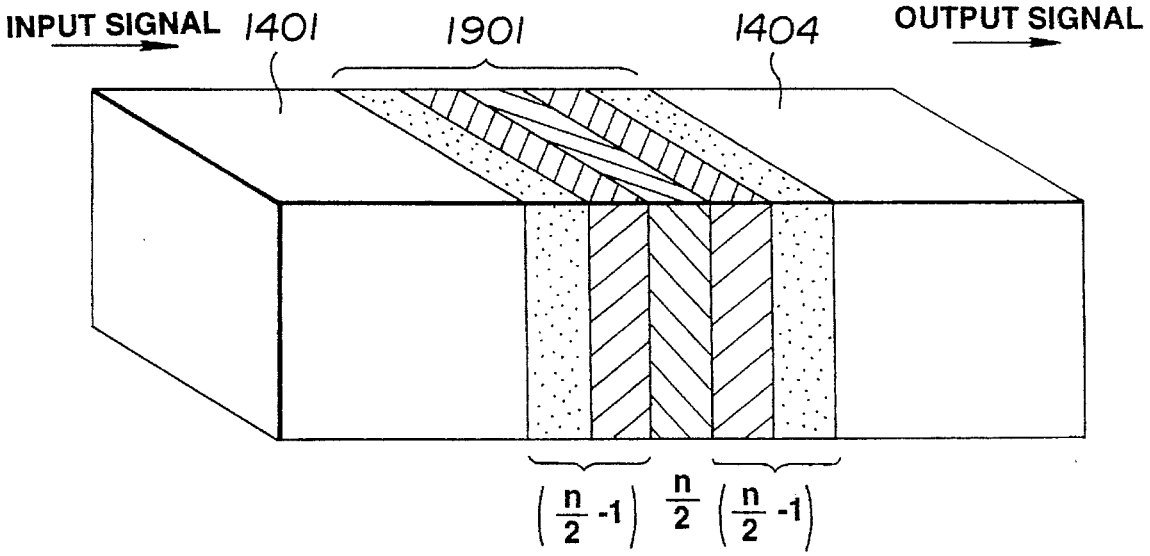
FIG. 19 is a perspective view showing another modified form of the attenuator of the invention.

Referring to FIG. 19, there is shown still another modified form of the attenuator of the invention. In this modification, the electromagnetic wave absorber portion 1901 contacts with the dielectric resin portion 1401 at a boundary surface substantially normal to the direction of transmission of the electromagnetic wave inputted into the attenuator and the electromagnetic wave absorber portion 1901 contacts with the dielectric resin portion 1404 at a boundary surface substantially normal to the direction of transmission of the inputted signal. The electromagnetic wave absorber portion 1901 has a series connection of n electromagnetic wave absorber blocks each made of fluorine resin or the like dielectric material containing an electromagnetic wave absorbing powder, such as carbon, graphite, carbon fiber, ferrite or the like, uniformly dispersed therein. The percentage by weight or volume of the high-frequency electromagnetic wave absorbing powder dispersed in the high-frequency electromagnetic wave absorber blocks increases as going in the direction of transmission of the input signal for the 1st to (n/2)th electromagnetic wave absorber blocks and decreases as going in the direction of transmission of the input signal for the (n/2)th to the nth electromagnetic wave absorber blocks. The electromagnetic wave absorber blocks 1901 are molded as a unit.

Figure 20:
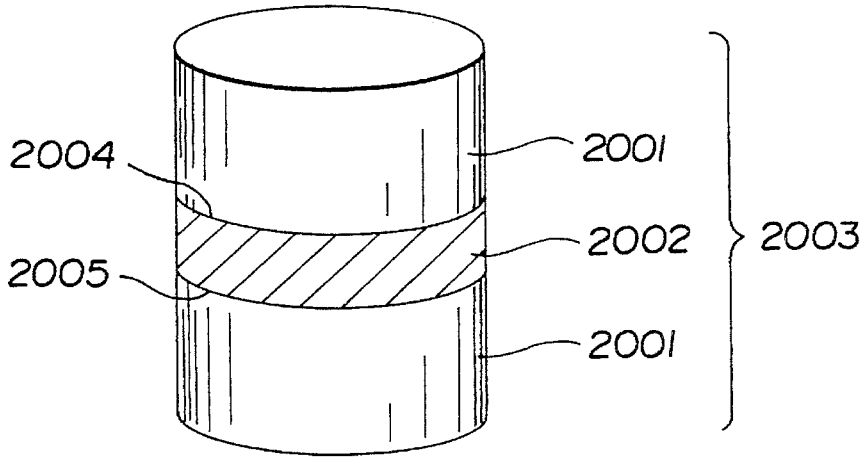
FIG. 20 is a perspective view used in explaining a method of producing the attenuator of the invention.
Figure 21:
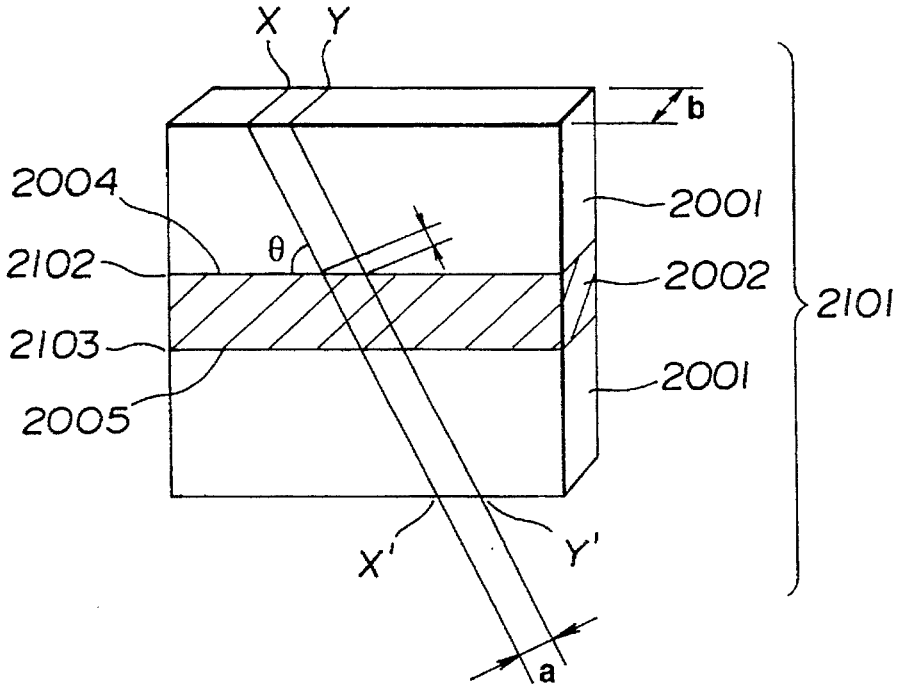
FIG. 21 is a perspective view used in explaining another method of producing the attenuator of the invention.

Description will be made to a method of production of the attenuator of the invention. A predetermined amount of polytetrafluoroethylene (PTFE) resin, which has a low dielectric constant, is charged in a bottomed cylindrical metal mold. A force piston is used to pressurize the charged PTFE resin. The appropriate surface pressure to be applied to the charged PTFE resin is greater than 0.5 $Kgf/cm^2$ and preferably 25 $Kgf/cm^2$. Upon completion of this pressurized preforming process, a predetermined amount of PTFE resin containing carbon, graphite or ferrite powder (high-frequency electromagnetic wave absorbing powder) uniformly dispersed therein is introduced onto the upper surface of the PTFE resin preformed in the metal mold. The force piston is used again to pressurize the introduced PTFE resin against the preformed PTFE resin. After a predetermined amount of PTFE resin is introduced into the metal mold, the force piston is used to pressurize the PTFE resin to mold an attenuator ingot. This compression molding process is made under a molding pressure ranging from 50 $Kgf/cm^2$ to 700 $Kgf/cm^2$ and preferably 250 $Kgf/cm^2$. As shown in FIG. 20, the attenuator ingot 2003 has a wave absorber portion 2002 sandwiched between dielectric portions 2001. It was confirmed that the wave absorber portion 2002 was jointed strongly to both of the dielectric portions 2001 at smooth boundary surfaces 2004 and 2005. The produced attenuator ingot 2003 is take out of the cylindrical metal mold and, then, it is burned for three hours at a temperature higher than the melting point (327° C.) of the PTFE resin. A preferable turning temperature is 340° C. The resulting product is an attenuator ingot 2003 having dielectric portions 2001 integrally fusion bonded at the boundary surfaces 2004 and 2005 to the wave absorber portion 2002. The attenuator ingot 2003 may be produced by sintering the molded ingot in the cylindrical metal mold. Furthermore, the PTFE resin containing an electromagnetic wave absorbing powder dispersed uniformly therein may be preformed in another cylindrical metal mold before it is molded along with the PTFE resin preformed in the cylindrical metal mold. Upon completion of this compression molding process, the attenuator ingot 303 is cut to produce a number of resistive terminator sheets 2101, as shown in FIG. 21. An attenuator is produced by obliquely cutting the attenuator sheet 2101 along lines x–x' and y–y' inclined at an angle θ with respect to the lines 2102 and 2103 (corresponding to the boundary surfaces 2004 and 2005) at which the wave absorber portion 2002 is fusion bonded to the dielectric portions 2001. It was confirmed that the dielectric and absorber portions were strongly fusion bonded as a unit at the boundary surfaces.

Figure 22:
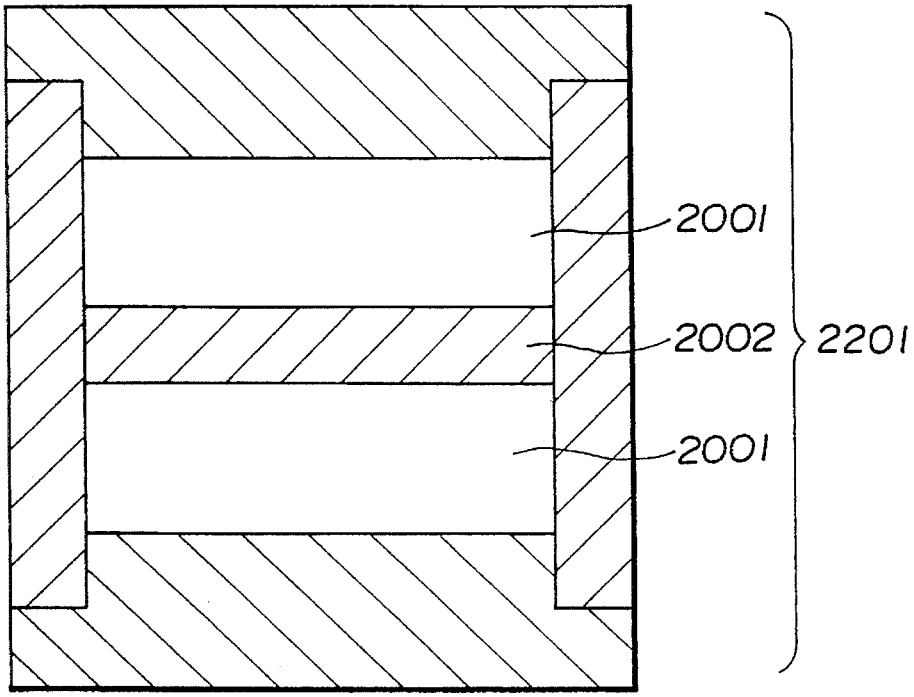
FIG. 22 is a sectional view used in explaining another method of producing the attenuator of the invention.

Referring to FIG. 22, description will be made to another method of producing the attenuator of the invention. The dielectric portions 2001 molded in the form of sintered PTFE resin blocks and the electromagnetic wave absorber portion 2002 molded in the form of a sintered PTFE resin containing carbon, graphite or ferrite powder uniformly dispersed therein are produced separately. The dielectric portions 2001 and the electromagnetic wave absorber portion 2002 are placed in a metal mold 2201 and sintered at a temperature higher than the melting point of the PTFE resin under pressure to produce an attenuator ingot. Then, the attenuator ingot is cut to produce attenuators in such a manner as described in connection with FIG. 21.

Figure 23:
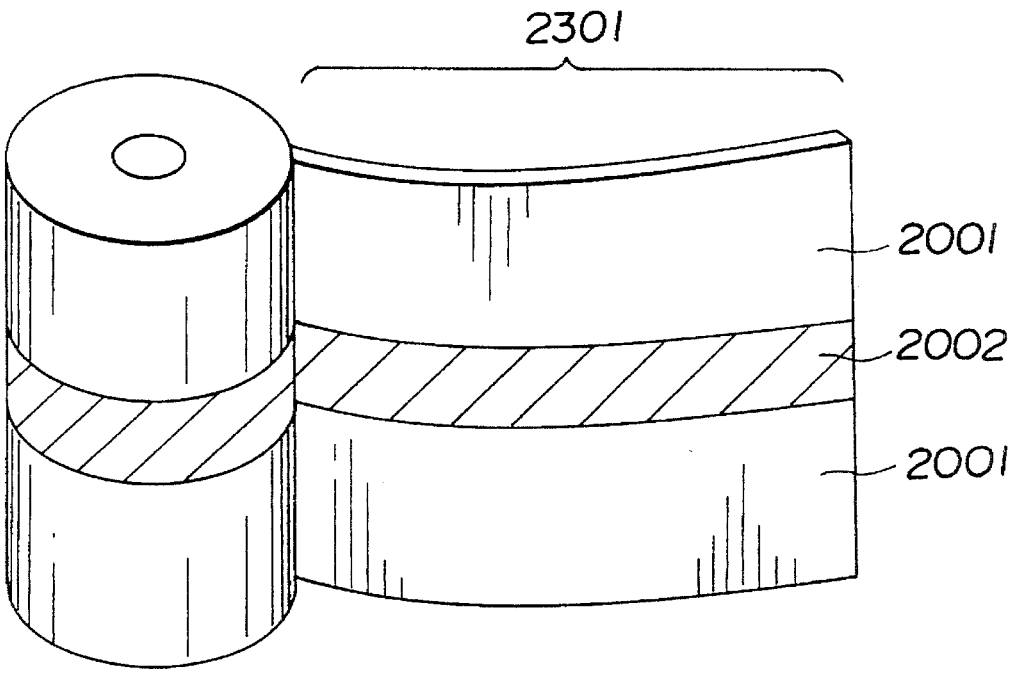
FIG. 23 is a perspective view used in explaining another method of producing the attenuator of the invention.

Referring to FIG. 23, description will be made to another method of producing the attenuator of the invention. An attenuator sheet 2301 is formed by cutting a cylindrical attenuator ingot having a wave absorber portion 2002 fusion bonded as a unit between a pair of dielectric portions 2001. 301 and 302. The attenuator 2301 is cut obliquely to form a number of attenuator in such a manner as described in connection with FIG. 21.

Figure 24:
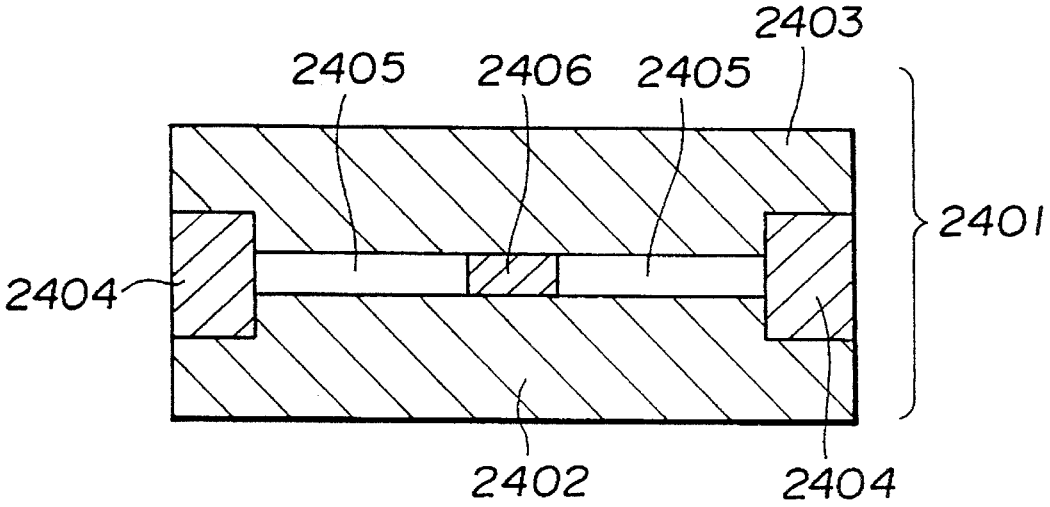
FIG. 24 is a sectional view used in explaining another method of producing the attenuator of the invention.

Referring to FIG. 24, description will be made to another method of producing the attenuator of the invention. A pair of dielectric portions 2405 each of which is molded in the form of a sintered PTFE resin sheet and a wave absorber portion 2406 molded in the form of a sintered PTFE resin sheet containing carbon, graphite or ferrite powder uniformly dispersed therein are produced separately. The dielectric portions 2405 and the wave absorber portion 2406 are placed in a metal mold 2401 with the wave absorber portion 2406 having its opposite ends held in surface contact with one ends of the dielectric portions 2405 and they are sintered at a temperature higher than the melting point of the PTFE resin under pressure to produce an attenuator sheet. The attenuator sheet is cut to produce a number of attenuator in such a manner as described in connection with FIG. 21. The metal mold 2401 includes a force piston 2403 and bottom and side boards 2402 and 2404.

Figure 25:
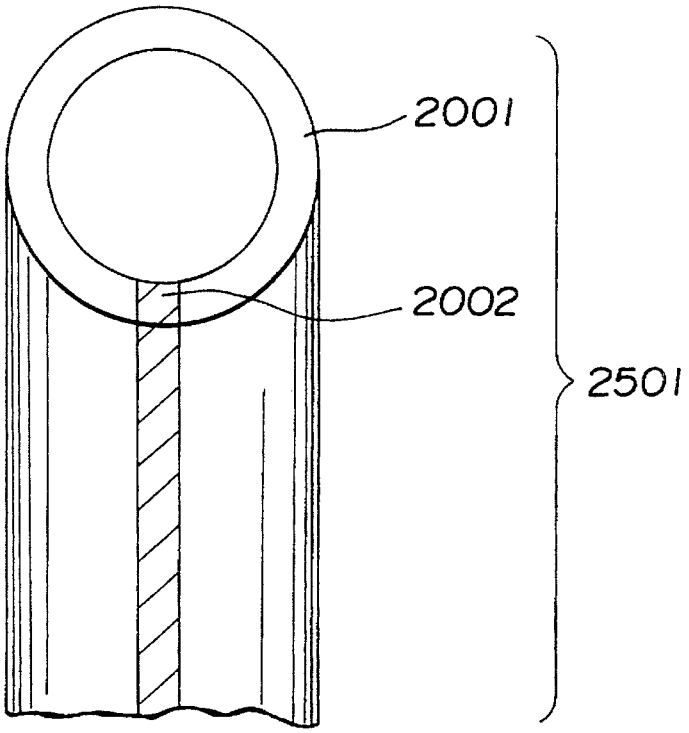
FIG. 25 is a perspective view used in explaining another method of producing the attenuator of the invention.
Figure 26:
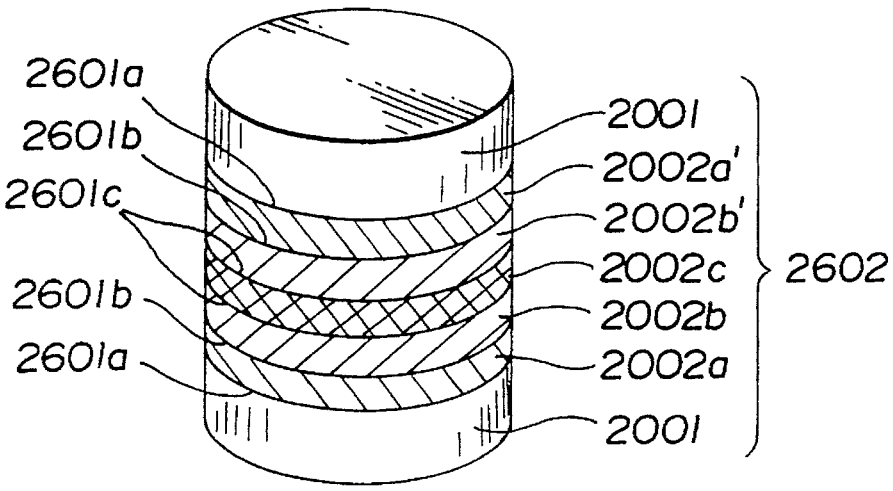
FIG. 26 is a perspective view used in explaining another method of producing the attenuator of the invention.
Figure 27:
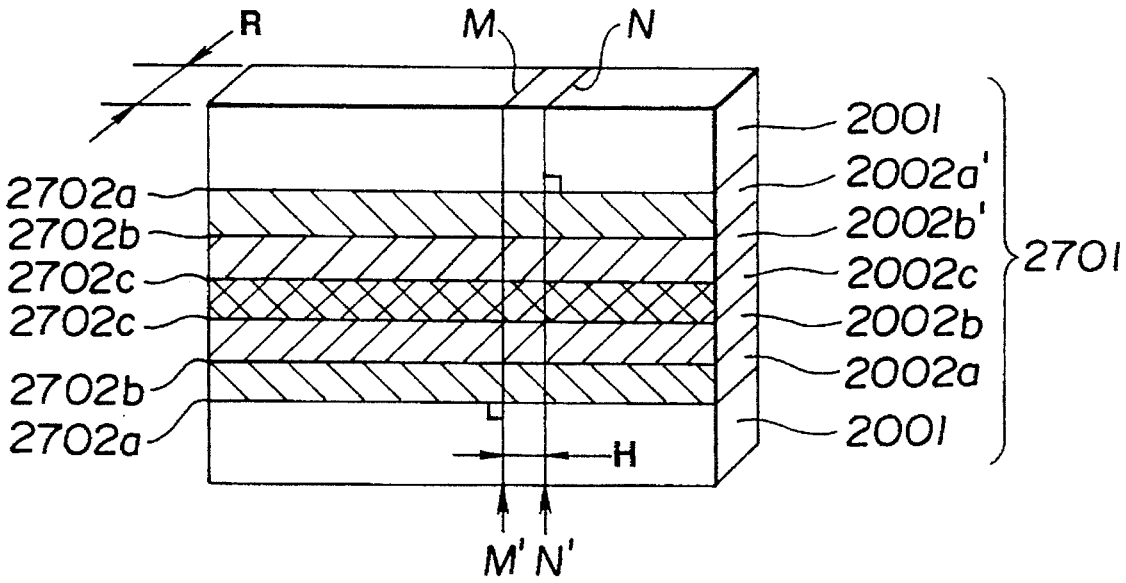
FIG. 27 is a perspective view used in explaining another method of producing the attenuator of the invention.

Referring to FIG. 25, description will be made to still another method of producing the attenuator of the invention. A paste extrusion method is utilized to form an attenuator tube 2501 of a dielectric portion 2001 including a wave absorber portion 2002 provided in the form of a line extending in the longitudinal direction thereof. The wave absorber portion 2002 contains carbon, graphite or ferrite powder uniformly dispersed therein. The dielectric and wave absorber portions 2001 and 2002 are fusion bonded strongly. The attenuator tube 2501 is modified in a flat sheet form and the attenuator sheet is cut to produce a number of attenuator in such a manner as described in connection with FIG. 21.

Description will be made to a method of production of the attenuator described in connection with FIG. 19. A predetermined amount of polytetrafluoroethylene (PTFE) resin is charged in a bottomed cylindrical metal mold. A force piston is used to pressurize the charged PTFE resin to preform a dielectric portion 2001. The appropriate surface pressure to be applied to the charged PTFE resin is greater than 0.5 $Kgf/cm^2$ and preferably 25 $Kgf/cm^2$.

Upon completion of this pressurized preforming process, a predetermined amount of PTFE resin containing carbon, graphite or ferrite powder (high-frequency electromagnetic wave absorbing powder) uniformly dispersed therein is introduced onto the upper surface of the dielectric portion 2001 preformed in the metal mold. The force piston is used again to pressurize the introduced PTFE resin against the preformed dielectric portion 2001 to preform a wave absorber portion 2002*a*. The surface pressure applied to the charged PTFE resin is 25 Kgf/cm$^2$.

Upon completion of this pressurized preforming process, a predetermined amount of PTFE resin containing carbon, graphite or ferrite powder (high-frequency electromagnetic wave absorbing powder) uniformly dispersed therein is introduced onto the upper surface of the wave absorber portion 2002*a* preformed in the metal mold. The force piston is used again to pressurize the introduced PTFE resin against the preformed wave absorber portion 2002*a* to preform a wave absorber portion 2002*b*. The surface pressure applied to the charged PTFE resin is 25 Kgf/cm$^2$. The amount of the high-frequency electromagnetic wave absorbing powder introduced to preform the wave absorber portion 2002*b* is greater than the amount of the high-frequency electromagnetic wave absorbing powder introduced to preform the wave absorber portion 2002*a*.

Upon completion of this pressurized preforming process, a predetermined amount of PTFE resin containing carbon, graphite or ferrite powder (high-frequency electromagnetic wave absorbing powder) uniformly dispersed therein is introduced onto the upper surface of the wave absorber portion 2002*b* preformed in the metal mold. The force piston is used again to pressurize the introduced PTFE resin against the preformed wave absorber portion 2002*b* to preform a wave absorber portion 2002*c*. The surface pressure applied to the charged PTFE resin is 25 Kgf/cm$^2$. The amount of the high-frequency electromagnetic wave absorbing powder introduced to preform the wave absorber portion 2002*c* is greater than the amount of the high-frequency electromagnetic wave absorbing powder introduced to preform the wave absorber portion 2002*b*.

Upon completion of this pressurized preforming process, a predetermined amount of PTFE resin containing carbon, graphite or ferrite powder (high-frequency electromagnetic wave absorbing powder) uniformly dispersed therein is introduced onto the upper surface of the wave absorber portion 2002*c* preformed in the metal mold. The force piston is used again to pressurize the introduced PTFE resin against the preformed wave absorber portion 2002*c* to preform a wave absorber portion 2002*b*'. The surface pressure applied to the charged PTFE resin is 25 Kgf/cm$^2$. The amount of the high-frequency electromagnetic wave absorbing powder introduced to preform the wave absorber portion 2002*b* is substantially the same as the amount of the high-frequency electromagnetic wave absorbing powder introduced to preform the wave absorber portion 2002*b*.

Upon completion of this pressurized preforming process, a predetermined amount of PTFE resin containing carbon, graphite or ferrite powder (high-frequency electromagnetic wave absorbing powder) uniformly dispersed therein is introduced onto the upper surface of the wave absorber portion 2002*b*' preformed in the metal mold. The force piston is used again to pressurize the introduced PTFE resin against the preformed wave absorber portion 2002*b*' to preform a wave absorber portion 2002*a*'. The surface pressure applied to the charged PTFE resin is 25 Kgf/cm$^2$. The amount of the high-frequency electromagnetic wave absorbing powder introduced to preform the wave absorber portion 2002*a*' is substantially the same as the amount of the high-frequency electromagnetic wave absorbing powder introduced to preform the wave absorber portion 2002*a*.

Upon completion of this pressurized preforming process, a predetermined amount of PTFE resin is introduced into the metal mold. The force piston is used to pressurize the PTFE resin to mold an attenuator ingot. This compression molding process is made under a molding pressure ranging from 50 Kgf/cm$^2$ to 700 Kgf/cm$^2$ and preferably 250 Kgf/cm$^2$. It was confirmed that the wave absorber portions 2002 were jointed strongly at smooth boundary surfaces 2601*a*, 2601*b* and 2601*c*. The produced attenuator ingot is take out of the cylindrical metal mold and, then, it is burned for three hours at a temperature higher than the melting point (327° C.) of the PTFE resin. A preferable turning temperature is 340° C. The resulting product is an attenuator ingot 303 having dielectric portions 2001 integrally fusion bonded to the wave absorber portions 2002. The attenuator described in connection with FIG. 19 may be produced by other attenuator producing methods described herein.

According to the attenuator producing method of the invention, the electric parts of the attenuator are certainly fusion bonded with one another without the use of adhesive. Thus, the attenuator of the invention is free from the disadvantages attendant on the conventional attenuators used for microwave and millimeter-wave bands.

Figure 28:
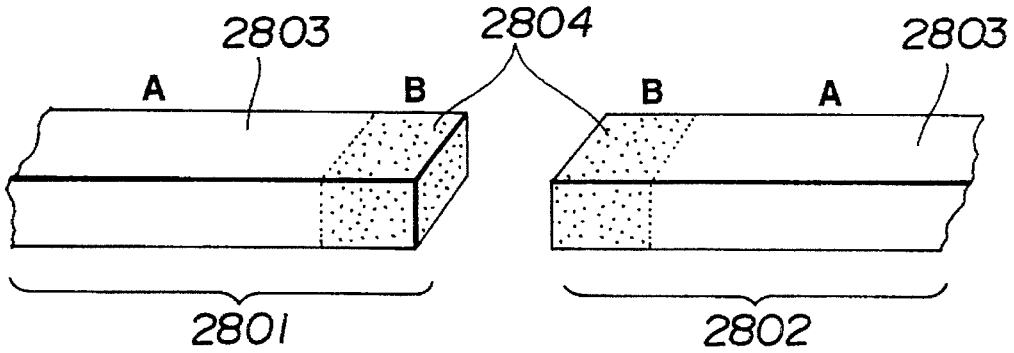
FIG. 28 is a fragmentary perspective view showing a matching line made in accordance with the invention.

Referring to FIG. 28, there is shown a matching line for use in an NRD wave guide embodying the invention. The matching line includes an input side matching dielectric block 2801 provided on the input side thereof and an output side matching dielectric block 2802 provided on the output side thereof. Each of the matching dielectric blocks 2801 and 2802 has a main line input/output dielectric portion 2803 and a matching dielectric portion 2804. The main line input/output dielectric portion 2803 is made of a dielectric resin. For example, the dielectric resin may be unsintered pure fluorine resin having a good extra-high-frequency characteristic. The matching dielectric portion 2804 may be made of unsintered pure fluorine resin containing a powder having a high dielectric constant dispersed therein. For example, the powder may be oxide ceramic powder. Each of the input- and output-side matching dielectric blocks 2801 and 2802 is produced by sintering the unsintered pure fluorine resin held in contact with the unsintered pure fluorine resin containing oxide ceramic powder dispersed therein. The unsintered pure fluorine resins are fusion bonded strongly.

Figure 29:
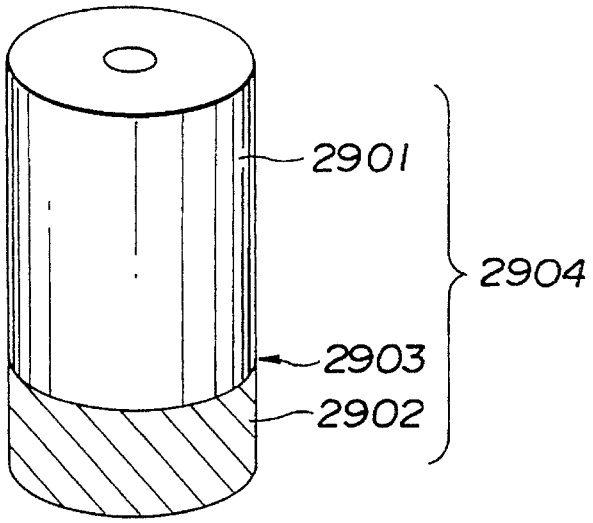
FIG. 29 is a perspective view used in explaining a method of producing the matching line of the invention.
Figure 30:
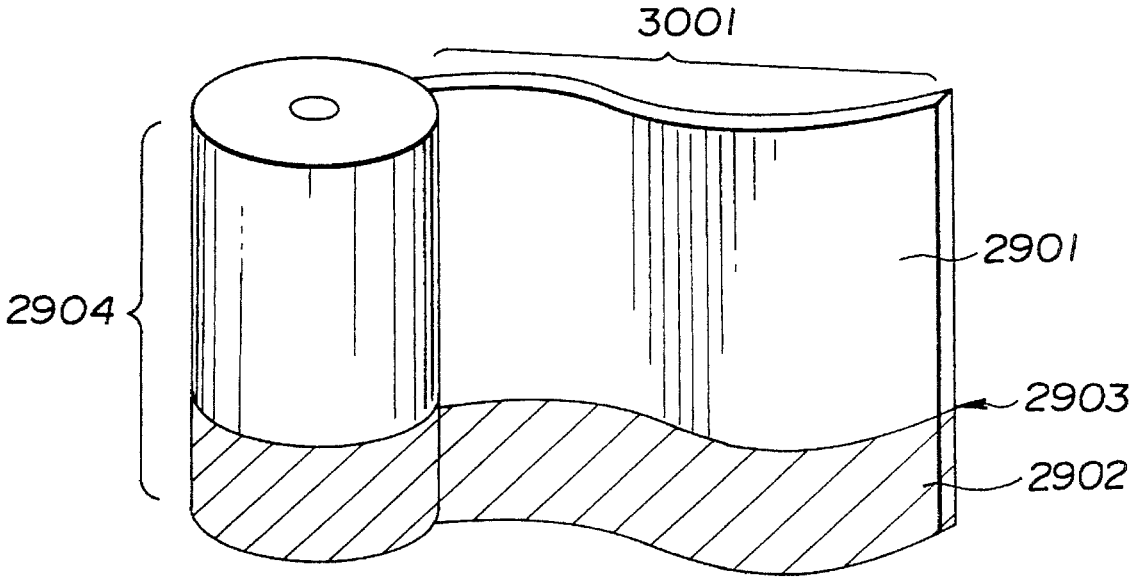
FIG. 30 is a perspective view used in explaining another method of producing the matching line of the invention.

Description will be made to a method of production of the input- and output-side matching dielectric blocks 2801 and 2802 of the matching line of the invention. A predetermined amount of polytetrafluoroethylene (PTFE) resin, which has a low dielectric constant, containing a predetermined amount of oxide ceramic powder, ferrite powder or the like having a high dielectric constant ranging from 3 to 100 is charged in a bottomed cylindrical metal mold. A force piston is used to pressurize the charged PTFE resin. The appropriate surface pressure to be applied to the charged PTFE resin is greater than 0.5 Kgf/cm$^2$ and preferably 25 Kgf/cm$^2$. Upon completion of this pressurized preforming process, a predetermined amount of PTFE resin is introduced onto the upper surface of the PTFE resin preformed in the metal mold. The force piston is used again to pressurize the introduced PTFE resin against the preformed PTFE resin to produce a matching line ingot 2904, as shown in FIG. 29. This compression molding process is made under a molding pressure ranging from 50 Kgf/cm$^2$ to 700 Kgf/cm$^2$ and preferably 250 Kgf/cm$^2$. The matching line ingot 2904 has an input/output dielectric layer 2901 and a matching dielectric layer 2902 strongly fusion bonded at a smooth boundary surface 2903. The produced matching line ingot 2904 is take out of the cylindrical metal mold and, then, it is burned for three hours at a temperature higher than the melting point (327° C.) of the PTFE resin. A preferable turning temperature is 340° C. The resulting product is a matching line ingot 2904 in which the input/output dielectric layer 2901 and the matching dielectric layer 2902 are fusion bonded as a unit at the smooth boundary surface 2903. The matching line ingot 2904 may be produced by sintering the molded ingot in the cylindrical metal mold. Furthermore, the PTFE resin containing oxide ceramic powder or ferrite powder uniformly dispersed therein may be preformed in another cylindrical metal mold before it is molded along with the PTFE resin preformed in the cylindrical metal mold. Upon completion of this compression sintering process, the matching line ingot 2904 is cut to produce an matching line sheet 3001, as shown in FIG. 30. A matching line, which has a height (a), a width (b) and a length (L1), is produced by cutting the matching line sheet 3001 along lines X–X' and Y–Y' normal to the line 3101 (corresponding to the boundary surface 2903) at which the input/output dielectric layer 2901 is fusion bonded to the matching dielectric layer 2902, as shown in FIG. 31. It was confirmed that the dielectric layers 2901 and 2902 were strongly fusion bonded as a unit at the boundary surface. The length L1 is determined in view of the specific inductive capacity of the matching line based on data on the reflection characteristic of a single element to be matched. It is to be noted that a matching line may be produced by cutting the matching line sheet 3001 along parallel lines X–X' and Y–Y' inclined at an angle with respect to the line 3101 at which the input/output dielectric layer 2901 is fusion bonded to the matching dielectric layer 2902.

Referring to FIGS. 32A and 32B, there is shown a phase adjusting circuit to which the matching line of the invention is applicable. The numeral 3201 designates a line portion which is a unit of the input- and output-side matching dielectric blocks 2801 and 2802. Thus, the whole length l of the line portion 3201 is equal to the sum of the length $l_1$ of the dielectric portion A made of pure fluorine resin, the length $l_1$ of the dielectric portion B made of fluorine resin containing a powder such as oxide ceramic powder or the like having a high dielectric constant, and the length $l_2$ of the dielectric portion A made of pure fluorine resin. Assuming now that $\beta_0$ is the line phase constant of the dielectric portion A and $\beta_1$ is the line phase constant of the dielectric portion B, the phase rotation of the line portion 3201 is given as $$\epsilon^{b}\cdot\epsilon^{c}>\epsilon^{d}$$

where $b=j\beta_0(l_0+l_2)$, $c=j\beta_1 l_1$, and $d=j\beta_0 l$

Figure 33:
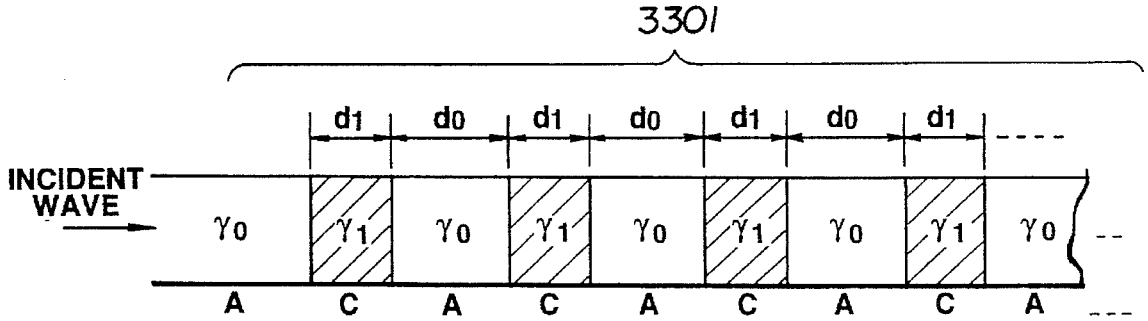
FIG. 33 is a schematic view showing a modified form of the matching line of the invention.

Referring to FIG. 33, there is shown another modified form of the matching line of the invention. In this modification, a dielectric portion C is disposed between adjacent dielectric portions A. The dielectric portion C is made of pure fluorine resin containing a powder having a variable high-frequency characteristic propagation constant. For example, the powder may be of a material having a high dielectric constant or a high resistance, or a high frequency electromagnetic material. The dielectric portions A and C are arranged alternatively, as shown in FIG. 33. The propagation constant of the dielectric portion A is set as $+j\beta_0$ where $\alpha_0$ is the damping constant and $\beta_0$ is the phase constant and the propagation constant of the dielectric portion C is set as $\gamma_2=\alpha_2+j\beta_2$ where $\alpha_2$ is the damping constant and $\beta_2$ is the phase constant to realize a circuit or line having various characteristics attendant on extra-high frequency line having a synchronous arrangement.

Figure 34:
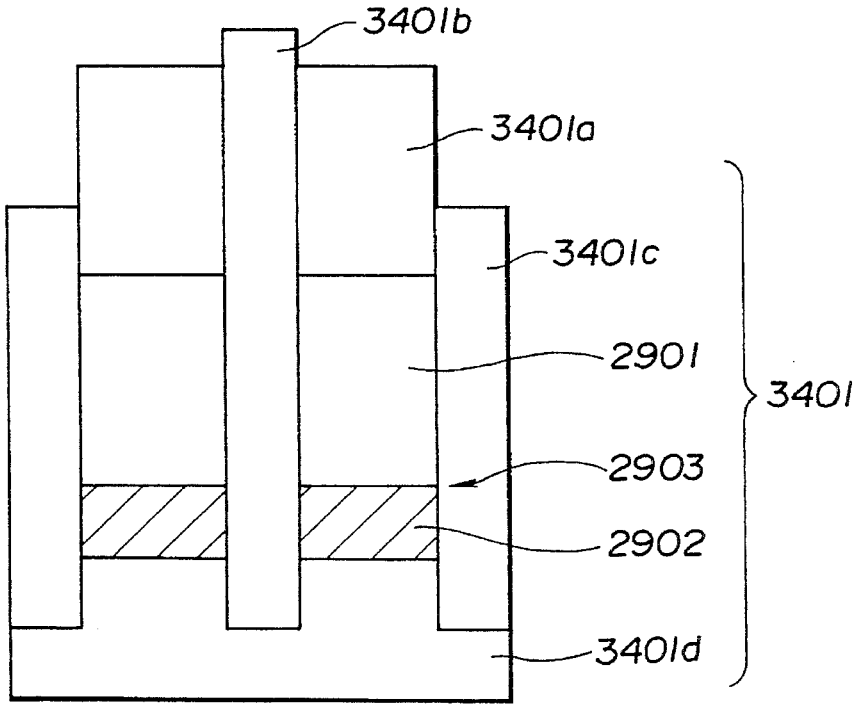
FIG. 34 is a sectional view used in explaining another method of producing the matching line of the invention.
Figure 35:
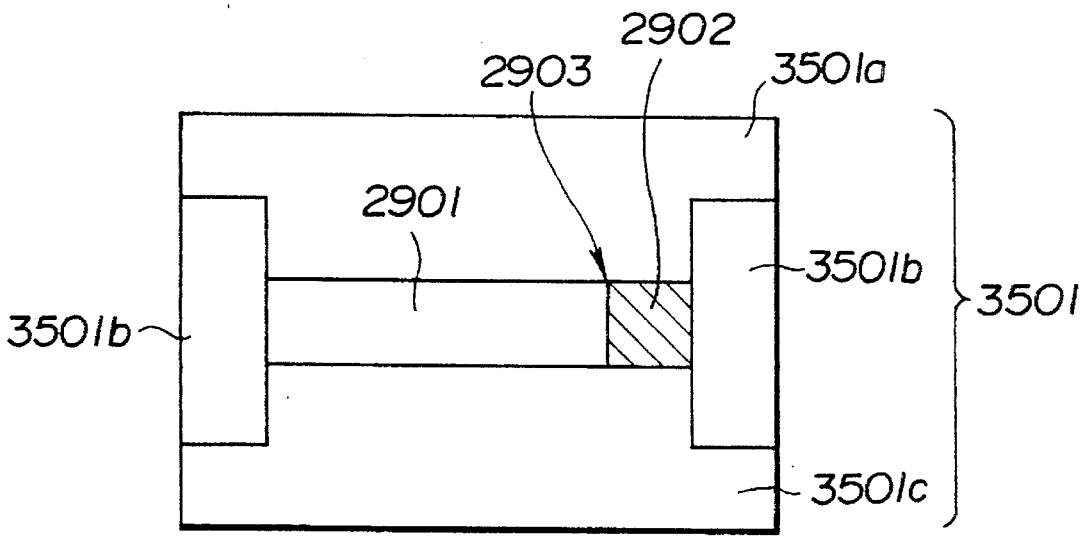
FIG. 35 is a sectional view used in explaining another method of producing the matching line of the invention.

Referring to FIGS. 34 and 35, description will be made to another method of producing the matching line of the invention. The dielectric portion 2901 molded in the form of a cylindrical sintered PTFE resin block and the dielectric portion 2902 molded in the form of a sintered PTFE resin containing oxide ceramic or ferrite powder uniformly dispersed therein are produced separately, as shown in FIG. 34. The metal mold 3401 includes a force piston 340*a*, a core rod 3401*b*, and side and bottom frames 3401*c* and 3401*d*. The dielectric portions 2901 and 2902 are placed in a metal mold 3501 with their one ends held in surface contact with each other, as shown in FIG. 35, and they are sintered at a temperature higher than the melting point of the PTFE resin under pressure to produce a matching line sheet. Then, the matching line sheet is cut to produce matching lines in such a manner as described in connection with FIG. 31. The metal mold 3501 includes a force piston 3501*a* and side and bottom frames 3501*b* and 3501*c*.

Figure 36:
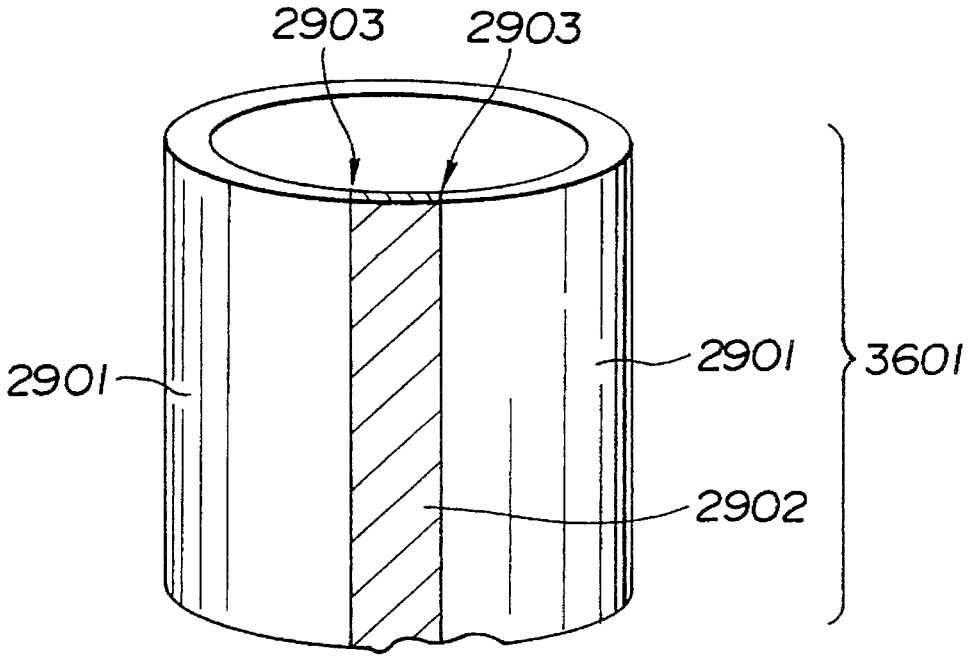
FIG. 36 is a fragmentary perspective view used in explaining another method of producing the matching line of the invention.
Figure 37:
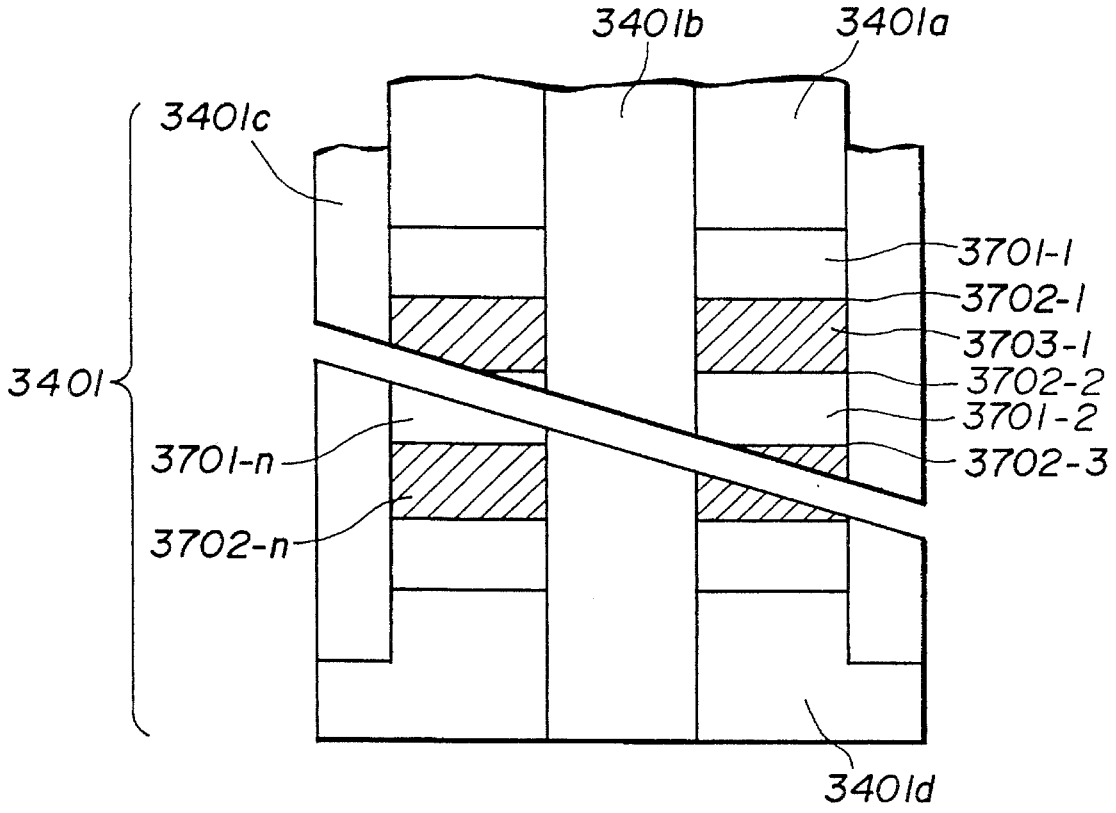
FIG. 37 is a fragmentary sectional view used in explaining another method of producing the matching line of the invention.

Description will be made to another method of producing the matching lines described in connection with FIGS. 28 and 32. A paste extrusion method is utilized to form a matching line tube 3601 of a dielectric portion 2901 including a dielectric portion 2902 provided in the form of a line extending in the longitudinal direction thereof, as shown in FIG. 36. The dielectric portion 2902 contains oxide ceramic or ferrite powder uniformly dispersed therein. The dielectric portions 2901 and 2902 are fusion bonded strongly. The matching line tube 3601 is modified in a flat sheet form and the matching line sheet is cut to produce a number of matching lines in such a manner as described in connection with FIG. 31.

Description will be made to another method of producing the matching line described in connection with FIG. 33. A predetermined amount of PTFE resin is charged in a bottomed cylindrical metal mold 3401 which is similar to that shown in FIG. 34. A force piston 3401*a* is used to pressurize the charged PTFE resin to preform the PTFE resin. The appropriate surface pressure to be applied to the charged PTFE resin is greater than 10 Kgf/cm$^2$ and preferably 25 Kgf/cm$^2$.

Upon completion of this pressurized preforming process, a predetermined amount of PTFE resin containing oxide ceramic or ferrite powder dispersed uniformly therein is introduced onto the upper surface of the PTFE resin preformed in the metal mold. The force piston is used again to pressurize the introduced PTFE resin against the preformed PTFE resin. The surface pressure applied to the PTFE resin is 25 Kgf/cm$^2$. Upon completion of this pressurized preforming process, a predetermined amount of PTFE resin is introduced onto the upper surface of the performed PTFE resin containing oxide ceramic or ferrite powder dispersed therein. These processes are repeated a predetermined number of times.

Thereafter, a predetermined amount of PTFE resin is introduced into the metal mold. The force piston is used to pressurize the PTFE resin to mold a matching line ingot. This compression molding process is made under a molding pressure ranging from 50 Kgf/cm$^2$ to 700 Kgf/cm$^2$ and preferably 250 Kgf/cm$^2$. It was confirmed that the dielectric layers 3701-1, 3701-2, . . . 3701-n were jointed strongly at smooth boundary surfaces 3702-1, 3702-2, . . . 3702-n to the respective dielectric layers 3703-1, 3703-2, . . . 3703-n.

The produced matching line ingot is take out of the cylindrical metal mold 3401 and, then, it is burned for three hours at a temperature higher than the melting point (327° C.) of the PTFE resin. A preferable turning temperature is 340° C. The resulting product is a matching line ingot having dielectric portions 2901 and 2902 integrally fusion bonded at boundary surfaces 3702-1, 3702-2, . . . 3702-n.

The matching line ingot is cut into a number of matching lines in such a manner as described in connection with FIG. 31.

Figure 38:
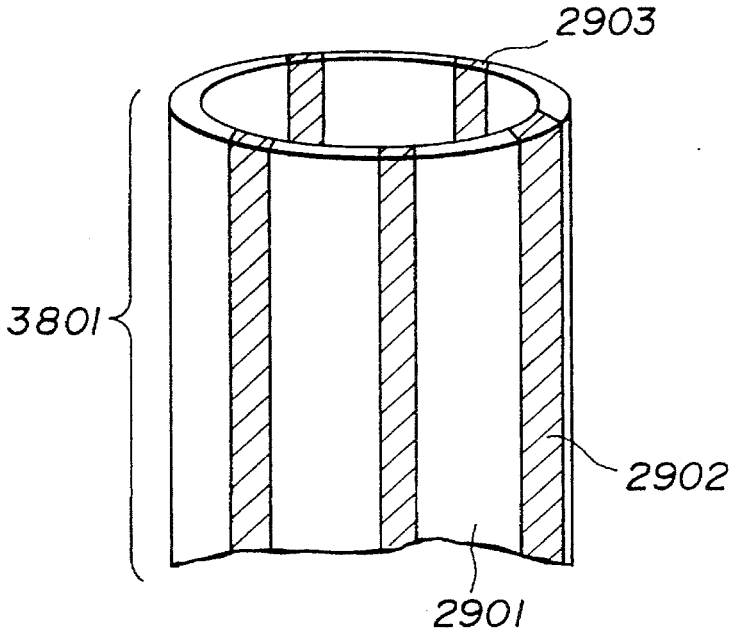
FIG. 38 is a fragmentary perspective view used in explaining another method of producing the matching line of the invention.

Referring to FIG. 38, description will be made to another method of producing the matching line described in connection with FIG. 33. A paste extrusion method is utilized to form a matching line tube 3801 of dielectric portions 2901 divided by a predetermined number of dielectric portions 2902 provided in the form of lines extending in the longitudinal direction thereof, as shown in FIG. 38. The dielectric portion 2902 contains oxide ceramic or ferrite powder uniformly dispersed therein. The dielectric portions 2901 and 2902 are fusion bonded strongly at boundary surfaces 2903. The matching line tube 3801 is modified in a flat sheet form and the matching line sheet is cut to produce a number of matching lines 3301 (FIG. 33) in such a manner as described in connection with FIG. 31.

According to the matching line producing method of the invention, the electric parts of the matching line are certainly fusion bonded with one another without the use of adhesive. Thus, the matching line of the invention is free from the disadvantages attendant on the conventional matching lines used for microwave and millimeter-wave bands.

Figure 39A:
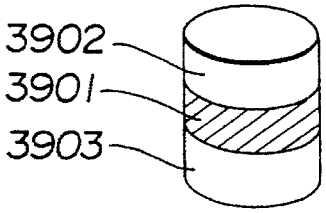
FIGS. 39A–39G are perspective views showing various forms of the resonator element of the invention.

Referring to FIG. 39A, there is shown a resonator element for use in an NRD guide embodying the invention. The resonator element includes a dielectric ceramic resonance portion 3901 sandwiched between upper and lower dielectric resin portions 3902 and 3903. The dielectric ceramic resonance portion 3901 has a high specific inductive capacity $\epsilon_r$ ranging from about 4 to about 100, and the upper and lower dielectric resin portions 3902 and 3903 have a low specific inductive capacity $\epsilon_r$ ranging from about 1.5 to about 4. The upper and lower dielectric resin portions 3902 and 3903 are made of a PTFE resin having a extra-high frequency electric characteristic.

Figure 39B:
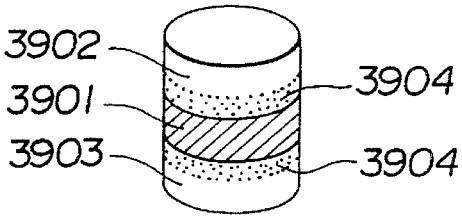

Referring to FIG. 39B, there is shown a modified form of the resonator element of the invention. In this modification, a PTFE resin layer 3904 is disposed between the upper surface of the dielectric ceramic resonance portion 3901 and the upper dielectric resin portion 3902, and another PTFE resin layer 3904 is disposed between the lower surface of the dielectric ceramic resonance portion 3901 and the lower dielectric resin portion 3903. The PTFE resin layers 3904 are made of PTFE resin containing a ceramic powder dispersed therein. The PTFE resin has a low specific inductive capacity and the ceramic powder has a high specific inductive capacity.

Figure 39C:
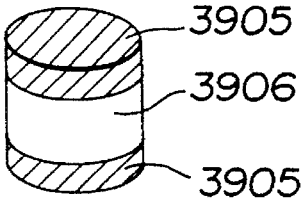
Figure 39D:
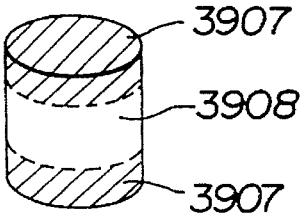
Figure 39E:
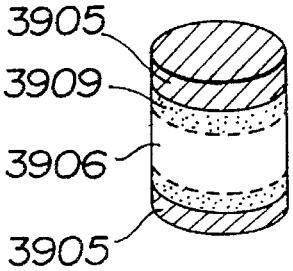
Figure 39F:
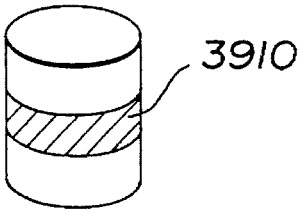
Figure 39G:
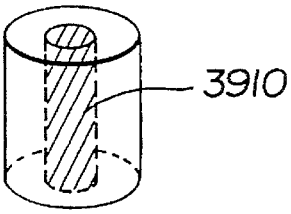

Referring to FIGS. 39C, 39D, 39E, 39F and 39G, there are shown various modified forms of the resonator element of the invention. FIG. 39C shows a resonator element having a spacer resin disc 3906 fusion bonded between a pair of ferrite discs 3905. FIG. 39D shows a resonator element having a pure fluorine resin disc 3908 fusion bonded between a pair of resin discs containing ferrite powder dispersed therein. FIG. 39E shows a resonator element which is substantially the same as shown in FIG. 39C except that a resin layer 3909 containing ferrite powder dispersed therein is disposed between the spacer resin disc 3905 and the upper ferrite disc 3905 and another resin layer 3909 containing ferrite powder dispersed therein is disposed between the spacer resin disc 3906 and the lower ferrite disc 3905. FIGS. 39F and 39G show different forms of resonator element having a resin disc or rod 3910 provided centrally therein. The resin disc or rod 3910 contains ferrite powder dispersed therein.

Figure 40:
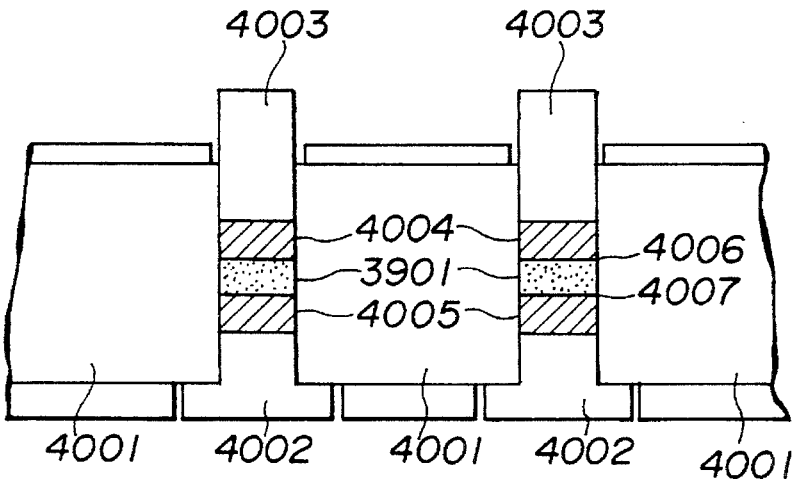
FIG. 40 is a fragmentary sectional view used in explaining a method of producing the resonator element of the invention.

Referring to FIG. 40, description will be made to a method of production of the resonator element of the invention with the use of a metal mold 4001 having a bottom frame 4002 and a force piston 4003. A predetermined amount of PTFE resin powder having a low specific inductive capacity is introduced into a cylindrical space defined by the bottom mold 4002 set on the bottom of the metal mold 4001. The force piston is used to pressurize the introduced PTFE resin powder to form a lower spacer PTFE resin disc. The appropriate surface pressure to be applied to the PTFE resin is greater than 25 Kgf/cm$^2$. Thereafter, a dielectric ceramic resonance element (disc) 3901 having a high specific inductive capacity is placed on the lower spacer PTFE resin disc. A predetermined amount of PTFE resin powder having a low specific inductive capacity is then introduced onto the upper surface of the dielectric ceramic resonance disc 3901. The force piston is used to pressurize the introduced PTFE resin powder to form an upper spacer PTFE resin disc. The appropriate surface pressure to be applied to the PTFE resin is greater than 25 Kgf/cm$^2$. Under this pressurized condition, they are sintered for 30 minutes or more at a temperature higher than the melting point (327° C.) of the PTFE resin. A preferable sintering temperature is 340° C. The resulting product is a resonator element as shown in FIG. 39A.

It is to be understood that the PTFE resin powder may be replaced with a sintered PTFE resin disc having a controlled weight and dimensions. It was confirmed that the dielectric ceramic resonance element (disc) 3901 was jointed strongly to the upper PTFE resin disc 4004 at a smooth boundary surface 4006 and to the lower PTFE resin disc 4005 at a smooth boundary surface 4007. The jointing strength is at least 0.3 Kgf/cm.

Figure 41:
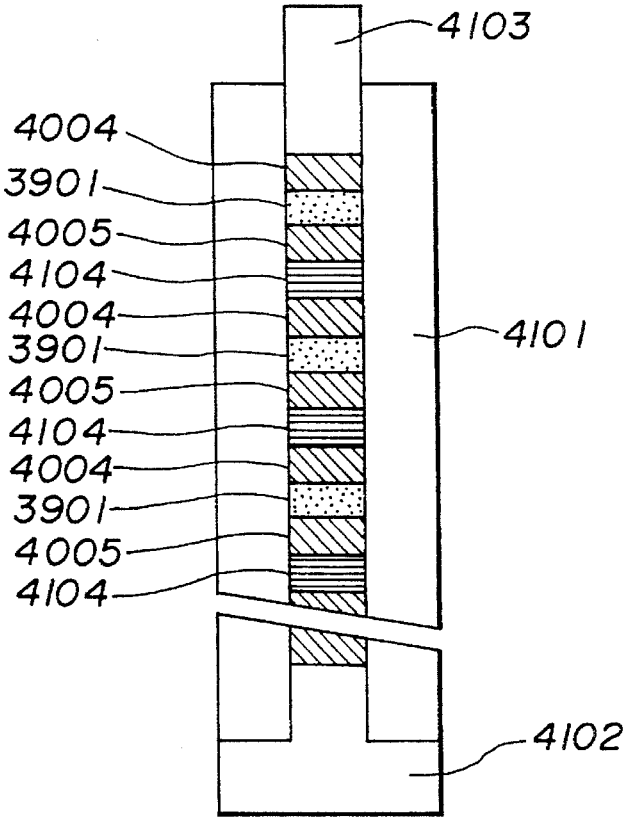
FIG. 41 is a fragmentary sectional view used in explaining another method of producing the resonator element of the invention.

Referring to FIG. 41, description will be made to a method of production of the resonator element of the invention with the use of a metal mold 4101 having a bottom frame 4102, a force piston 4103 and a metal spacer 4104. A predetermined amount of PTFE resin powder having a low specific inductive capacity is introduced into a cylindrical space defined by the bottom mold 4102 set on the bottom of the metal mold 4101. The force piston is used to pressurize the introduced PTFE resin powder to form a lower spacer PTFE resin disc. The appropriate surface pressure to be applied to the PTFE resin is greater than 25 Kgf/cm$^2$. Thereafter, a dielectric ceramic resonance element (disc) 3901 having a high specific inductive capacity is placed on the lower spacer PTFE resin disc. A predetermined amount of PTFE resin powder having a low specific inductive capacity is then introduced onto the upper surface of the dielectric ceramic resonance disc 3901. The force piston is used to pressurize the introduced PTFE resin powder to form an upper spacer PTFE resin disc. The appropriate surface pressure to be applied to the PTFE resin is greater than 25 Kgf/cm$^2$. A metal spacer 4101 is placed on the upper surface of the upper spacer PTFE resin disc. These processes are repeated a predetermined number of times.

Thereafter, the force piston 4103 is used to pressurize the layers formed in the cylindrical space defined by the bottom mold 4102. The appropriate surface pressure to be applied to the layers is greater than 25 Kgf/cm$^2$. Under this pressurized condition, the layers are sintered for 30 minutes or more at a temperature higher than the melting point (327° C.) of the PTFE resin. Upon completion of this sintering process, the metal spacers 4104 are removed. A preferable sintering temperature is 340° C. The resulting product is a resonator element as shown in FIG. 39A.

Description will be made to the resonator element as described in connection with FIG. 39B. A PTFE resin layer 3904 is disposed between the upper surface of the dielectric ceramic resonance portion 3901 and the upper dielectric resin portion 3902, and another PTFE resin layer 3904 is disposed between the lower surface of the dielectric ceramic resonance portion 3901 and the lower dielectric resin portion 3903. The PTFE resin layers 3904 are made of PTFE resin containing ceramic powder dispersed therein to have a uniform ceramic powder density or a ceramic powder density changing in a direction of thickness of the PTFE resin layer 3904. The lower dielectric resin portion 3903, the PTFE resin layer 3904, the dielectric ceramic resonance layer 3901, the PTFE resin layer 3904 and the upper dielectric resin layer 3902 piled in this order. Within the metal mold, the layers are compressed and sintered at a temperature higher than the melting point of the PTFE resin. The layers may be sintered while compressed within the metal mold.

Figure 42:
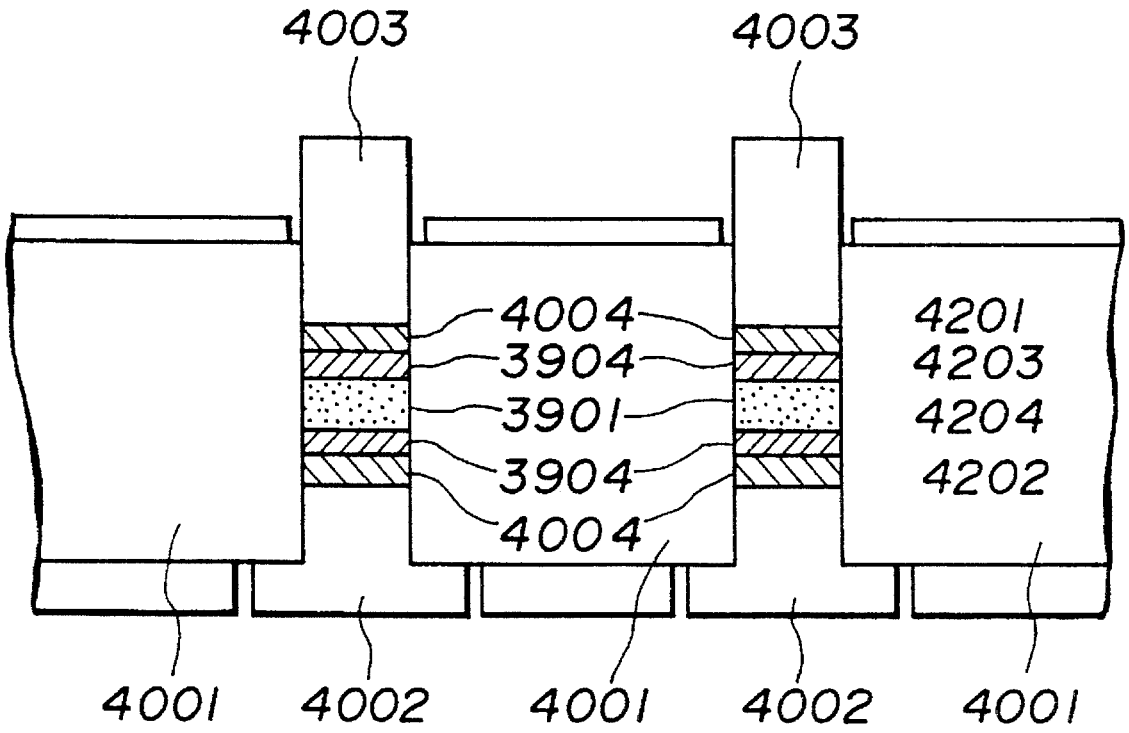
FIG. 42 is a fragmentary sectional view used in explaining another method of producing the resonator element of the invention.

Referring to FIG. 42, description will be made to another method of production of the resonator element of the invention with the use of a metal mold 4001 which is similar to that used in the resonator element production method described in connection with FIG. 40. That is, the metal mold 4001 has a bottom mold 4002 and a force piston 4003. A predetermined amount of PTFE resin powder having a low specific inductive capacity is introduced into a cylindrical space defined by the bottom mold 4002 set on the bottom of the metal mold 4001. The force piston is used to pressurize the introduced PTFE resin powder to form a PTFE resin disc 4004. The appropriate surface pressure to be applied to the PTFE resin powder is greater than 25 Kgf/$cm^2$. Thereafter, a predetermined amount of PTFE powder mixed uniformly with ceramic powder having a high specific inductive capacity is introduced onto the PTFE resin disc 4004. The force piston is used to pressurize the introduced PTFE resin powder to form a PTFE resin disc 3904. The appropriate surface pressure to be applied to the PTFE resin powder is greater than 25 Kgf/$cm^2$. A dielectric ceramic resonance element (disc) 3901 having a high specific inductive capacity is placed on the PTFE resin disc 3904. Thereafter, a predetermined amount of PTFE powder mixed uniformly with ceramic powder having a high specific inductive capacity is introduced onto the PTFE resin disc 4004. The force piston is used to pressurize the introduced PTFE resin powder to form a PTFE resin disc 3904. The appropriate surface pressure to be applied to the PTFE resin powder is greater than 25 Kgf/$cm^2$. A predetermined amount of PTFE resin powder having a low specific inductive capacity is then introduced. The force piston is used to pressurize the introduced PTFE resin powder. The appropriate surface pressure applied to the PTFE resin is greater than 50 Kgf/$cm^2$. Under this pressurized condition, they are sintered for 30 minutes or more at a temperature higher than the melting point (327° C.) of the PTFE resin. A preferable sintering temperature is 340° C. The resulting product is a resonator element as shown in FIG. 39B.

It is to be understood that the PTFE resin powder may be replaced with a sintered PTFE resin disc having a controlled weight and dimensions. It was confirmed that the dielectric ceramic resonance element (disc) 3901 was jointed strongly to the upper PTFE resin disc 4004 at a smooth boundary surface 4006 and to the lower PTFE resin disc 4005 at a smooth boundary surface 4007. The jointing strength is at least 0.3 Kgf/cm.

According to the resonator producing method of the invention, the electric parts of the resonator are certainly fusion bonded with one another without the use of adhesive. Thus, the resonator of the invention is free from the disadvantages attendant on the conventional resonators used for microwave and millimeter-wave bands.

Figure 43A:
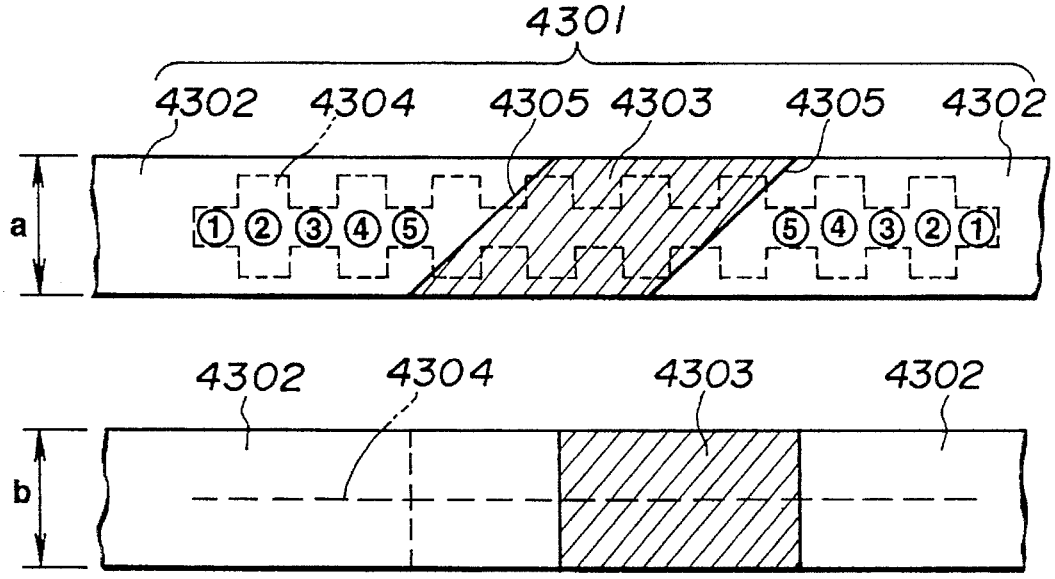
FIG. 43A is a fragmentary sectional view showing a switching circuit made in accordance with the invention.
Figure 43B:
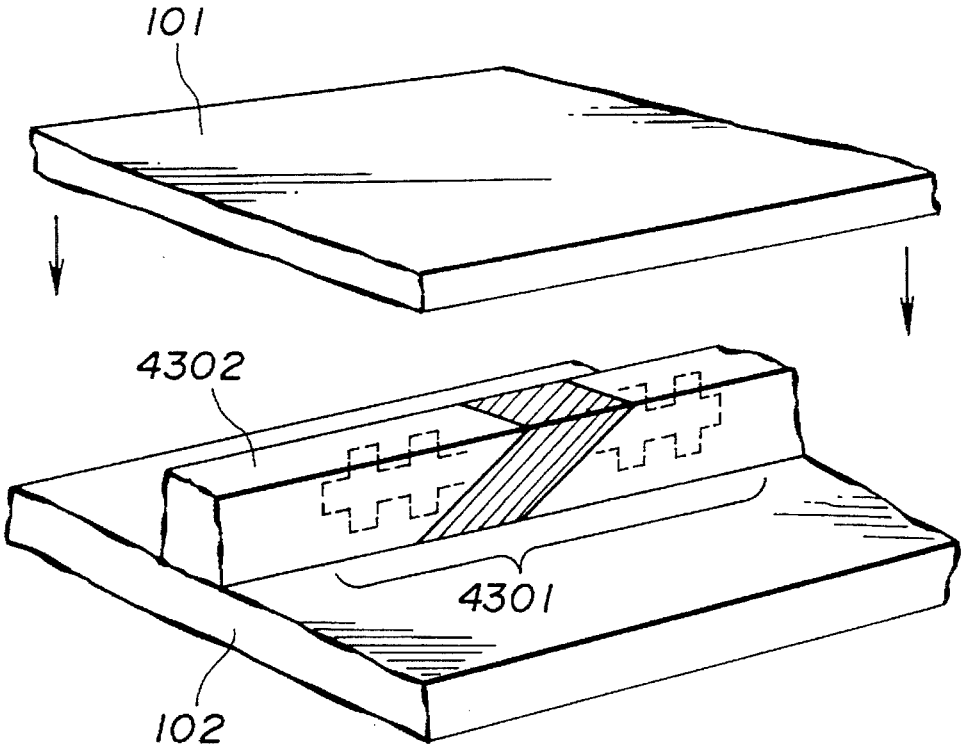
FIG. 43B is a fragmentary perspective view showing the switching circuit of the invention.

Referring to FIGS. 43A and 43B, there is shown a switching circuit for use in a non-radiative dielectric (NRD) guide embodying the invention. The switching circuit (line) 4301 includes a rod-shaped dielectric line having a ferrite powder dispersed dielectric line portion 4303 fusion bonded at opposite inclined boundary surfaces 4305 to pure dielectric line portions 4302. The pure dielectric line portions are made of a pure dielectric material, and the ferrite powder dispersed dielectric line portion is made of a pure dielectric material containing a predetermined percentage by weight or volume of ferrite powder dispersed therein. An unnecessary mode suppressor 4304 is placed centrally in the rod-shaped dielectric line in such a manner as to extend through the ferrite powder dispersed dielectric line portion 4303. The unnecessary mode suppressor 4304 serves to suppress unnecessary modes $LSE_{01}$ and TE which may be caused due to line section vertical and horizontal nonsymmetry. That is, the unnecessary mode suppressor 4304 is provided to absorb unnecessary modes produced under an abnormal magnetic field condition which may occur in the presence of a DC bias applied to the ferrite powder dispersed dielectric line portion 4303 when the switching circuit is turned off.

Figure 44A:
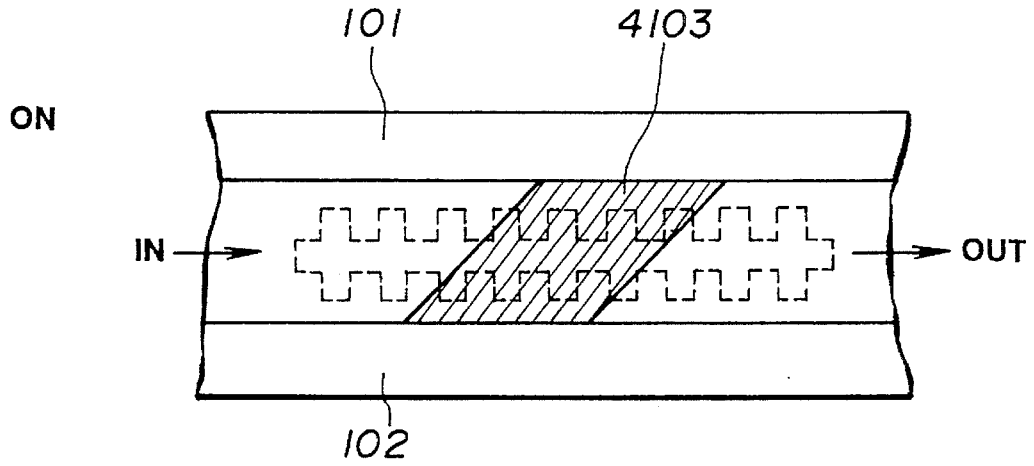
FIGS. 44A and 44B are fragmentary sectional views used in explaining the operation of the switching circuit of the invention.
Figure 44B:
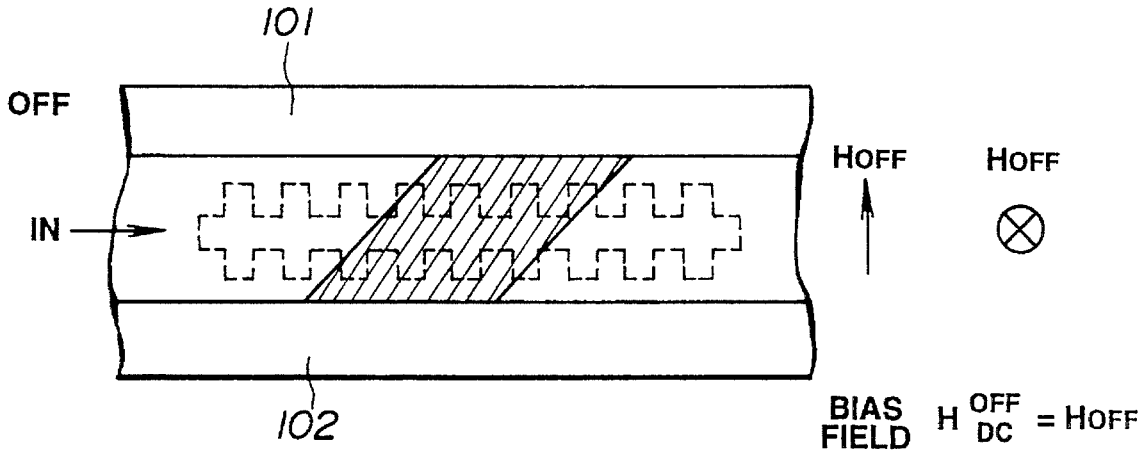
Figure 45A:
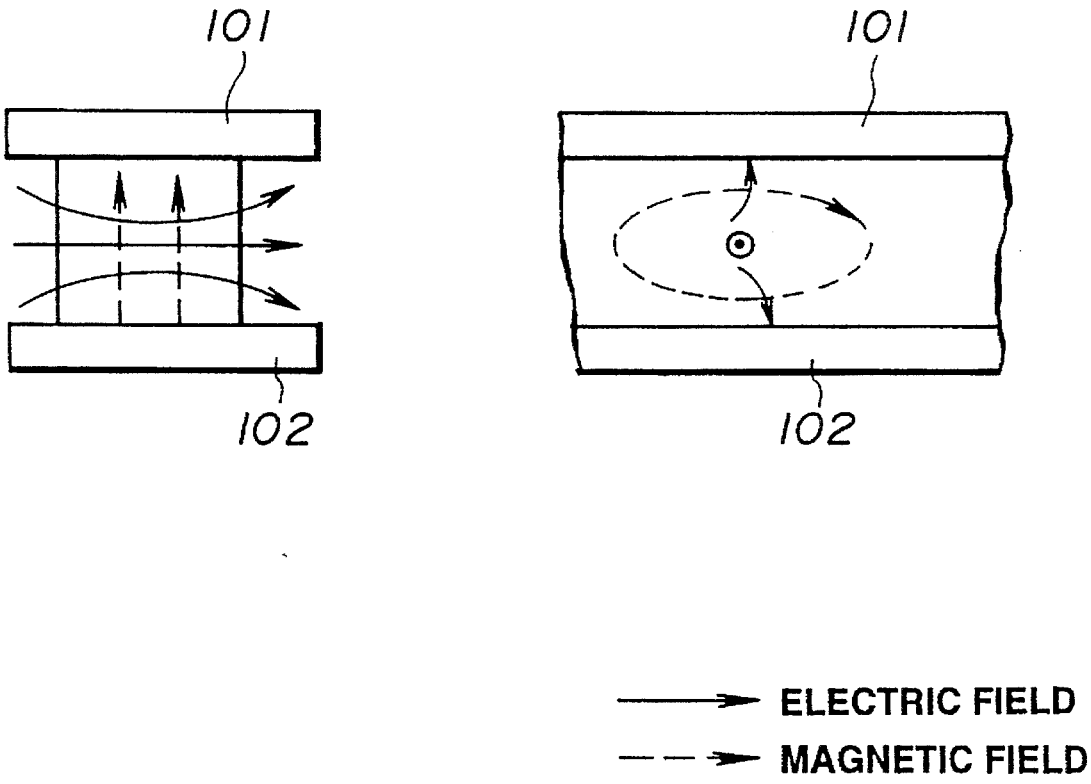
FIGS. 45A and 45B are schematic views used in explaining the operation of the switching circuit of the invention.
Figure 45B:
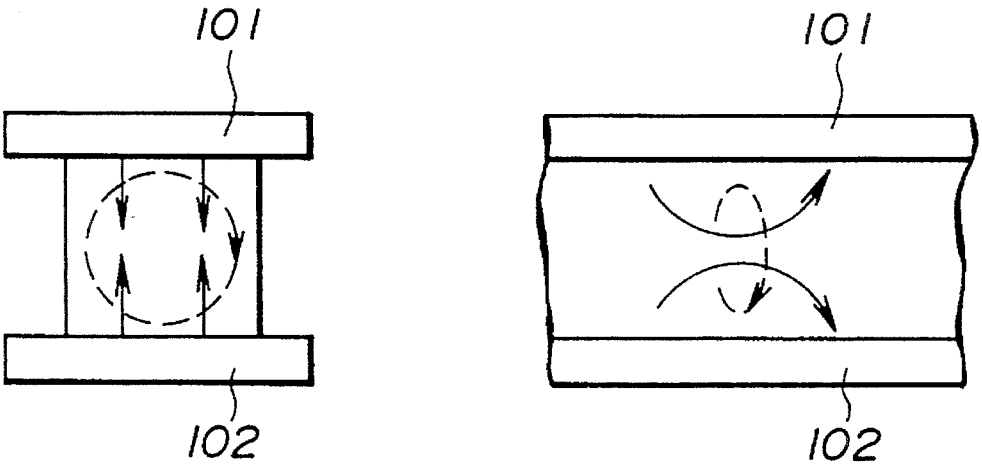

The switching circuit is held turned on when not biased, as shown in FIG. 44A. As a result, a signal is inputted into the switching circuit, as indicated by the arrow (in) and transmitted through the inclined boundary surfaces 4305 into the ferrite powder dispersed dielectric line portion 4303. The inputted signal is outputted from the switching circuit, as indicated by the arrow (out) with a small loss. To turn the switching circuit off, a DC bias may be applied in the vertical or horizontal direction to the upper and lower conductive plates 101 and 102. As a result, the dispersed ferrite is directed magnetically in the direction of application of the DC bias, as shown in FIG. 44B. As can be seen from FIGS. 45A and 45B, the main transmission mode is not reflected completely although it is suppressed. The inputted signal is partially absorbed in the ferrite powder dispersed dielectric line portion 4303 and almost no signal appears at the output. It is, therefore, possible to minimize the reflection toward the input side. Since an LSE unnecessary mode occurs due to an abnormal magnetic field condition, the unnecessary mode suppressor 4304 is provided.

Figure 46A:
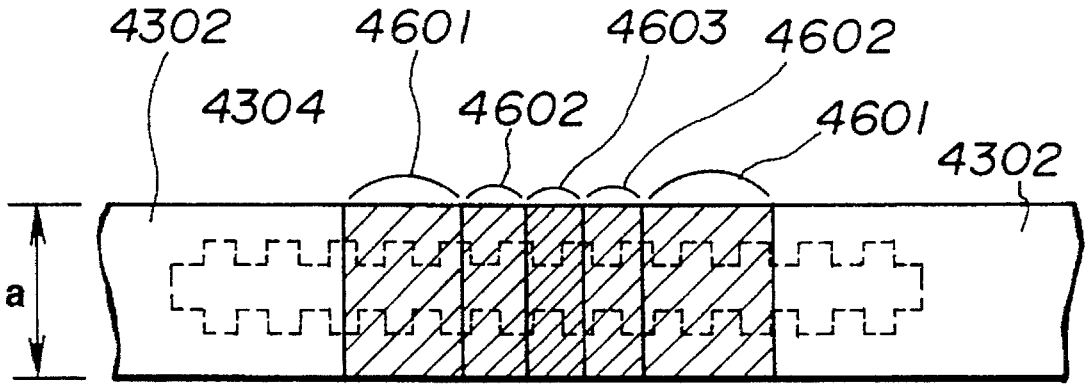
FIGS. 46A and 46B are fragmentary sectional views showing a modified form of the switching circuit of the invention.
Figure 46B:
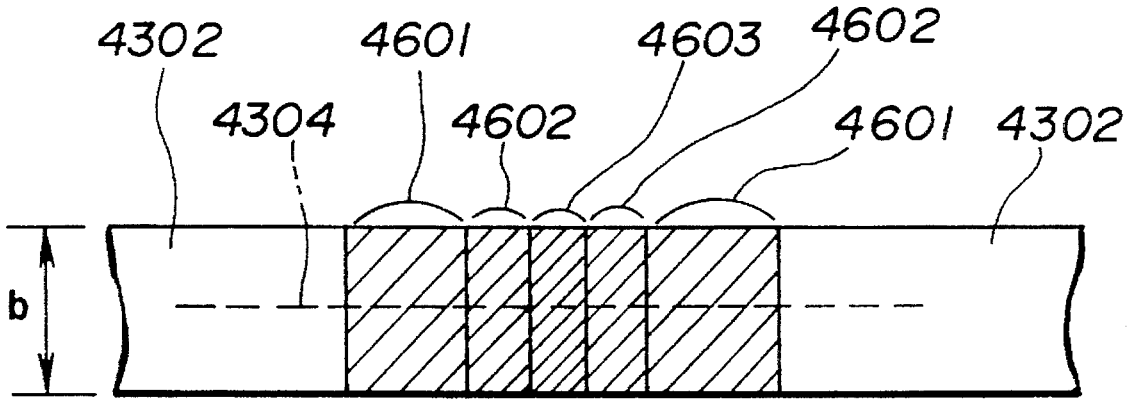

Referring to FIGS. 46A and 46B, there is shown a modified form of the switching circuit of the invention. A predetermined number of ferrite powder dispersed dielectric blocks 4601, 4602 and 4603 are disposed between the pure dielectric line portions 4302. The percentages of the ferrite powder contained in the respective dielectric blocks 4601, 4602 and 4603 are determined in such a manner as to minimize the degree to which the inputted signal is reflected and permit the possibility of the inputted signal to pass the switching circuit. For example, the percentage of ferrite powder contained in the dielectric block 4602 is greater than the percentage of ferrite powder contained in the dielectric block 4601. The percentage of ferrite powder contained in the dielectric block 4603 is greater than the percentage of ferrite powder contained in the dielectric block 4602. The reflection characteristic may be improved by providing inclined boundary surfaces on the opposite sides of the series connection of the dielectric blocks, as described in connection with FIGS. 43A and 43B.

According to the switching circuit producing method of the invention, the electric parts of the switching circuit are certainly fusion bonded with one another without the use of adhesive. Thus, the resistive terminator of the invention is free from the disadvantages attendant on the conventional switching circuits used for microwave and millimeter-wave bands.

Figure 47:
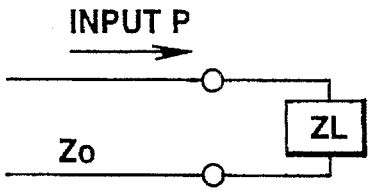
FIG. 47 is a circuit diagram used in explaining the operation of an impedance matching element made in accordance with the invention.

Description will be made to an impedance matching/converting element. The efficiency with which an input power P is supplied to a load $Z_L$ through a line having an impedance $Z_0$, as shown in FIG. 47, is at maximum when $$Z_0=Z_L^* \quad (1)$$

where $Z_L^*=R+jX$ assuming that $Z_L=R-jX$)

Figure 48:
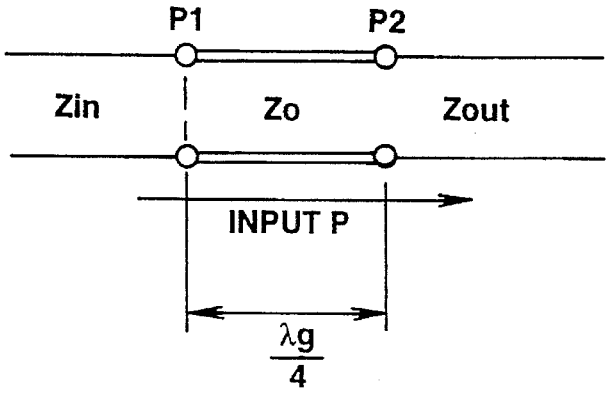
FIG. 48 is a circuit diagram used in explaining the operation of an impedance converting element made in accordance with the invention.

The efficiency with which an input power P is supplied from a port P1 to a port P2, as shown in FIG. 48, is a t maximum when $$Z_0^2=Z_{in}\cdot Z_{out}. \quad (2)$$

Figure 49A:
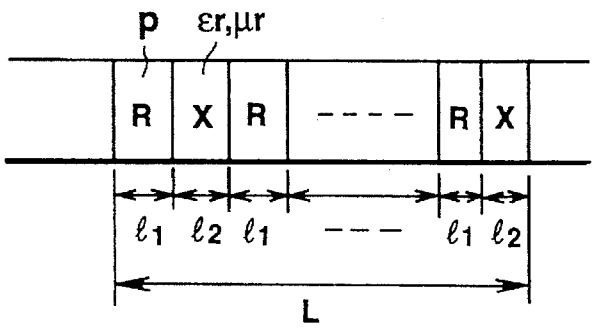
FIGS. 49A and 49B are schematic views showing an impedance matching/converting element made in accordance with the invention.
Figure 49B:
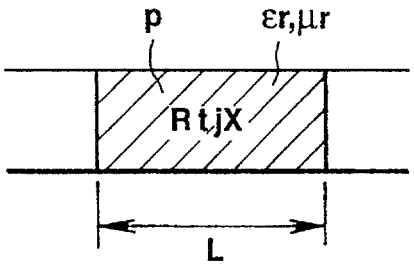

The condition derived from Equations (1) and (2) can be satisfied by an element or line having a characteristic impedance $Z_0=R+jX$. For example, this condition can be realized by the use of a pure dielectric member containing a ρ powder and a pure dielectric member containing $\epsilon_r$ or $\mu_r$ powder, as shown in FIGS. 49A and 49B. The character ρ is used to indicate a material such as carbon, graphite, ferrite or the like having a high specific resistance, the character $\epsilon_r$ is used to indicate a material such as ceramics or the like having a high specific inductive capacity ranging from 3 to 100, and the character $\mu_r$ is used to indicate a material such as magnetic ceramics, ferrite or the like having a high relative permeability.

Figure 50A:
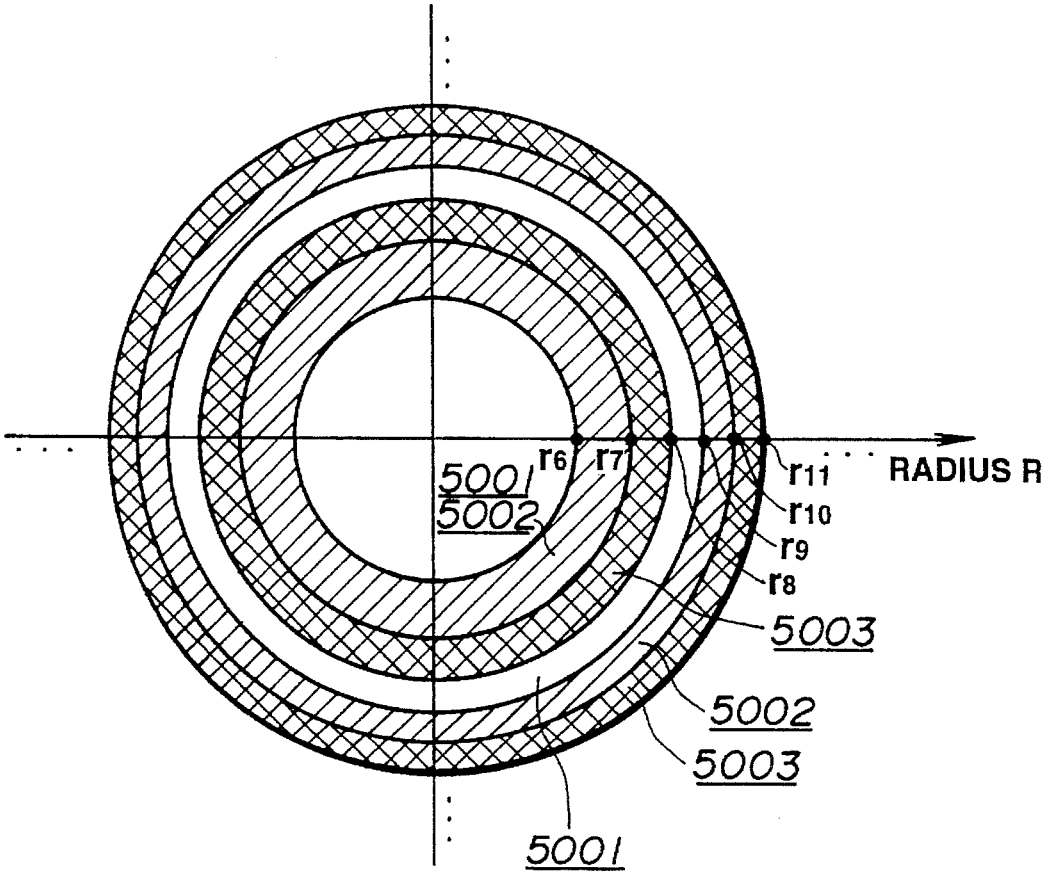
FIG. 50A is a plan view showing one embodiment of an electromagnetic lens made in accordance with the invention.
Figure 50B:
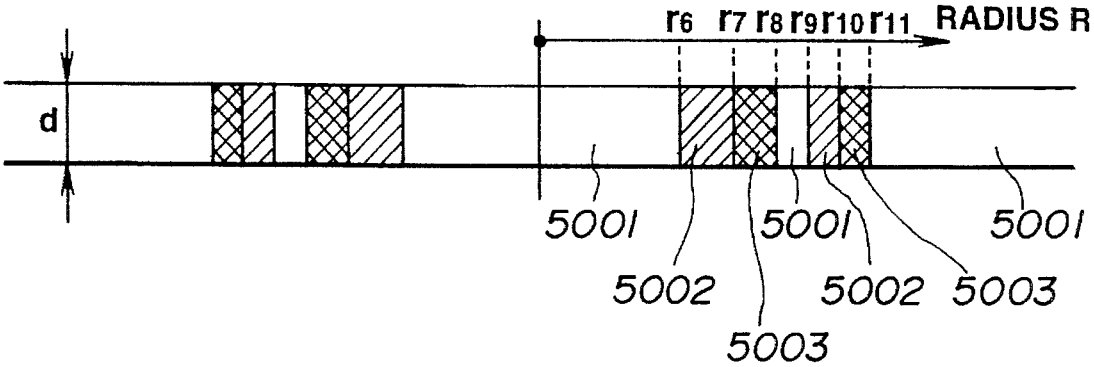
FIG. 50B is a sectional view showing the electromagnetic lens of FIG. 50A.

Referring to FIGS. 50A and 50B, there is shown a dielectric resin electromagnetic lens embodying the invention. The electromagnetic lens, which is taken in the form of a flat disc having a predetermined thickness (d), has a predetermined number of phase zones 5001, 5002 and 5003 disposed in a concentric relationship with one another. The phase zones 5001 are made of a base material such as pure fluorine resin. The phase zones 5002 are made of pure fluorine resin containing a first predetermined percentage of a dielectric powder having a high specific inductive capacity. The phase zones 5003 are made of pure fluorine resin containing a second predetermined percentage of a dielectric powder having a high specific inductive capacity. The first and second percentages are determined in such a manner that the phase zones 5001, 5002 and 5003 provide different phase shifts of 0°, 120° and 240°.

Figure 51A:
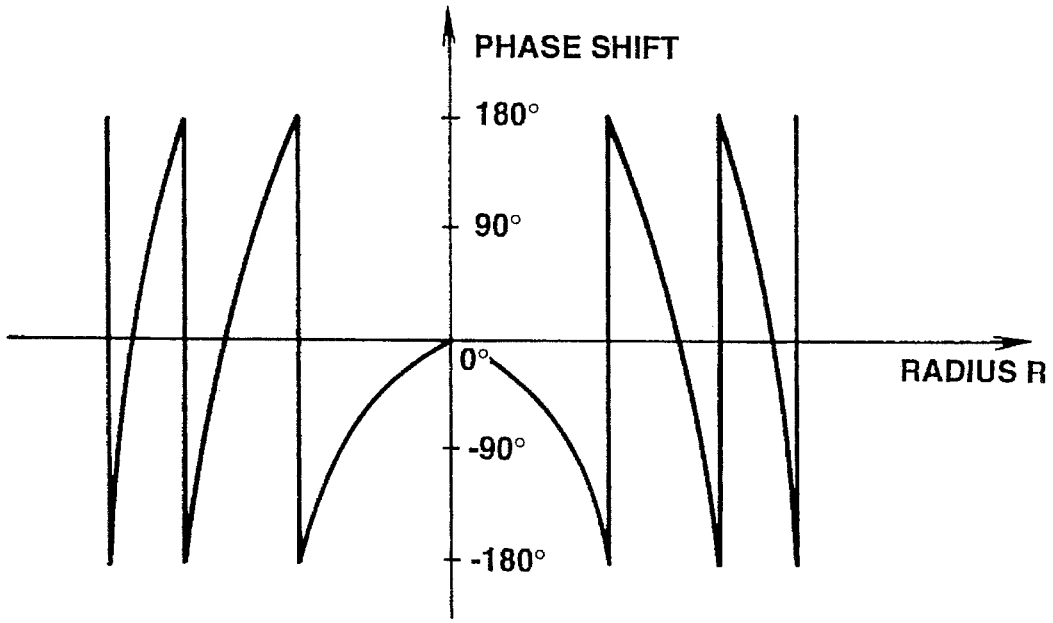
FIG. 51A is a graph showing original phase values obtained from a Fresnel zone chart.
Figure 51B:
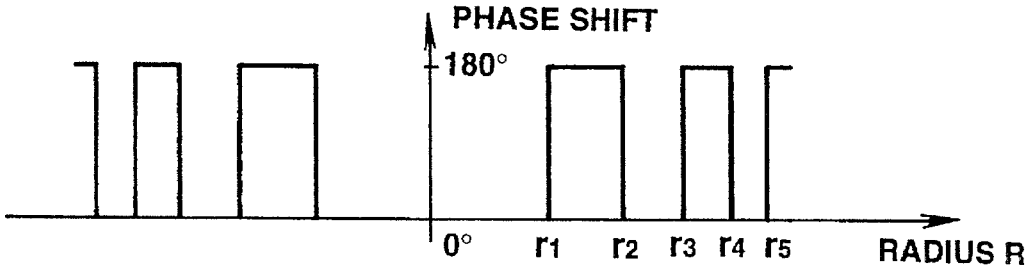
FIG. 51B is a graph showing phase values obtained by rounding the original phase values with respect to two discontinuous finite values.
Figure 51C:
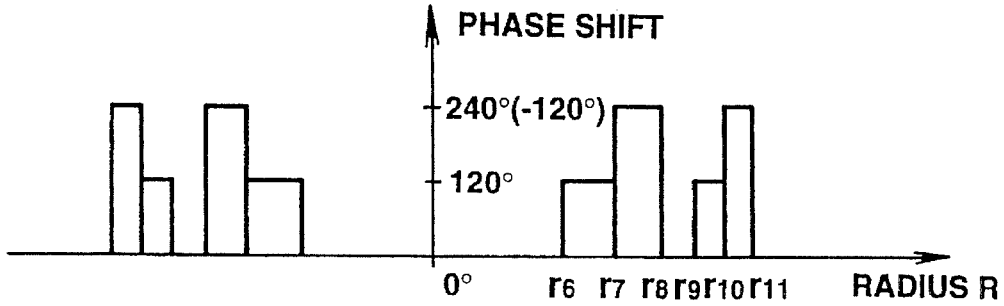
FIG. 51C is a graph showing phase values obtained by rounding the original phase values with respect to three discontinuous finite values.

Referring to FIGS. 51A, 51B and 51C, description is made the manner to which the phase zones are designed. FIG. 51A shows a normal Fresnel zone chart relating the phase shift with respect to the radius of the electromagnetic lens. This Fresnel zone chart is used to create a phase-radius chart wherein the phase shift values are converted into the form of 0° or 180°, as shown in FIG. 51B, by rounding the phase values with respect to +90° and −90°. As can be seen from FIG. 51B, he phase is 0° for the circular phase zone indicated by the radius ranging from 0 to r1, the annular phase zone indicated by the radius ranging from r2 to r3 and the annular phase zone indicated by the radius ranging from r4 to r5. The phase is 180° for the annular phase zone indicated by the radius ranging from r1 to r2, the annular phase zone indicated by the radius ranging from r3 to r4 and the annular phase zone indicated by the radius greater than r5. This phase-radius chart may be used to produce an electromagnetic lens having two different phase zones arranged alternatively in a concentric relationship. In this case, the electromagnetic lens is a dielectric disc having coaxial metal film rings fusion bonded on its one surface for the annular phase zones indicated by the radius ranging from r1 to r2, the radius ranging from r3 to r4 and the radius greater than r5. The dielectric disc has a predetermined thickness and a predetermined specific inductive capacity.

The Fresnel zone chart of FIG. 51A may be used to create a phase-radius chart wherein the phase shift values are converted into the form of 0°, 120° or 240°, as shown in FIG. 51C. As can be seen from FIG. 51B, the phase is 0° for the circular phase zone indicated by the radius ranging from 0 to r6, the annular phase zone indicated by the radius ranging from r8 to r9 and the annular phase zone indicated by the radius greater than r11. The phase is 120° for the annular phase zone indicated by the radius ranging from r6 to r7 and the annular phase zone indicated by the radius ranging from r9 to r10. The phase is 240° for the annular phase zone indicated by the radius ranging from r7 to r8 and the annular phase zone indicated by the radius ranging from r10 to r11. This phase-radius chart may be used to produce an electromagnetic lens having three different phase zones arranged alternatively in a concentric relationship in a manner similar to that described in connection with FIG. 51B. The phase-radius chart of FIG. 51C can provide a characteristic closer to the characteristic of FIG. 51A to the electromagnetic lens than the phase-radius chart of FIG. 51B. In order to improve the characteristic of the electromagnetic lens, the phase shift values of the Fresnel zone chart of FIG. 51A may be converted into the form of greater number of phase values.

Figure 52:
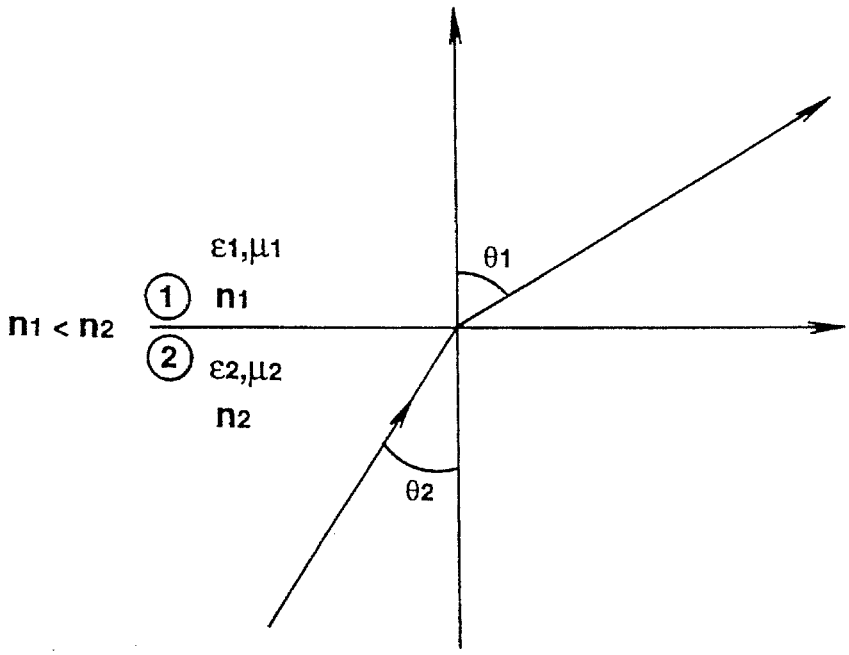
FIG. 52 is a graph used in explaining the relationship between the refractive index and specific inductive capacity of the electromagnetic lens of the invention.

It is now assumed that an electromagnetic wave is incident on a substance made of first and second materials (1) and (2) having different characteristics are in contact with each other at a contact surface X, as shown in FIG. 52. The first material (1) has a dielectric constants $\epsilon_1$, a magnetic permeability $\mu_1$, a phase constant $k_1$, a refractive index $n_1$ and a phase velocity $V_1$. The second material (2) has a dielectric constants $\epsilon_2$, a magnetic permeability $\mu_2$, a phase constant $K_2$, a refractive index $n_2$ and a phase velocity $V_2$. For the contact surface, the following equation is obtained:

$$K_1\times\sin\theta_1 K_2\times\sin\theta_2$$

Thus, $$\frac{\sin\theta_2}{\sin\theta_1}=\frac{k_2}{k_1}=\frac{\sqrt{\epsilon_2\mu_2}}{\sqrt{\epsilon_1\mu_1}}=\frac{n_2}{n_1}$$

$$k_1=\frac{\omega}{v_1},\ v_1=\frac{1}{\sqrt{\epsilon_1\mu_1}}$$

where ω is the angular frequency. Thus, if $\mu_1=\mu_2\approx\mu_0$ (space permeability), $$n_1=\sqrt{\epsilon_1}=\sqrt{\epsilon_0\epsilon_{ri}}$$

where i=1, 2, $\mu_1$ is the space permeability and $\mu_{ri}$ is the specific inductive capacity.

Figure 53:
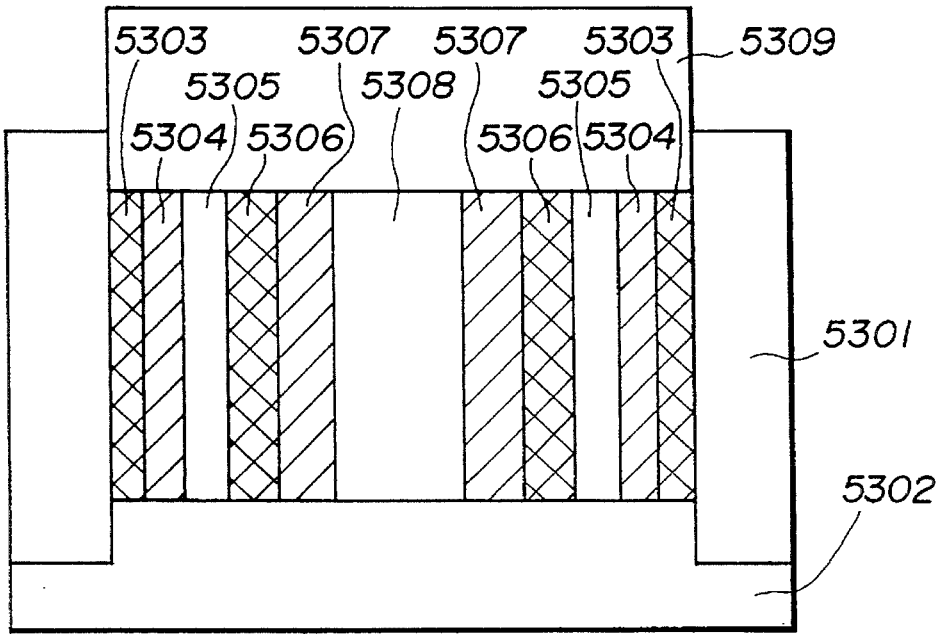
FIG. 53 is a sectional view used in explaining a method of producing the electromagnetic lens of the invention.

Referring to FIG. 53, description will be made to a method of production of the electromagnetic lens of the invention with the use of a cylindrical metal mold 5301 having a bottom board 5302 and a force piston 5309. PTFE resin containing a first predetermined amount of oxide ceramic powder dispersed uniformly therein is sintered to produce an oxide ceramic dispersed PTFE resin sleeve 5303 having a specific inductive capacity $\epsilon_{r3}$. The oxide ceramic dispersed PTFE resin sleeve 5303 is placed in the metal mold 5301. PTFE resin containing a second predetermined amount of oxide ceramic powder dispersed uniformly therein is sintered to produce an oxide ceramic dispersed PTFE resin sleeve 5304 having a specific inductive capacity $\epsilon_{r2}$. The oxide ceramic dispersed PTFE resin sleeve 5304 is placed inside the oxide ceramic dispersed PTFE resin sleeve 5303 in the metal mold 5301. A PTFE resin sleeve 5305 is placed inside the oxide ceramic dispersed PTFE resin sleeve 5304 in the metal mold 5301.

PTFE resin containing a first predetermined amount of oxide ceramic powder dispersed uniformly therein is sintered to produce an oxide ceramic dispersed PTFE resin sleeve 5306 having a specific inductive capacity $\epsilon_{r3}$. The oxide ceramic dispersed PTFE resin sleeve 5306 is placed inside the PTFE resin sleeve 5305 in the metal mold 5301. PTFE resin containing a second predetermined amount of oxide ceramic powder dispersed uniformly therein is sintered to produce an oxide ceramic dispersed PTFE resin sleeve 5307 having a specific inductive capacity $\epsilon_{r2}$. The oxide ceramic dispersed PTFE resin sleeve 5307 is placed inside the oxide ceramic dispersed PTFE resin sleeve 5306 in the metal mold 5301. A PTFE resin rod 5308 is placed inside the oxide ceramic dispersed PTFE resin sleeve 5307 in the metal mold 5301.

Figure 54:
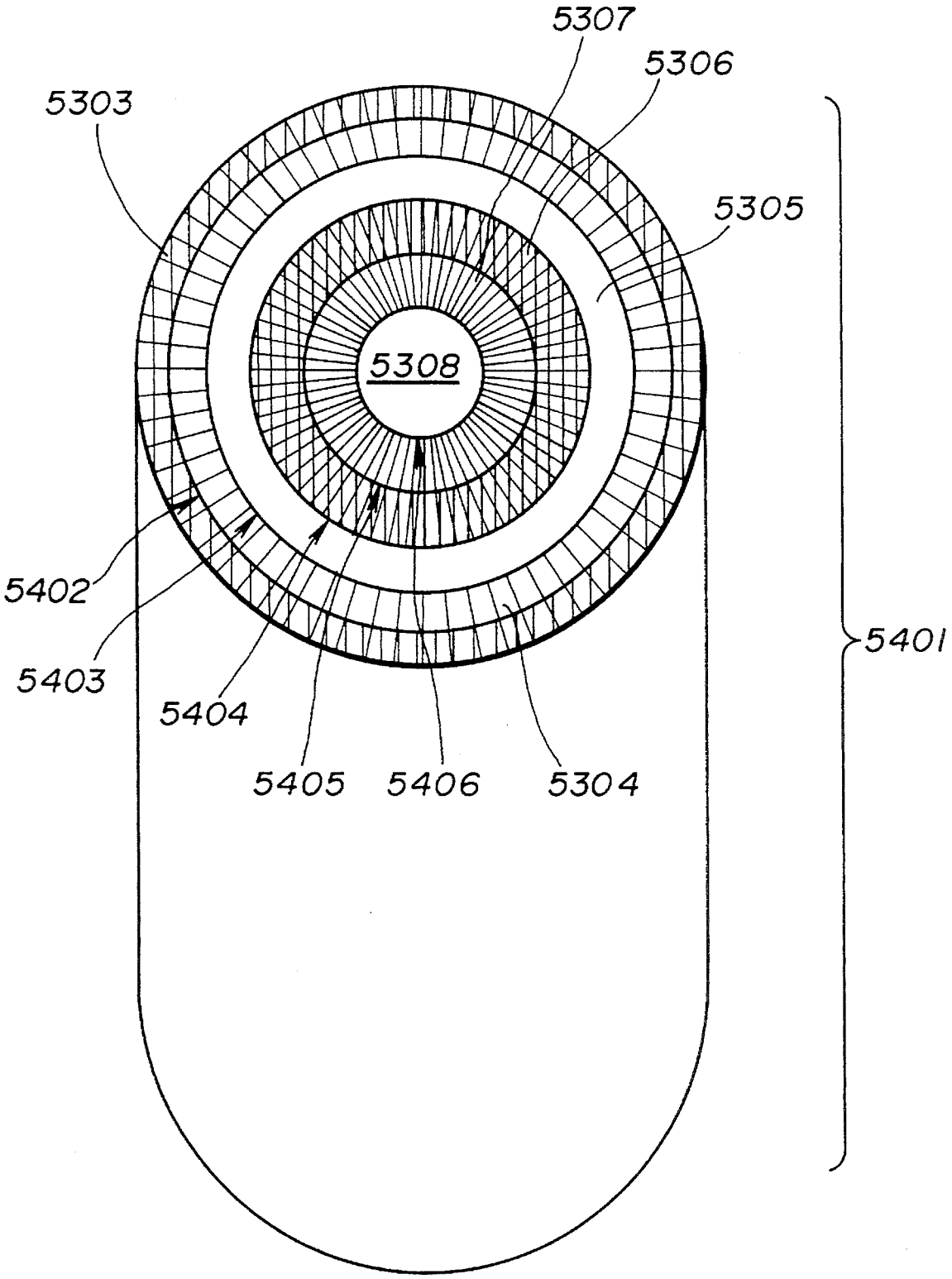
FIG. 54 is a perspective view used in explaining the method of producing the electromagnetic lens of the invention.

Thereafter, the force piston 5309 is used to pressurize the sleeves and rod placed in the metal mold 5301. The appropriate surface pressure to be applied to the sleeves and rod is greater than 10 Kgf/cm$^2$ and preferably in the range of 50 Kgf/cm$^2$ to 700 Kgf/cm$^2$. Under this pressurized condition, the sleeves and rod are sintered for 3 hours at a temperature higher than the melting point (327° C.) of the PTFE resin. A preferable sintering temperature is 340° C. The resulting product is a PTFE resin electromagnetic lens block 5401, as shown in FIG. 54. The PTFE resin electromagnetic lens block 5401 is taken out of the metal mold 5301. It was confirmed that the oxide ceramic dispersed PTFE resin sleeve 5303 was strongly fusion bonded at the boundary surface 5402 to the oxide ceramic dispersed PTFE resin sleeve 5304, the oxide ceramic dispersed PTFE resin sleeve 5304 was strongly fusion bonded at the boundary surface 5403 to the PTFE resin sleeve 5305, the PTFE resin sleeve 5305 was strongly fusion bonded at the boundary surface 5404 to the oxide ceramic dispersed PTFE resin sleeve 5306, the oxide ceramic dispersed PTFE resin sleeve 5306 was strongly fusion bonded at the boundary surface 5405 to the oxide ceramic dispersed PTFE resin sleeve 5307, and the oxide ceramic dispersed PTFE resin sleeve 5307 was strongly fusion bonded at the boundary surface 5406 to the PTFE resin rod 5308. Thereafter, the PTFE resin electromagnetic lens block 5401 is cut into a number of electromagnetic lenses as shown in FIGS. 50A and 50B.

Figure 55:
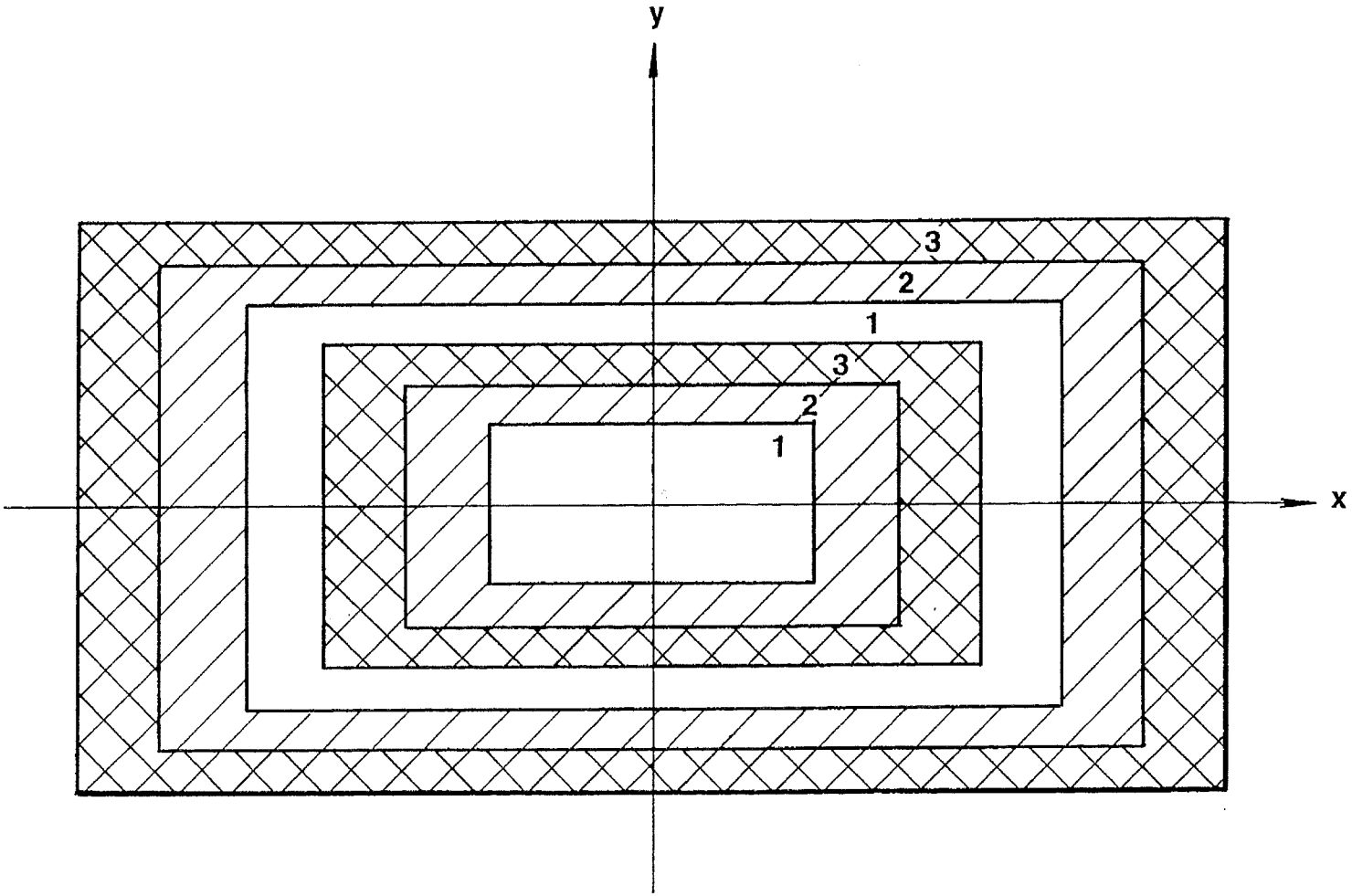
FIG. 55 is a plan view showing a modified form of the electromagnetic lens of the invention.
Figure 56A:
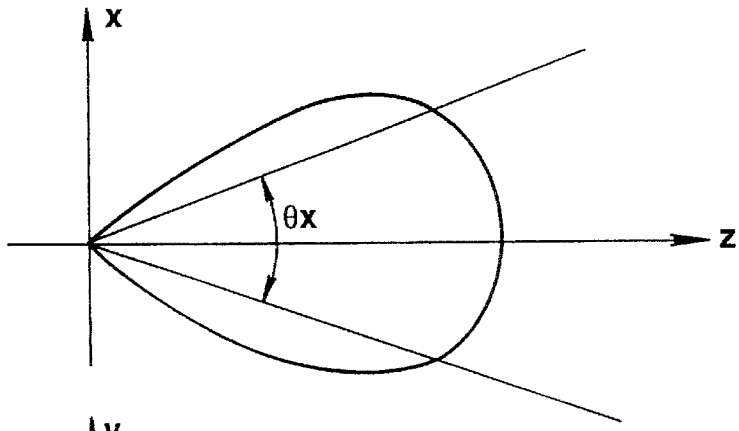
FIGS. 56A and 56B are graphs used in explaining the directivity of the electromagnetic lens of the invention.
Figure 56B:
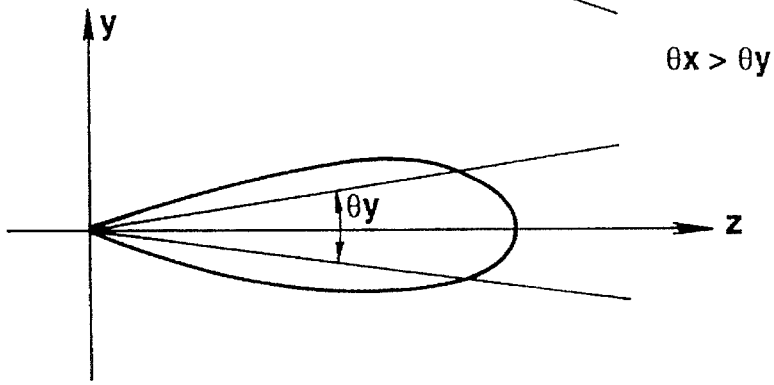

Referring to FIG. 55, there is shown a modified form of the electromagnetic lens of the invention. In this modification, the electromagnetic lens is taken in the form of a rectangular flat plate having a predetermined number of phase zones 1, 2 and 3. The phase zones 1 are made of a base material such as pure fluorine resin. The phase zones 2 are made of pure fluorine resin containing a first predetermined percentage of a dielectric powder having a high specific inductive capacity. The phase zones 3 are made of pure fluorine resin containing a second predetermined percentage of a dielectric powder having a high specific inductive capacity. The first and second percentages are determined in such a manner that the phase zones 1, 2 and 3 provide different phase shifts. With this modification, the directivities on the x–z plane and y–z plane are regulated in such a manner that the beam width $\theta_x$ on the x–z plane is greater than the beam width $\theta_y$, as shown in FIGS. 56A and 56B. Therefore, an electromagnetic lens antenna to which the invention is applied can provide three dimensional beam regulation.

Figure 57:
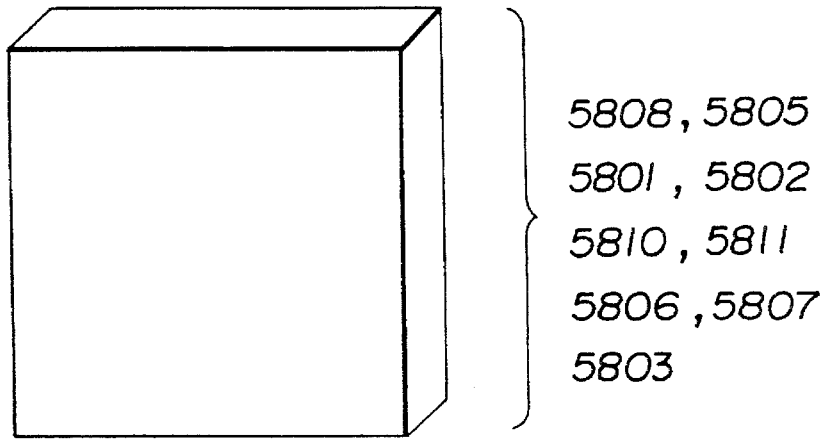
FIG. 57 is a perspective view showing a PTFE resin plate used in the course of production of the electromagnetic lens of the invention.
Figure 58A:
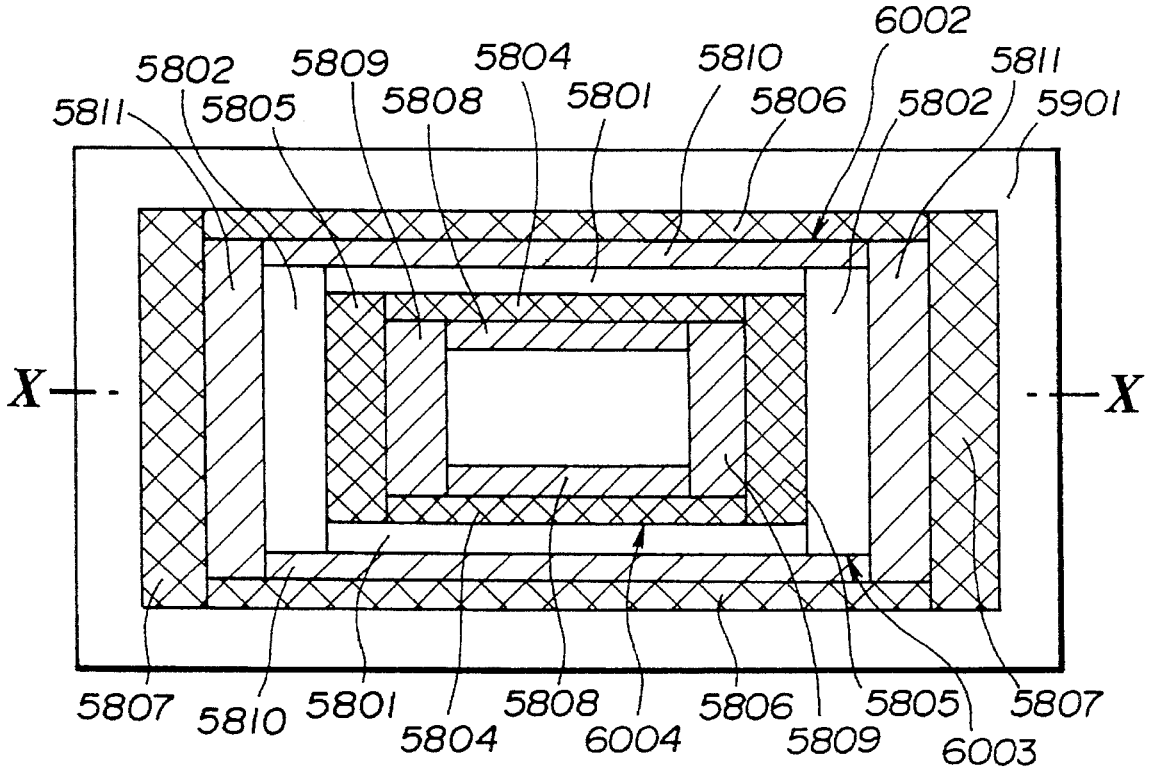
FIG. 58A is a plan view used in explaining a method of producing the electromagnetic lens of the invention.
Figure 58B:
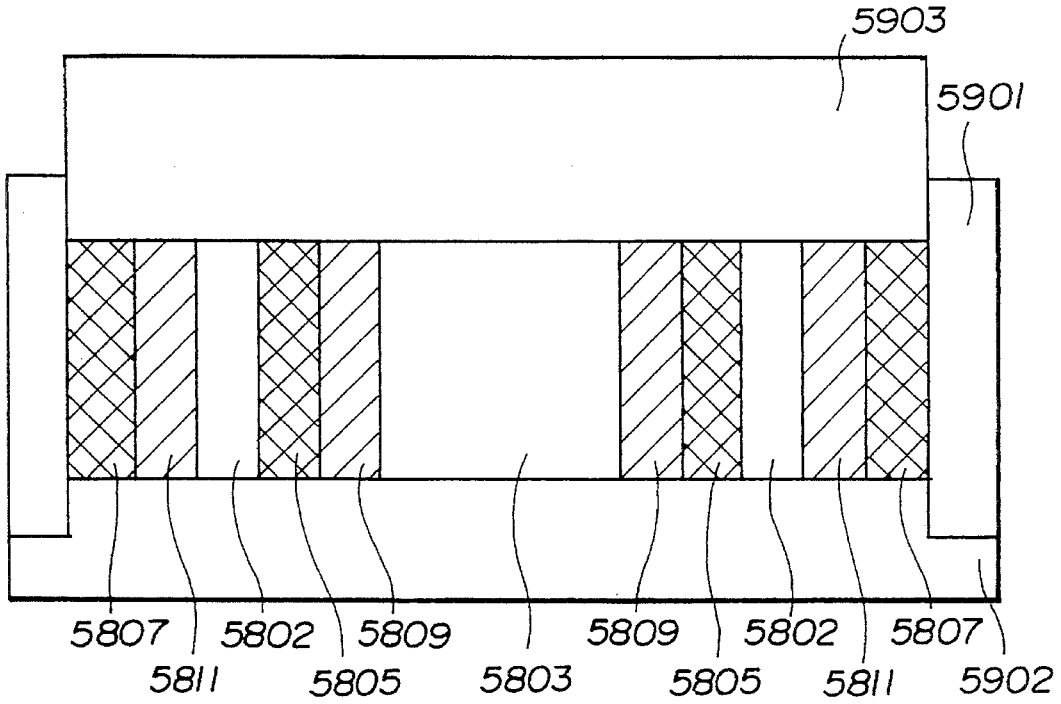
FIG. 58B is a sectional view used in explaining the method of production of the electromagnetic lens of the invention.
Figure 59:
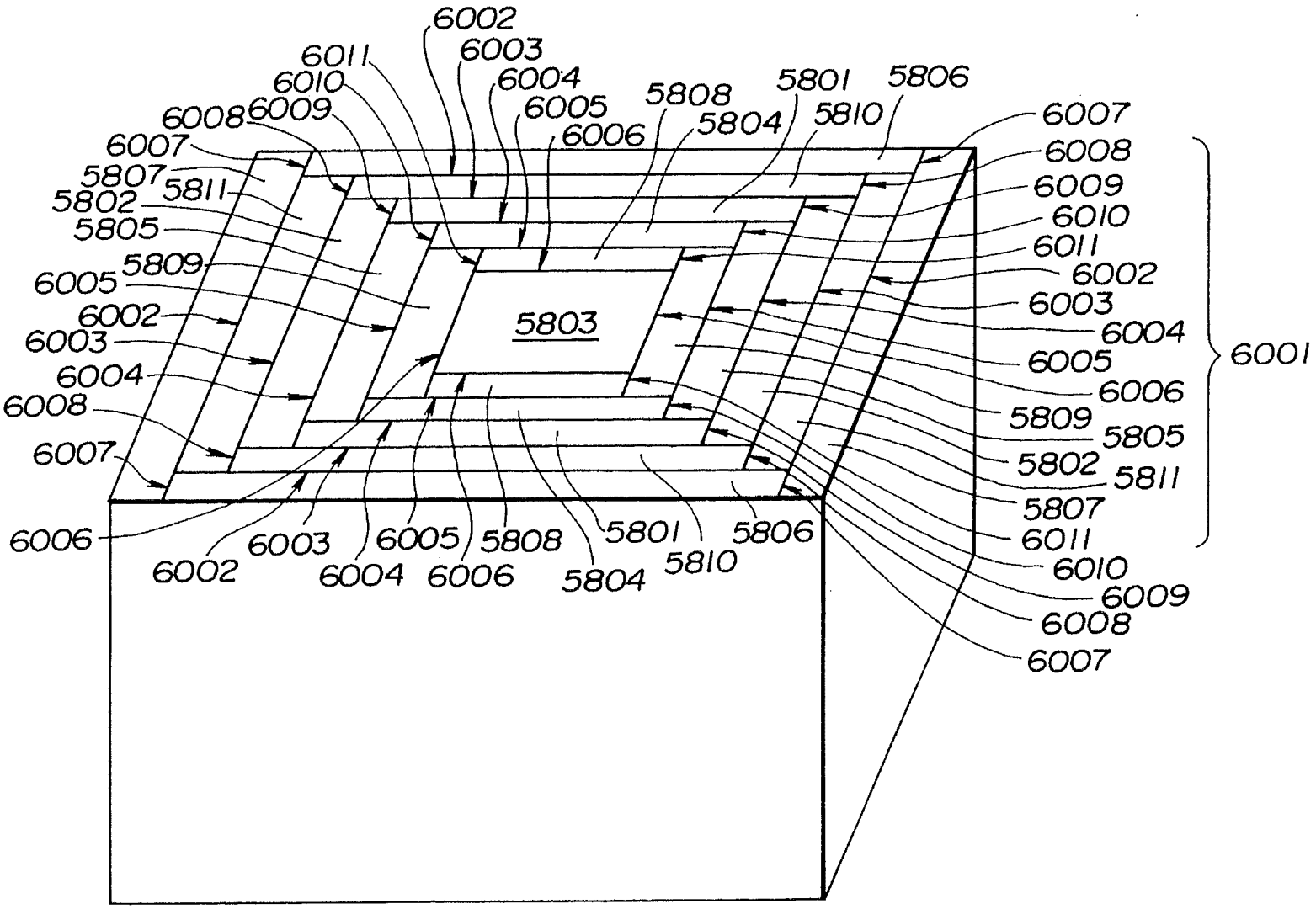
FIG. 59 is a perspective view showing the structure of the electromagnetic lens of the invention.

Referring to FIGS. 57–59, description will be made to a method of production of the electromagnetic lens of FIG. 55 with the use of a rectangular metal mold 5901 having a bottom 5902 and a force piston 5903. PTFE resin containing a first predetermined amount of oxide ceramic powder dispersed uniformly therein is sintered to produce oxide ceramic dispersed PTFE resin end plates 5807 having a first specific inductive capacity $\epsilon_{r3}$. The oxide ceramic dispersed PTFE resin end plates 5807 are placed in the metal mold 5901. PTFE resin containing a first predetermined amount of oxide ceramic powder dispersed uniformly therein is sintered to produce oxide ceramic dispersed PTFE resin side plates 5806 having a first specific inductive capacity $\epsilon_{r3}$. The oxide ceramic dispersed PTFE resin side plates 5806 are placed in the metal mold 5901 to form a first rectangular frame along with the oxide ceramic dispersed PTFE resin end plates 5807. PTFE resin containing a second predetermined amount of oxide ceramic powder dispersed uniformly therein is sintered to produce oxide ceramic dispersed PTFE resin end plates 5811 having a second specific inductive capacity $\epsilon_{r2}$. The oxide ceramic dispersed PTFE resin end plates 5811 are placed in the first rectangular frame formed in the metal mold 5901. PTFE resin containing a second predetermined amount of oxide ceramic powder dispersed uniformly therein is sintered to produce oxide ceramic dispersed PTFE resin side plates 5810 having a second specific inductive capacity $\epsilon_{r2}$. The oxide ceramic dispersed PTFE resin side plates 5810 are placed in the first rectangular frame formed in the metal mold 5901 to form a second rectangular frame along with the oxide ceramic dispersed PTFE resin end plates 5811. PTFE resin is sintered to produce PTFE resin end plates 5802. The PTFE resin end plates 5802 are placed in the second rectangular frame formed in the metal mold 5901. PTFE resin is sintered to produce PTFE resin side plates 5801. The PTFE resin side plates 5801 are placed in the second rectangular frame formed in the metal mold 5901 to form a third rectangular frame along with the PTFE resin end plates 5802. PTFE resin containing a first predetermined amount of oxide ceramic powder dispersed uniformly therein is sintered to produce oxide ceramic dispersed PTFE resin end plates 5805 having a first specific inductive capacity $\epsilon_{r3}$. The oxide ceramic dispersed PTFE resin end plates 5805 are placed in the third rectangular frame formed in the metal mold 5901. PTFE resin containing a first predetermined amount of oxide ceramic powder dispersed uniformly therein is sintered to produce oxide ceramic dispersed PTFE resin side plates 5804 having a first specific inductive capacity $\epsilon_{r3}$. The oxide ceramic dispersed PTFE resin side plates 5804 are placed in the third rectangular frame formed in the metal mold 5901 to form a fourth rectangular frame along with the oxide ceramic dispersed PTFE resin end plates 5805. PTFE resin containing a second predetermined amount of oxide ceramic powder dispersed uniformly therein is sintered to produce oxide ceramic dispersed PTFE resin end plates 5809 having a second specific inductive capacity $\epsilon_{r2}$. The oxide ceramic dispersed PTFE resin end plates 5809 are placed in the fourth rectangular frame formed in the metal mold 5901. PTFE resin containing a second predetermined amount of oxide ceramic powder dispersed uniformly therein is sintered to produce oxide ceramic dispersed PTFE resin side plates 5808 having a second specific inductive capacity $\epsilon_{r2}$. The oxide ceramic dispersed PTFE resin side plates 5808 are placed in the fourth rectangular frame formed in the metal mold 5901 to form a fifth rectangular frame along with the oxide ceramic dispersed PTFE resin end plates 5809. PTFE resin is sintered to produce a PTFE resin block 5803. The PTFE resin block 5803 is placed in the fifth rectangular frame formed in the metal mold 5901.

Thereafter, the force piston 5903 is used to pressurize the frames and block placed in the metal mold 5901. The appropriate surface pressure to be applied to the frames and block is greater than 10 Kgf/cm$^2$ and preferably in the range of 50 Kgf/cm$^2$ to 700 Kgf/cm$^2$. Under this pressurized condition, the frames and block are sintered for 3 hours at a temperature higher than the melting point (327° C.) of the PTFE resin. A preferable sintering temperature is 340° C. The resulting product is a PTFE resin electromagnetic lens block 6001, as shown in FIG. 59. The PTFE resin electromagnetic lens block 6001 is taken out of the metal mold 5901.

It was confirmed that the first rectangular frame was strongly fusion bonded at the boundary surface 6002 to the second rectangular frame, the second rectangular frame was strongly fusion bonded at the boundary surface 6003 to the third rectangular frame, the third rectangular frame was strongly fusion bonded at the boundary surface 6004 to the fourth rectangular frame, the fourth rectangular frame was strongly fusion bonded at the boundary surface 6005 to the fifth rectangular frame, and the fifth rectangular frame was strongly fusion bonded at the boundary surface 6006 to the center block. It was also confirmed that the end and side plates of the first, second, third, fourth and fifth rectangular frames were strongly fusion bonded at the respective boundary surfaces 6007, 6008, 6009, 6010 and 6011. Thereafter, the PTFE resin electromagnetic lens block 6001 is cut into a number of electromagnetic lenses as shown in FIG. 55.

What is claimed is:

1. A circuit element for microwave and millimeter-wave bands, comprising:

a dielectric line made of a pure dielectric resin; and a high-frequency wave absorbing member made of a pure dielectric resin containing at least one of first, second and third powders dispersed therein, the first powder having a high specific inductive capacity, the second powder having a high magnetic premeability, the third powder having a high specific resistance, the high-frequency wave absorbing member being fusion bonded as a unit to the dielectric line.

2. A circuit element for microwave and millimeter-wave bands, comprising:

a dielectric line made of a pure dielectric resin; and a high-frequency wave absorbing member made of a pure dielectric resin containing a powder dispersed therein, the powder having a high specific resistance;

the high-frequency wave absorbing member being fusion bonded at an inclined boundary to the dielectric line.

3. A circuit element for microwave and millimeter-wave bands, comprising:

a dielectric line made of a pure dielectric resin; and a high-frequency wave absorbing member fusion bonded to the dielectric line, the high-frequency wave absorbing member being made of a pure dielectric resin containing a percentage of a powder dispersed therein, the powder having a high specific resistance, the powder percentage changing in a direction away from the dielectric line.

4. A circuit element for microwave and millimeter-wave bands, comprising:

a dielectric line made of a pure dielectric resin; and a high-frequency wave absorbing member made of a pure dielectric resin containing a powder dispersed therein, the powder having a high magnetic permeability;

the high-frequency wave absorbing member being fusion bonded at an inclined boundary to the dielectric line.

5. A circuit element for microwave and millimeter-wave bands, comprising:

a dielectric line made of a pure dielectric resin; and a high-frequency wave absorbing member fusion bonded to the dielectric line, the high-frequency wave absorbing member being made of a pure dielectric resin containing a percentage of a powder dispersed therein, the powder having a high magnetic permeability, the powder percentage changing in a direction away from the dielectric line.

6. A circuit element for microwave and millimeter-wave bands, comprising:

a dielectric line made of a pure dielectric resin; and a high-frequency wave absorbing member made of a pure dielectric resin containing a powder dispersed therein, the powder having a high specific inductive capacity;

the high-frequency wave absorbing member being fusion bonded at an inclined boundary to the dielectric line.

7. A circuit element for microwave and millimeter-wave bands, comprising:

a dielectric line made of a pure dielectric resin; and a high-frequency wave absorbing member fusion bonded to the dielectric line, the high-frequency wave absorbing member being made of a pure dielectric resin containing a percentage of a powder dispersed therein, the powder having a high specific inductive capacity, the powder percentage changing in a direction away from the dielectric line.

8. A circuit element for microwave and millimeter-wave bands, comprising:

a dielectric line made of a pure dielectric resin; and a high-frequency wave absorbing member made of a pure dielectric resin containing two of first, second and third powders dispersed therein, the first powder having a high specific inductive capacity, the second powder having a high magnetic permeability, the third powder having a high specific resistance, the high-frequency wave absorbing member being fusion bonded as a unit to the dielectric line.

9. A circuit element for microwave and millimeter-wave bands, comprising:

a dielectric line made of a pure dielectric resin; and a high-frequency wave absorbing member made of a pure dielectric resin containing first, second and third powders dispersed therein, the first powder having a high specific inductive capacity, the second powder having a high magnetic permeability, the third powder having a high specific resistance, the high-frequency wave absorbing member being fusion bonded as a unit to the dielectric line.

* * * * *